US006331228B1

(12) United States Patent
Heath et al.

(10) Patent No.: US 6,331,228 B1
(45) **Date of Patent: *Dec. 18, 2001**

(54) PRINTED, SOFT, BULKY SINGLE-PLY ABSORBENT PAPER HAVING A SERPENTINE CONFIGURATION AND LOW SIDEDNESS

(75) Inventors: Michael S. Heath, Menasha; T. Philips Oriaran; Mark S. Siegel, both of Appleton; Frank D. Harper; John H. Dwiggins, both of Neenah, all of WI (US)

(73) Assignee: Fort James Corporation, Deerfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/568,664

(22) Filed: May 10, 2000

Related U.S. Application Data

(62) Division of application No. 09/075,689, filed on May 11, 1998, now Pat. No. 6,165,319.

(51) Int. Cl.[7] ..... D21H 17/07; B31F 1/07

(52) U.S. Cl. ..... 162/117; 162/109; 162/111; 162/164.6; 162/166; 162/179; 428/153; 428/176

(58) Field of Search ..... 162/111, 109, 162/164.6, 117, 112, 123, 127, 166, 179, 125, 132–133, 134, 113, 204–207; 428/153, 154, 174, 172, 156

(56) References Cited

U.S. PATENT DOCUMENTS 5,882,479 * 3/1999 Oriaran et al. ..... 162/112

* cited by examiner

*Primary Examiner*—Jose Fortuna

(57) ABSTRACT

The present invention relates to a soft, thick, single-ply, printed, absorbent paper product having a Yankee side and an air side wherein the absorbent paper is printed on before or after embossing on the Yankee side, air side, or both sides, said absorbent paper exhibiting a serpentine configuration. This inventions also relates to a process for the manufacture of such absorbent paper product having a basis weight of at least about 12.5 lbs. per 3000 square foot ream and having low sidedness, said tissue exhibiting: a specific total tensile strength of between 40 and 200 grams per 3 inches per pound per 3000 square foot ream, a cross direction specific wet tensile strength of between 2.75 and 20.0 grams per 3 inches per pound per 3000 square foot ream, the ratio of MD tensile to CD tensile of between 1.25 and 2.75, a specific geometric mean tensile stiffness of between 0.5 and 3.2 grams per inch per percent strain per pound per 3000 square foot ream, a friction deviation of less than 0.250, and a sidedness parameter of less than 0.30. These single-ply, printed, absorbent paper products in the form of unembossed or embossed single-ply bathroom tissue, facial tissue, or napkin are useful articles of commerce. The single-ply absorbent paper products exhibit a printed sidedness value of $\Delta E$ of less than 2.

31 Claims, 27 Drawing Sheets

(3 of 27 Drawing Sheet(s) Filed in Color)

Single–Ply Invention

One Ply of Commercial 2–Ply

Printed Single-Ply Invention-Yankee Side

Ink Strikethrough From Single-Ply Invention When Yankee Side Was Printed

Printed Single-Ply Invention-Air Side

Ink Strikethrough From Single-Ply Invention When Air Side Was Printed

Printed Commercial 2-Ply Substrate (top ply)-Yankee Side

Ink Strikethrough From Commercial 2-Ply When Top Ply Was Printed

Central Impression

Stack

In-Line

PRINTED, SOFT, BULKY SINGLE-PLY ABSORBENT PAPER HAVING A SERPENTINE CONFIGURATION AND LOW SIDEDNESS

This application is a division of application Ser. No. 09/075,689, filed May 11, 1998 now U.S. Pat. No. 6,165, 319.

BACKGROUND OF THE INVENTION

Through air drying has become the technology of preference for making one-ply absorbent paper for many manufacturers who build new absorbent paper machines as, on balance, through air drying ("TAD") offers many economic benefits as compared to the older technique of conventional wet-pressing ("CWP"). With through air drying, it is possible to produce a single-ply absorbent paper in the form of a tissue with good initial softness and bulk as it leaves the absorbent paper machine.

In the older wet pressing method, to produce a premium quality printed, absorbent paper, it has normally been preferred to combine two plies by embossing them together. In this way, the rougher air-side surfaces of each ply may be joined to each other and thereby concealed within the sheet. However, producing two-ply products, even on state of the art CWP machines, lowers paper machine productivity by about 20% as compared to a one-ply product. In addition, there may be a substantial cost penalty involved in the production of two-ply products because the parent rolls of each ply are not always of the same length, and a break in either of the single plies forces the operation to be shut down until it can be remedied. Also, it is not normally economic to convert older CWP tissue machines to TAD. But even though through air drying has often been preferred for new machines, conventional wet pressing is not without its advantages as well. Water may normally be removed from a cellulosic web at lower energy cost by mechanical means such as by overall compaction than by drying using hot air.

What has been needed in the art is a method of making a premium quality printed single-ply absorbent paper using conventional wet pressing having a high bulk and excellent softness attributes. In this way advantages of each technology could be combined so older CWP machines can be used to produce high quality printed single ply absorbent paper products in the form of bathroom tissue, facial tissue, and napkin at a cost which is far lower than that associated with producing two-ply absorbent paper. Two-ply absorbent papers are normally printed on the top ply. Any ink migration through the top ply (strikethrough) is hidden by the bottom ply, which also provides a barrier to further ink migration. In printing single-ply absorbent papers, it is important to prevent or minimize ink strikethrough onto process equipment, which can compromise process efficiency.

Among the more significant barriers to the production of printed single-ply CWP absorbent paper have been the generally low softness, thinness and the extreme sidedness of single-ply webs and their inability to hold the ink without having undesirable ink migration which renders the prior art one-ply products unprintable. An absorbent product's softness can be increased by lowering its strength, as it is known that softness and strength are inversely related. However, a product having very low strength will present difficulties in manufacturing and will be rejected by consumers as it will not hold up in use. Use of premium, low coarseness fibers, such as eucalyptus, and stratification of the furnish so that the premium softness fibers are on the outer layers of the tissue is another way of addressing the low softness of CWP products; however this solution is expensive to apply, both in terms of equipment and ongoing fiber costs. In any case, neither of these schemes addresses the problem of thinness of the web and the resulting unprintability of the absorbent paper product. TAD processes employing fiber stratification can produce a nice, soft, bulky sheet having adequate strength and good similarity of the surface texture on the front of the sheet as compared to the back. Having the same texture on front and back is considered to be quite desirable in these products or, more precisely, having differing texture is generally considered quite undesirable. Because of the deficiencies mentioned above, many single-ply CWP products currently found in the marketplace are typically low end products which cannot be printed. These products often are considered deficient in thickness, softness, and exhibit excessive two sidedness. Accordingly, these products have had rather low consumer acceptance and are typically used in "away from home" applications in which the person buying the tissue is not the user. It should be not that to date there are no commercially printed one-ply CWP absorbent paper products.

We have found that we can produce a soft, printed, high basis weight, high strength CWP bathroom tissue, facial tissue, and napkins with low sidedness having a serpentine configuration by judicious combination of several techniques as described herein. Basically, these techniques fall into five categories: (i) providing a web having a basis weight of at least 12.5 pounds for each 3000 square foot ream; (ii) optionally adding to the web a controlled amount of a temporary wet strength agent and softener/debonder; (iii) low angle, high percent crepe, high adhesion creping giving the product low stiffness and a high stretch; (iv) optionally embossing the tissue; and (v) printing one or both sides of the absorbent paper product either before or after embossing. By various combinations of these techniques as described, taught, and exemplified herein, it is possible to almost "dial in" for the printed absorbent paper the required degree of softness, strength, and sidedness depending upon the desired goals. The use of softeners having a melting range of about 1°–40° C. and being dispersible at a temperature of about 1°–100° C. suitably 1°–40° C. preferably 20°–25° C. further improves the properties of the novel printed, one-ply absorbent paper product having a serpentine configuration.

The confirmation that our products have a very low printed sidedness was obtained by printing the Yankee side and the air side of the absorbent paper and comparing the differences. Surprisingly, on visual inspection, no differences could be ascertained and by the use of a spectrodensitometer, the total color difference (ΔE) values supported the visual observation.

Samples were measured with an X-Rite 938 spectrodensitometer. A solid tone was measured for L*C*H° color space coordinates and ΔEcmc using a 4 mm aperture, D65 light source, 100 standard observer, 2:1:1 factor setting. As described in the X-Rite Color *Guide and Glossary*, L*C*H° is a three-dimensional cylindrical representation of color, where L* depicts Lightness, C* depicts Chroma (saturation), and H° depicts Hue angle. The X-Rite 938 Operation Manual defines ΔEcmc as a single numeric value that expresses total color difference between a sample and a standard. CMC tolerancing is a modification of the L*C*H°, providing better agreement between visual assessment and instrumentally measured color difference. The CMC calculation mathematically defines an ellipsoid around the standard color with semi-axis corresponding to hue, chroma, and lightness and allows for a user defined acceptance level. An average of three measurements were reported. Differences in total color (ΔE) were used to quantify similarity or differences in print appearance between the samples as a logical means to express relationships between the three-dimensional space of lightness, chroma, and hue angle. At an ΔEcmc value of ≦1.0, the standard observer would not detect differences in appearance between samples and at ΔE≦2.0, the differences would be very low. At ΔE≧3.0 differences would be readily observable. The backing ply was also measured for ink transfer using the same X-Rite settings. The amount of ink strikethrough on the backing ply was compared to white, non-print areas. Larger ΔE levels indicate a greater total level of strikethrough. Relative differences between samples of ΔEcmc≦1.0 indicate similar levels of strikethrough.

FIELD OF THE INVENTION

The present invention is directed to a printed, soft, strong in use, bulky single-ply absorbent paper product having a serpentine configuration and a low sidedness and processes for the manufacture of such paper. More particularly, this invention is directed to a printed, soft, strong-in-use, bulky, single-ply bathroom tissue, facial tissue, and napkin having a low printed sidedness, suitably a value of ΔE of less than 2, preferably less than 1 in addition to a low surface sidedness parameter of less than 0.3.

DESCRIPTION OF BACKGROUND ART

Paper is generally manufactured by suspending cellulosic fiber of appropriate geometric dimensions in an aqueous medium and then removing most of the liquid. The paper derives some of its structural integrity from the mechanical arrangement of the cellulosic fibers in the web, but most by far of the paper's strength is derived from hydrogen bonding which links the cellulosic fibers to one another. With paper intended for use as bathroom tissue, facial tissue or napkin, the degree of strength imparted by this inter-fiber bonding, while necessary to the utility of the product, can result in a lack of perceived softness that is inimical to consumer acceptance. One common method of increasing the perceived softness of bathroom tissue, facial tissue and napkin is to crepe the paper. Creping is generally effected by fixing the cellulosic web to a Yankee drum thermal drying means with an adhesive/release agent combination and then scraping the web off the Yankee by means of a creping blade. Creping, by breaking a significant number of inter-fiber bonds adds to and increases the perceived softness of resulting bathroom tissue product.

Another method of increasing a web's softness is through the addition of chemical softening and debonding agents. Compounds such as quaternary amines that function as debonding agents are often incorporated into the paper web. These cationic quaternary amines can be added to the initial fibrous slurry from which the paper web is subsequently made. Alternatively, the chemical debonding agent may be sprayed onto the cellulosic web after it is formed but before it is dried.

One-ply bathroom tissue, facial tissue and napkin, generally suffers from the problem of thinness and therefore unprintability, lack of softness, and also "sidedness." Sidedness is introduced into the sheet during the manufacturing process. The side of the sheet that was adhered to the Yankee and creped off, i.e., the Yankee side, is generally softer than the "air" side of the sheet. This two-sidedness is seen both in sheets that have been pressed to remove water and in unpressed sheets that have been subjected to vacuum and hot air (through-drying) prior to being adhered to the crepe dryer. The sidedness is present even after treatment with a softener. A premium one-ply bathroom tissue, facial tissue or napkin, should not only have a high overall softness level, but should also exhibit softness of each side approaching the softness of the other.

The most pertinent prior art patents will be discussed but, in our view, none of them can be fairly said to apply to the printed, one-ply, absorbent paper of this invention which exhibits high thickness, soft, strong and low sidedness attributes. In U.S. Pat. No. 5,164,045, Awofeso et al. disclose a soft, high bulk tissue. However, production of this product requires stratified foam forming and a furnish that contains a substantial amount of anfractuous and mechanical bulking fibers, none of which are necessary to practice the present invention; also, the paper products of U.S. Pat. No. 5,164,045 cannot be printed.

In U.S. Pat. No. 5,695,607, Oriaran, et al. disclose a low sidedness product, but the tissue is not printed. In addition, production of this product requires such strategies as fiber and/or chemical stratification that have been found unnecessary to produce the product of the present invention. Dunning et al., U.S. Pat. No. 4,166,001, discloses a double creped three-layered product having a weak middle layer. The Dunning product does not suggest the printed one-ply premium soft absorbent paper products of this invention having a serpentine configuration and also having a low printability sidedness (ΔE).

The foregoing prior art references do not disclose or suggest a printed, high-softness, strong one-ply absorbent paper product in the form of a bathroom tissue, facial tissue, or napkin having serpentine configuration and low sidedness and having a total specific tensile strength of no more than 200 grams per three inches per pound per 3000 square foot ream, optionally a cross direction wet tensile strength of at least 2.75 grams per three inches per pound per 3000 square foot ream, a specific geometric mean tensile stiffness of 0.5 to 3.2 grams per inch per percent strain per pound per 3,000 square foot ream, a GM friction deviation of no more than 0.25 and a sidedness parameter less than 0.3.

SUMMARY OF THE INVENTION

The novel premium quality printed, high-softness, single-ply absorbent paper product having a serpentine configuration and a very low "sidednebs" including low printability sidedness (ΔE) along with excellent softness, coupled with strength is advantageously obtained by using a combination of five processing steps.

Suitably, the printed premium softness, strong, low sidedness absorbent paper in the form of a bathroom tissue, facial tissue, or napkin has been prepared by utilizing techniques falling into five categories: (i) providing a web having basis weight of at least 12.5 pounds for each 3000 square foot ream; (ii) optionally adding to the web or to the furnish controlled amounts of a temporary wet strength agent and adding a softener/debonder preferably a softener dispersible in water at a temperature of about 1°–100° C. suitably 1°–40° C. advantageously 20°–25° C. Advantageously the softener should have a melting point below 40° C.; (iii) low angle, high adhesion creping using suitable high strength nitrogen containing organic adhesives and a crepe angle of less than 85 degrees, the relative speeds of the Yankee dryer and reel being controlled to produce a product having a final product MD stretch of at least 15%; and (iv)

optionally embossing the one-ply absorbent paper product preferably between matted emboss rolls; and (v) printing the paper product on one or both sides either before or after embossing. The furnish may include a mixture of softwood, hardwood, and recycled fiber. The premium softness and strong, single-ply, absorbent paper product having low sidedness may be suitably obtained from a homogenous former or from two-layer, three-layer, or multi-layer stratified formers.

Further advantages of the invention will be set forth in part in the description which follows. The advantages of the invention may be realized and attained by means of the instrumentalities and combinations particularly pointed out in the appended claims.

To achieve the foregoing advantages and in accordance with the purpose of the invention as embodied and broadly described herein, there is disclosed:

A method of making a printed, high-softness, high-basis weight, single-ply absorbent paper product having a serpentine configuration. This paper product is suitably in the form of a bathroom tissue, facial tissue, or napkin. The absorbent printed paper product is prepared by:

(a) providing a fibrous pulp of papermaking fibers;

(b) forming a nascent web from said pulp, wherein said web has a basis weight of at least about 12.5 lbs./3000 sq. ft. ream;

(c) optimally including in said web at least about 3 lbs./ton of a temporary wet strength agent and up to 10 lbs./ton of a nitrogen containing softener; optionally a cationic nitrogen containing softener; dispersible in water at a temperature of about 1°–100° C. suitably 1°–40° C. advantageously 20°–25° C., advantageously the softener has a melting point below 40° C.;

(d) dewatering said web;

(e) adhering said web to a Yankee dryer;

(f) creping said web from said Yankee dryer using a creping angle of less than 85 degrees, wherein the relative speeds between said Yankee dryer and the take-up reel is controlled to produce a final product MD stretch of at least about 15%;

(g) optionally calendering said web;

(h) optionally embossing said web preferably between matted emboss rolls; and (i) printing one or both sides of the web prior to or after embossing using either the rotogravure or flexographic printing process; and (j) forming a single-ply web wherein steps (a)–(f) and (i) and optionally steps (g) and (h) are controlled to result in a single-ply absorbent paper product in the form of a bathroom tissue, facial tissue, or napkin having a serpentine configuration and a total specific tensile strength of no more than 200 grams per three inches per pound per 3,000 square foot ream, suitably no more than 150 grams per three inches per pound per 3,000 square foot ream, preferably no more than 75 grams per three inches per pound per 3,000 square foot ream, a cross direction wet tensile strength of at least 2.7 grams per three inches per pound per ream, a specific geometric ream tensile stiffness of between 0.5 and 3.2 grams per inch per percent strain per pound per 3,000 square foot ream, a GM friction deviation of no more than 0.25 and a sidedness parameter less than 0.3 usually in the range of about 0.180 to about 0.250 and suitably the printed side has a $\Delta E$ value of less than 2, preferably less than 1, when the total specific tensile strength does not exceed 75 grams per three inches per pound per 3,000 square foot ream.

To summarize at a total specific tensile strength of about 200 grams per 3 inches or less per 3,000 square foot ream, the cross direction specific wet tensile strength is about 20 grams or less per 3,000 square foot ream, the ratio of MD tensile to CD tensile is between 1.25 and 2.75. The specific geometric mean tensile strength is 3.2 or less grams per inch per percent strain per pound per 3000 square foot ream. The friction deviation is less than 0.25 and the sidedness parameter is less than 0.30. At a total specific tensile strength of about 150 grams per 3 inches or less per 3000 square foot ream the cross direction specific wet tensile strength is about 15 grams or less per 3000 square foot ream, the ratio of MD tensile to CD tensile is between 1.25 and 2.75. The specific geometric ream tensile strength is 2.4 or less grams per inch per percent strain per pound per 3000 square foot ream. The friction deviation is less than 0.25 and the sidedness parameter is less than 0.30. When the absorbent paper in the form of a bathroom tissue, facial tissue or napkin exhibits a total specific tensile strength between 40 and 75 grams per 3 inches per 3000 square foot ream, it has a cross direction specific wet tensile strength of between 2.75 and 7.5 grams per 3 inches per pound per 3000 square foot ream, and its specific geometric mean tensile stiffness is between 0.5 and 1.2 grams per inch per percent strain per pound per 3000 square foot ream and its friction deviation is less than 0.225; and the tissue has sidedness parameter of less than 0.275.

In one embodiment of this invention, the one-ply, printed, absorbent paper product may be embossed with a pattern that includes a first set of bosses which resemble stitches, hereinafter referred to as stitch-shaped bosses, and at least one second set of bosses which are referred to as signature bosses. Signature bosses may be made up of any emboss design and are often a design which is related by consumer perception to the particular manufacturer of the tissue.

In another aspect of the present invention, a paper product is embossed with a wavy lattice structure which forms polygonal cells. These polygonal cells may be diamonds, hexagons, octagons, or other readily recognizable shapes. In one preferred embodiment of the present invention, each cell is filled with a signature boss pattern. More preferably, the cells are alternatively filled with at least two different signature emboss patterns.

In another preferred embodiment, one of the signature emboss patterns is made up of concentrically arranged elements. These elements can include like elements for example, a large circle around a smaller circle, or differing elements, for example a larger circle around a smaller heart. In a most preferred embodiment of the present invention, at least one of the signature emboss patterns are concentrically arranged hearts as can be seen in FIG. 6. Again, in a most preferred embodiment, another signature emboss element is a flower.

These one-ply absorbent papers in the form of a bathroom tissue, facial tissue, or napkin can suitably be printed on the Yankee or air side prior to or after embossing. The product can suitably be printed on both sides. In some applications the one-ply absorbent paper is not embossed hut designs are printed on it.

The printed, one-ply absorbent paper of this invention in the form of a bathroom tissue, facial tissue, or napkin has higher softness and strength parameters than prior art one-ply absorbent paper products and the embossed one-ply tissue product of the present invention has superior attributes than prior art one-ply embossed tissue products. The use of concentrically arranged emboss elements in one of the signature emboss patterns adds to the puffiness effects realized in the appearance of the paper product tissue. The puffiness associated with this arrangement is the result not only of appearance but also of an actual raising of the tissue upward.

BRIEF DESCRIPTION OF THE DRAWINGS

The present invention will become more fully understood from the detailed description given herein below and the accompanying drawings which are given by way of illustration only and thus are not limiting of the present invention.

The file of this patent contains at least one drawing executed in color. Copies of this patent with color drawing (s) will be provided by the Patent and Trademark Office upon request and payment of the necessary fee.

FIGS. 8A1, and 8B1 illustrate that for the printed product of this invention color intensity on the printed Yankee side and printed Air side are the same, thus further demonstrating equal printability on either side.

FIGS. 8A1, 8B1, and 8C1 demonstrate that color intensities of printed Yankee and Air sides of this invention are the same as color intensity of printed commercial two-ply tissue.

FIGS. 8A2, 8B2, and 8C2 illustrate that for the printed product of this invention ink strikethrough from the printed Yankee and Air sides are the same, but ink strikethrough is much lower than in commercial two-ply product.

In FIG. 10B, 62A is the fountain pan, and 62B is the oscillating doctor blade.

In FIG. 11A, 65 is impression roll; 66 is plate roll; 68 is engraved anilox roll; 69 is ink supply; and 73 is manifold. In FIG. 11B, 71 is rubber fountain roller; and 72 is in fountain pan.

FIGS. 14A–1 14A–2, 14A–3 and 14B illustrate one micro emboss pattern on one-ply absorbent paper product which is printed on one or both sides prior to or after embossing.

FIGS. 15A–1, 15A–2, 15A–3, 15B–1, 15B–2, 15B–3, 15C and FIG. 5 illustrate another micro emboss pattern on one-ply absorbent paper products which is printed on one or both sides prior to or after embossing.

DETAILED DESCRIPTION OF THE PREFERRED EMBODIMENTS

A design can be printed either in-line or off-line of a converting process to either side of a one-ply CWP absorbent paper product in the form of a bathroom tissue, facial tissue, or a napkin exhibiting low sidedness using two conventional printing processes.

Rotogravure is an intaglio printing method offering precise ink application and transfer of a desired design image by use of a precisely etched roller surface. Design total area and color intensity can be varied by adjustment to small spaced engraved deposits (i.e., cells) in the roller surface. Design coverage can vary from 1–90% of coverage preferably 1–80% coverage. Engraving can be accomplished by chemical acid etch or electromechanical methods, with a preference for the latter method. The engraving will use a range between 100 to 200 lines per inch with engraving depths ranging between 5 to 50 microns.

Figure 10A:
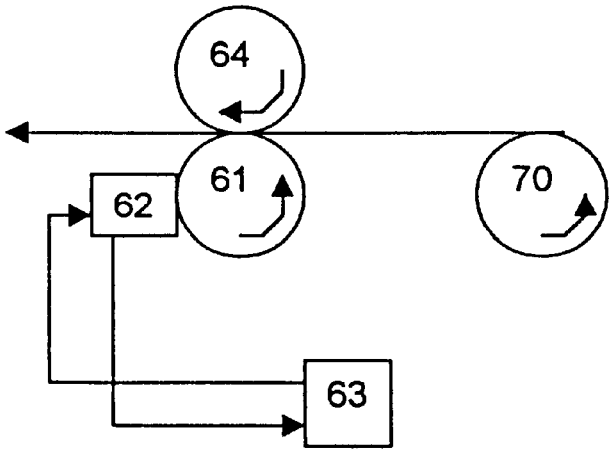
FIGS. 10A and 10B illustrate suitable direct gravure printing processes.
Figure 10B:
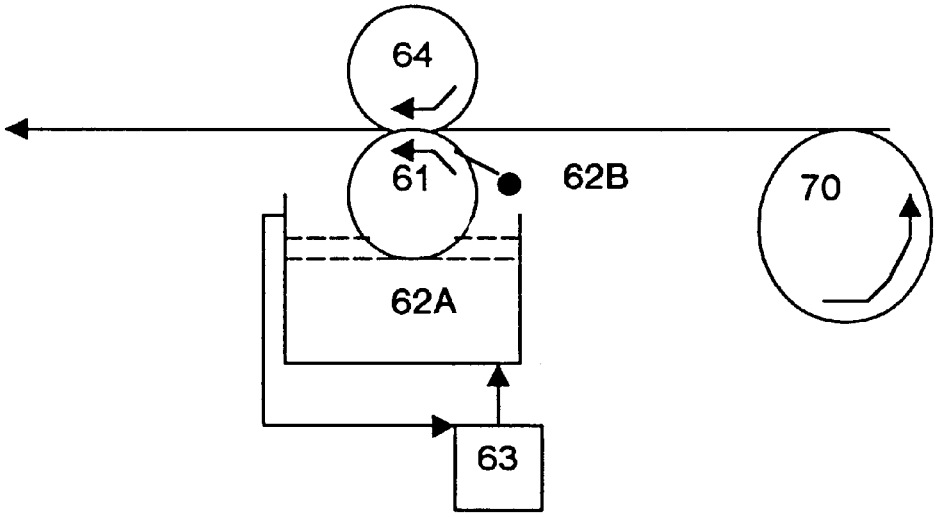
Figure 12A:
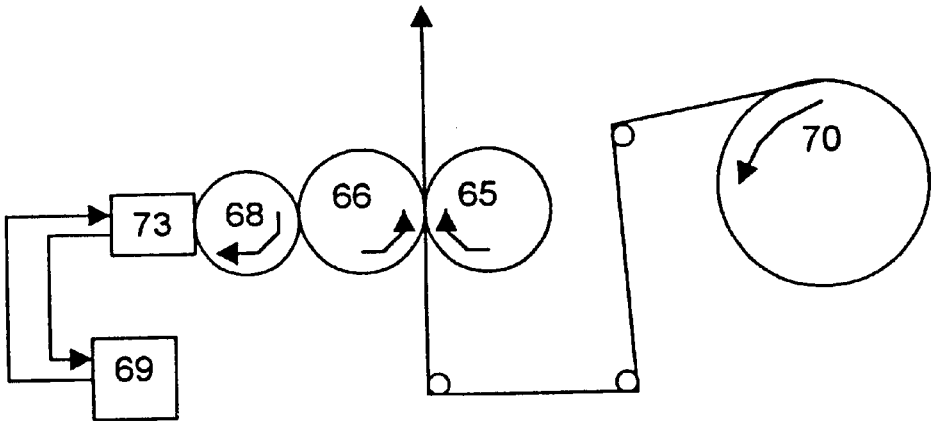
FIG. 12A and FIG. 12B illustrate suitable offset gravure processes.
Figure 12B:
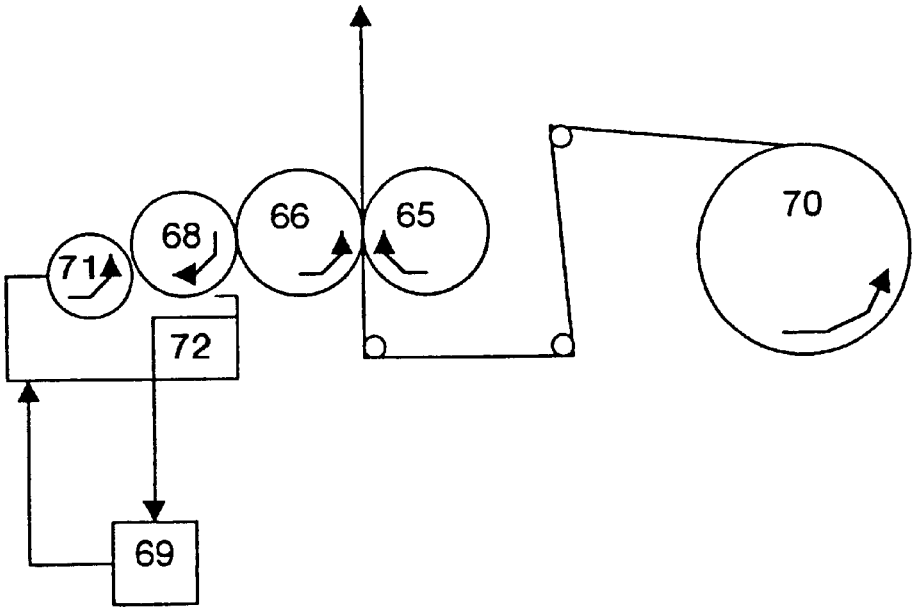

Direct rotogravure is the preferred gravure method of choice, as shown in FIGS. 10A and 10B, but offset gravure, illustrated in FIGS. 12A and 12B, are also suitable methods. The design image is transferred to the one-ply CWP substrate when the web (FIG. 10A, Number 70) is passed in contact between the engraved roller (61) and a covered impression roller (64). This impression roller (64) covering can be a natural or synthetic rubber with a durometer between 60 and 90 Shore A. Contact between the rollers will range from 0.250 to 0.625 inches. Ink is recirculated from a supply source (63) to an applicator head (62) which is in contact with the engraved roller (61). Solvent or waterbased inks are suitably used with a preference for waterbased inks at dilution ratios ranging between 10 to 20 parts water to 1 part concentrated ink.

Either Yankee or air side substrate side can be printed using direct gravure as shown in FIGS. 10A and 10B. Both sides can be printed by use of two print stations in sequence. Multi-color designs on one surface can be offered by use of print stations in sequence. The printing can be conducted prior to embossing or after embossing.

Figure 11A:
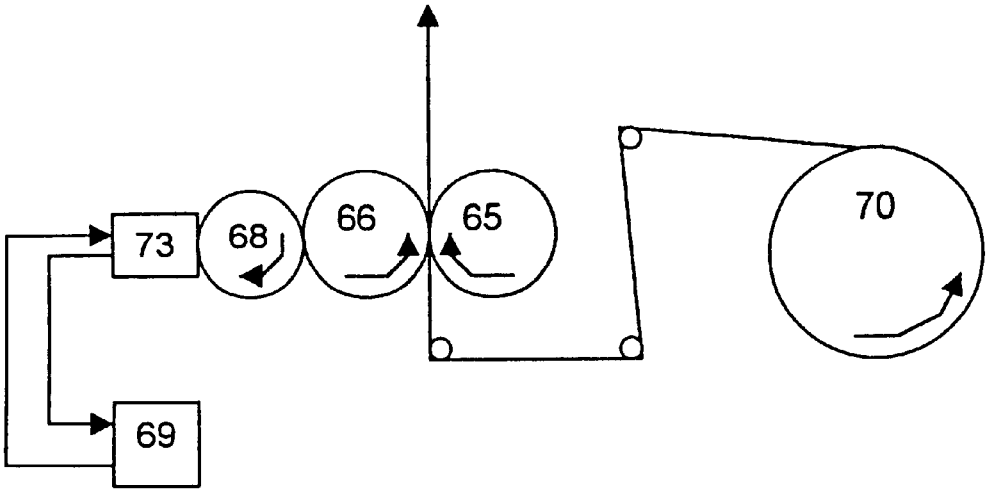
FIG. 11A and FIG. 11B illustrate suitable flexographic printing processes.
Figure 11B:
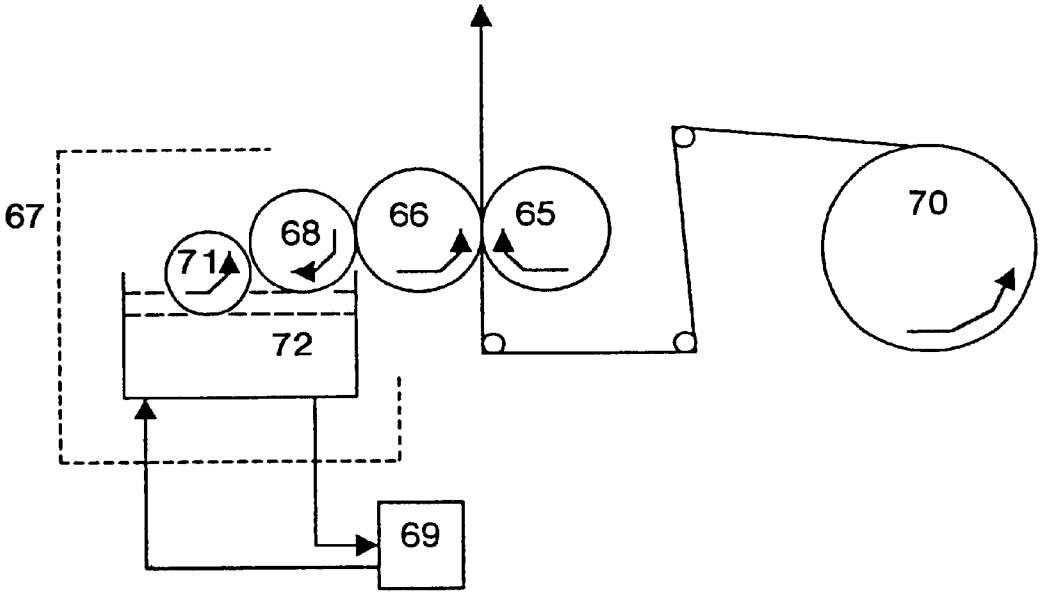

Flexographic printing, illustrated in FIGS. 11A and 11B, is a rotary relief printing method where the desired design image employing an elastometric material is raised above non-printing areas on a roller surface. The elastometric material can be molded or laser engraved natural or synthetic rubber, or photopolymer and is commonly referred to as a plate cylinder when mounted on a roller. A durometer range between 35 and 65 Shore A is used for the elastometric material.

Ink is transferred to the elastometric raised image by means of an engraved roller referred to as an anilox roller. Engraved small spaced deposits can be varied to control the volume of ink transferred to the raised image when the anilox roller is in contact with the plate cylinder. The amount of this contact ranges between 0.002 to 0.012 inch. Ink is recirculated from a supply pump to an applicator head in direct contact with the engraved anilox roller. The engraved roller does not transfer ink directly to the one-ply CWP substrate, thus differs from the direct rotogravure method. The amount of ink transferred can be controlled by specification of the engraving volume. A range of volume between 1.0 and 10.0 billion cubic micron per square inch is suitable for one-ply CWP tissue. The design image is transferred (FIG. 11) from the plate to the one-ply CWP tissue when the web is passed in contact between the plate cylinder and an impression roller. This is shown in FIGS. 13A, 13B, and 13C or FIGS. 11A and 11B. The impression roller is commonly a metal roller or hard elastometric material. The amount of contact between the plate cylinder and impression roller ranges between 0.002 to 0.012 inch.

Figure 13A:
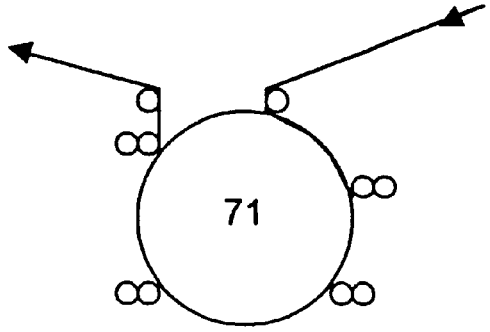
FIGS. 13A, 13B, and 13C illustrate suitable press designs. a central impression, stack and in-line flexographic press design.
Figure 13B:
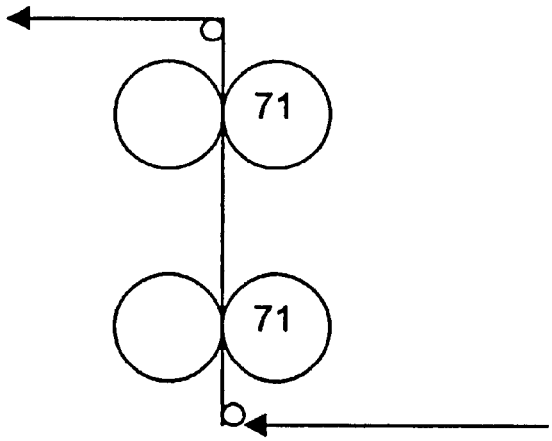
Figure 13C:
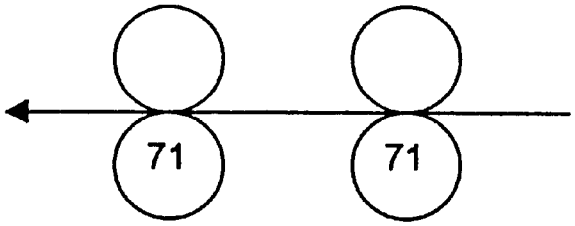
Figures 1, 14A:
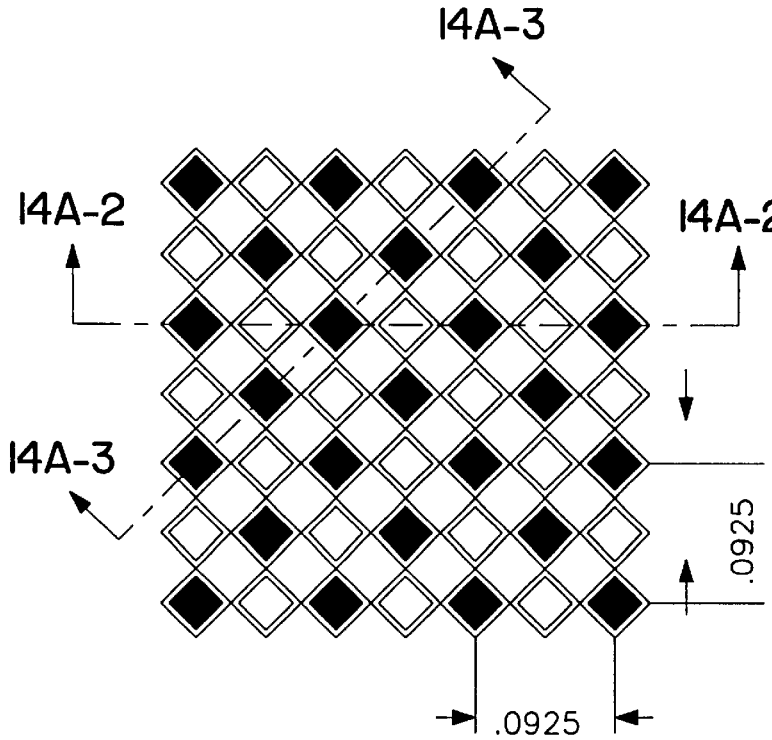
Figures 3, 14A:
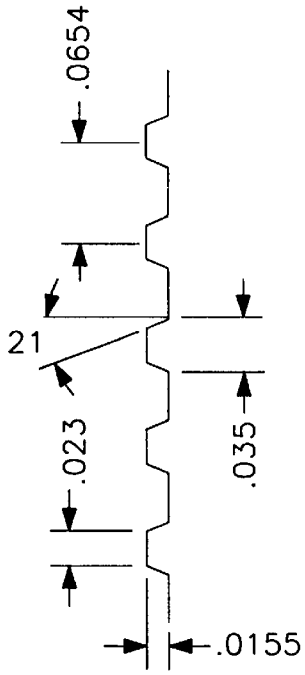
Figures 2, 14A:
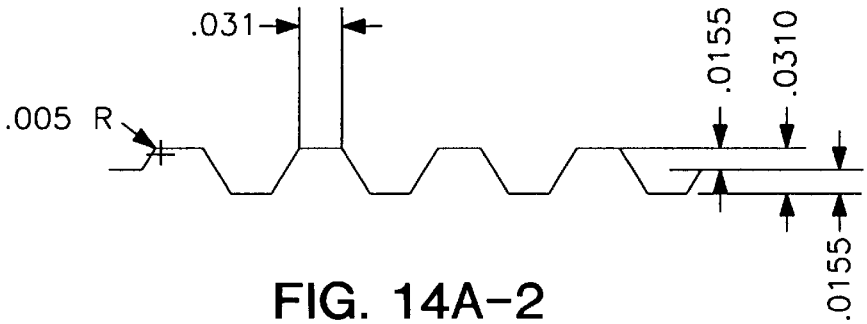
Figure 14B:
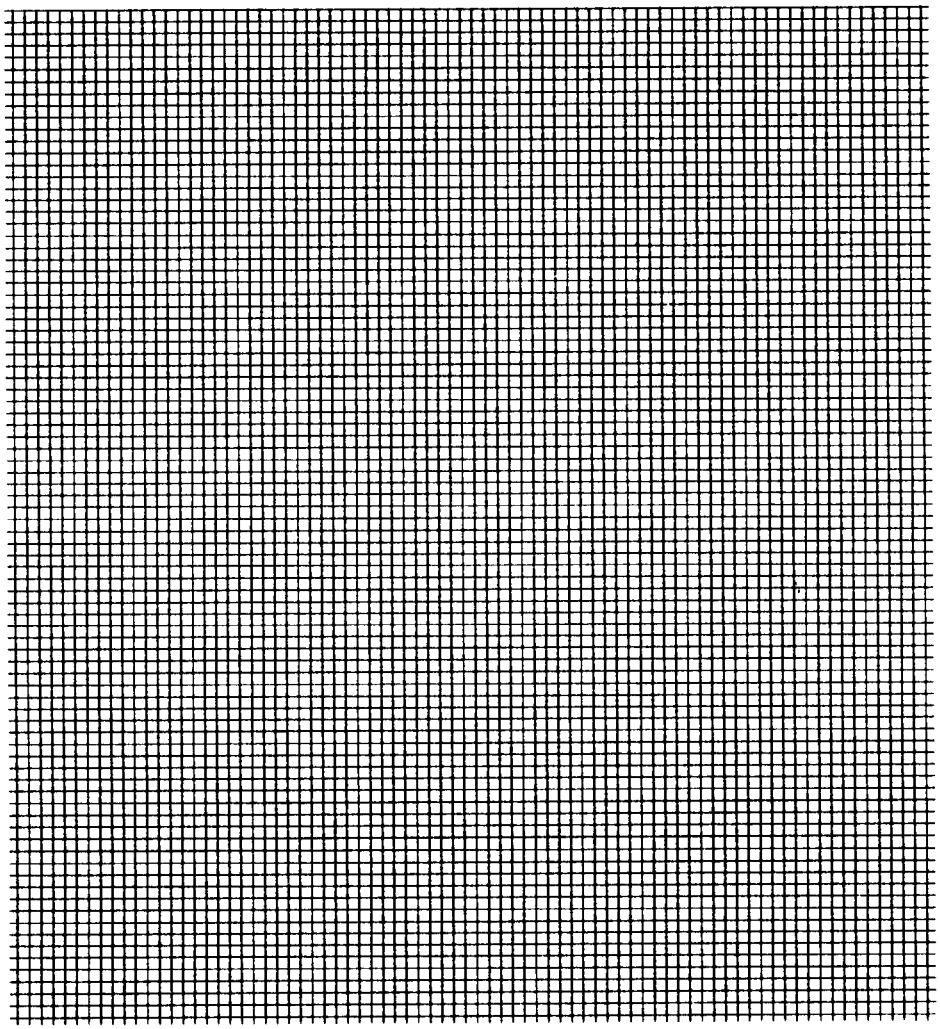

In the printing of one-ply absorbent paper products in the form of bathroom tissues, facial tissue, or napkins, a multicolor design is suitably produced by use of central impression (FIG. 13A), stack (FIG. 13B), or in-line press configurations (FIG. 13C).

Central impression is the preferred press design since it offers the best color-to-color registration.

The printing technology is further discussed after Example 26.

The paper products of the present invention, e.g., single-ply tissue having one, two, three, or more layers, may be manufactured on any papermaking machine of conventional forming configurations such as fourdrinier, twin-wire, suction breast roll, or crescent forming configurations.

Figure 9:
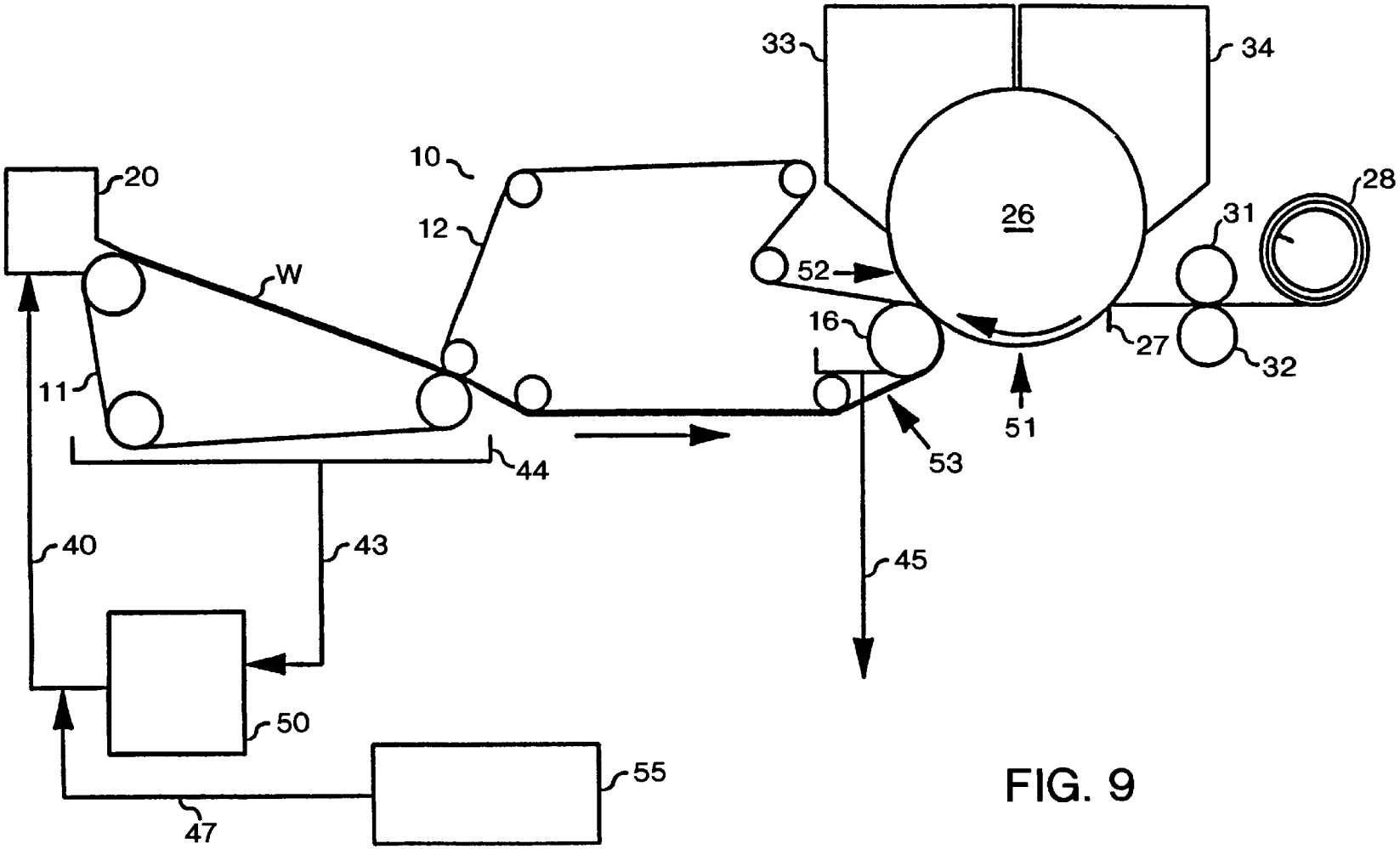
FIG. 9 is a schematic flow diagram of the papermaking process showing suitable points of addition of charge less temporary wet strength chemical moieties and optionally starch and softener/debonder.

FIG. 9 illustrates an embodiment of the present invention wherein machine chest (55) is used for preparing the papermaking furnish. Functional chemicals such as dry strength agents, temporary wet strength agents and softening agents may be added to the furnish in the machine chest (55) or in conduit (47). The furnish may be treated sequentially with chemicals having different functionality depending on the character of the fibers that constitute the furnish, particularly their fiber length and coarseness, and depending on the precise balance of properties desired in the final product. The furnish is diluted to a low consistency, typically 0.5% or less, and transported through conduit (40) to headbox (20) of a paper machine (10). FIG. 9 includes a web-forming end or wet end with a liquid permeable foraminous forming fabric (11) which may be of any conventional configuration.

A wet nascent web (W) is formed in the process by ejecting the dilute furnish from headbox (20) onto forming fabric (11). The web is dewatered by drainage through the forming fabric, and additionally by such devices as drainage foils and vacuum devices (not shown). The water that drains through the forming fabric may be collected in savall (44) and returned to the papermaking process through conduit (43) to silo (50), from where it again mixes with the furnish coming from machine chest (55).

From forming fabric (11), the wet web is transferred to felt (12). Additional dewatering of the wet web may be provided prior to thermal drying, typically by employing a nonthermal dewatering means. This nonthermal dewatering is usually accomplished by various means for imparting mechanical compaction to the web, such as vacuum boxes, slot boxes, contacting press rolls, or combinations thereof. The wet nascent web (W) is carried by the felt (12) to the pressing roll (16) where the wet nascent web (W) is transferred to the drum of a Yankee dryer (26). Fluid is pressed from the wet web (W) by pressing roll (16) as the web is transferred to the drum of the Yankee dryer (26) at a fiber consistency of at least about 5% up to about 50%, preferably at least 15% up to about 45%, and more preferably to a fiber consistency of approximately 40%. The web is then dried by contact with the heated Yankee dryer and by impingement of hot air onto the sheet, said hot air being supplied by hoods (33) and (34). The web is then creped from the dryer by means of a creping blade (27). The finished web may be pressed between calendar rolls (31) and (32) and is then collected on a take-up roll (28).

Adhesion of the partially dewatered web to the Yankee dryer surface is facilitated by the mechanical compressive action exerted thereon, generally using one or more pressing rolls (16) that form a nip in combination with thermal drying means (26). This brings the web into more uniform contact with the thermal drying surface. The attachment of the web to the Yankee dryer may be assisted and the degree of adhesion between the web and the dryer controlled by application of various creping aids that either promote or inhibit adhesion between the web and the dryer (26). These creping aids are usually applied to the surface of the dryer (26) at position (51), prior to its contacting the web.

Also shown in FIG. 9 are the location for applying functional chemicals to the already-formed cellulosic web. According to one embodiment of the process of the invention, the temporary wet strength agent can be applied directly on the Yankee (26) at position (51) prior to application of the web thereto. In another preferred embodiment, the wet strength agent can be applied from position (52) or (53) on the air-side of the web or on the Yankee side of the web respectively. Softeners are suitably sprayed on the air side of the web from position (52) or on the Yankee side from position (53) as shown in FIG. 9. The softener/debonder can also be added to the furnish prior to its introduction to the headbox (20). Again, when a starch based temporary wet strength agent is added, it should be added to the furnish prior to web formation. The softener may be added either before or after the starch has been added, depending on the balance of softness and strength attributes desired in the final product. In general, when temporary wet strength agents are employed, charged temporary wet strength agents are added to the furnish prior to its being formed into a web, while uncharged temporary wet strength agents are added to the already formed web as shown in FIG. 9.

Papermaking fibers used to form the soft absorbent, single-ply products of the present invention include cellulosic fibers commonly referred to as wood pulp fibers, liberated in the pulping process from softwood (gymnosperms or coniferous trees) and hardwoods (angiosperms or deciduous trees). Cellulosic fibers from diverse material origins may be used to form the web of the present invention, including non-woody fibers liberated from sugar cane, bagasse, sabai grass, rice straw, banana leaves, paper mulberry (i.e., bast fiber), abaca leaves, pineapple leaves, esparto grass leaves, and fibers from the genus Hesperaloe in the family Agavaceae. Also recycled fibers which may contain any of the above fibers sources in different percentages are used in the present invention. Suitable fibers are disclosed in U.S. Pat. Nos. 5,320,710 and 3,620,911, both of which are incorporated herein by reference.

Papermaking fibers can be liberated from their source material by any one of the number of chemical pulping processes familiar to one experienced in the art including sulfate, sulfite, polysulfite, soda pulping, etc. The pulp can be bleached if desired by chemical means including the use of chlorine, chlorine dioxide, oxygen, etc. Furthermore, papermaking fibers are liberated from source material by any one of a number of mechanical/chemical pulping processes familiar to anyone experienced in the art including mechanical pulping, thermomechanical pulping, and chemi thermomechanical pulping. These mechanical pulps are bleached, if one wishes, by a number of familiar bleaching schemes including alkaline peroxide and ozone bleaching. The type of furnish is less critical than is the case for prior art products. A significant advantage of the invention over the prior art processes is that coarse hardwoods and softwoods and significant amounts of recycled fiber are utilized to create a soft product in the process of this invention while prior art one-ply products had to be prepared from more expensive low-coarseness softwoods and low-coarseness hardwoods such as eucalyptus.

Using an alternate embossing system, printed premium quality high-softness, single-ply absorbent paper products having a very low "sidedness" along with excellent softness, coupled with strength are advantageously obtained by using a combination of five processing steps.

Suitably, the premium softness, strong, low sidedness bathroom tissue has been prepared by utilizing techniques falling into five categories: (i) providing a web having basis weight of at least 12.5 pounds for each 3,000 square foot ream; (ii) optionally adding to the web or to the furnish controlled amounts of a temporary wet strength agent and a softener/debonder; (iii) low angle, high adhesion creping using suitable high strength nitrogen containing organic adhesives and a crepe angle of less than 85 degrees, the relative speeds of the Yankee dryer and a reel being controlled to produce a product MD stretch of at least 15%; (iv) embossing the tissue between mated emboss rolls, each of which has both male and female elements; and (v) printing the absorbent paper sheet on one or both sides prior to embossing or after embossing. The furnish may include a mixture of softwood, hardwood, and recycled fiber. The premium softness and strong single-ply tissue having low sidedness may be suitably obtained from a homogenous former or from two-layer, three-layer, or multi-layer stratified formers.

To achieve the foregoing advantages and in accordance with the purpose of the invention as embodied and broadly described herein, there is disclosed:

A method of making a printed, absorbent, high-softness, high-basis weight, single-ply tissue comprising:

(a) providing a fibrous pulp of papermaking fibers;

(b) forming a nascent web from said pulp, wherein said web has a basis weight of at least about 12.5 pounds per 3000 square foot ream;

(c) including in said web at least about 3 pounds per ton of a temporary wet strength agent and up to 10 pounds per ton of a nitrogen containing softener; optionally a cationic nitrogen containing softener;

(d) dewatering said web;

(e) adhering said web to a Yankee dryer;

(f) creping said web from said Yankee dryer using a creping angle of less than 85 degrees, wherein the relative speeds between said Yankee dryer and the take-up reel is controlled to produce a final product MD stretch of at least about 15%;

(g) optionally calendering said web;

(h) embossing said web between mated emboss rolls, each of which contains both male and female elements;

(i) printing said web on one side or both sides, optionally before or after embossing;

(j) forming a single-ply web wherein steps (a)–(f) and (h)–(i) and optionally step (g) are controlled to result in a single-ply tissue product having a total tensile strength of between 40 and 200 grams per three inches per pound per ream basis weight, a cross direction wet tensile strength of between 2.75 and 20 grams per three inches per pound per 3000 square foot ream of basis weight, the ratio of MD tensile to CD tensile of between 1.25 and 2.75, a specific geometric mean tensile stiffness of 0.5 to 3.2 grams per inch per percent strain per pound per 3000 square foot ream, a ratio of product cross direction stretch to base sheet cross direction stretch of at least about 1.4, a GM friction deviation of no more than 0.225, and a sidedness parameter less than 0.3 usually in the range of about 0.180 to about 0.250.

There is also disclosed a single-ply tissue produced by a wet pressing technique, having a total tensile strength of no more than 75 grams per three inches per pound per ream basis weight, a cross direction wet tensile strength of at least 2.7 grams per three inches per pound per ream of basis weight, a tensile stiffness of no more than about 1.1 grams per inch per percent strain per pound per ream basis weight, a ratio of produce cross direction stretch to base sheet cross direction stretch of at least about 1.4, a GM friction deviation of no more than 0.225 and a sidedness parameter less than 0.275 usually in the range of about 0.180 to about 0.250.

To reach the attributes needed for a premium printed, one-ply absorbent paper product, the paper product of the present invention should optionally be treated with a temporary wet strength agent. It is believed that the inclusion of the temporary wet strength agent facilitates the absorbent paper in the form of a bathroom tissue, facial tissue, or napkin to hold up in use despite its high softness level for a one-ply CWP product and consequently its relatively low level of dry strength. The bathroom tissues, facial tissues, and napkins of this invention having a suitable level of temporary wet strength are generally perceived as being stronger and thicker in use than similar products having low wet strength values. Suitable wet strength agents comprise an organic moiety and suitably include water soluble aliphatic dialdehydes or commeclally available water soluble organic polymers comprising aldehydic units, and cationic starches containing aldehyde moieties. These agents are suitably used singly or in combination with each other.

Suitable temporary wet strength agents are aliphatic and aromatic aldehydes including glyoxal, malonic dialdehyde, succinic dialdehyde, glutaraldehyde, dialdehyde starches, polymeric reaction products of monomers or polymers having aldehyde groups and optionally nitrogen groups. Representative nitrogen containing polymers which can suitably be reacted with the aldehyde containing monomers or polymers include vinylamide, acrylamide, and related nitrogen containing polymers These polymers impart a positive charge to the aldehyde containing reaction product.

We have found that condensates prepared from dialdehydes such as glyoxal or cyclic urea and polyol both containing aldehyde moieties are useful for producing temporary wet strength. Since these condensates do not have a charge, they are added to the web as shown in FIG. 9 before or after the pressing roll (16) or charged directly on the Yankee surface. Suitably these temporary wet strength agents are sprayed on the air side of the web prior to drying on the Yankee as shown in FIG. 9 from position 52.

The preparation of cyclic ureas is disclosed in U.S. Pat. No. 4,625,029 herein incorporated by reference in its entirety. Other U.S. Patents of interest disclosing reaction products of dialdehydes with polyols include U.S. Pat. Nos. 4,656,296; 4,547,580; and 4,537,634 and are also incorporated into this application by reference in their entirety. The dialdehyde moieties expressed in the polyols render the whole polyol useful as a temporary wet strength agent in the manufacture of the one-ply tissue of this invention. Suitable polyols are reaction products of dialdehydes such as glyoxal with polyols having at least a third hydroxyl group. Glycerin, sorbitol, dextrose, glycerin monoacrylate, and glycerin monomaleic acid ester are representative polyols useful as temporary wet strength agents.

Polysaccharide aldehyde derivatives are suitable for use in the manufacture of the tissues of this invention. The polysaccharide aldehydes are disclosed in U.S. Pat. Nos. 4,983,748 and 4,675,394. These patents are incorporated by reference into this application. Suitable polysaccharide aldehydes have the following structure:

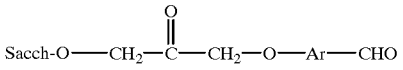

wherein Ar is an aryl group. This cationic starch is a representative cationic moiety suitable for use in the manufacture of the tissue of the present invention and can be charged with the furnish. A starch of this type can also be used without other aldehyde moieties but, in general, should be used in combination with a cationic softener.

The tissues of this invention suitably include polymers having non-nucleophilic water soluble nitrogen heterocyclic moieties in addition to aldehyde moieties. Representative resins of this type are:

A. Temporary wet strength polymers comprising aldehyde groups and having the formula:

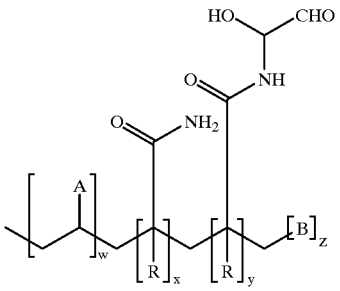

wherein A is a polar, non-nucleophilic unit which does not cause said resin polymer to become water-insoluble; B is a hydrophilic, cationic unit which imparts a positive charge to the resin polymer; each R is H, $C_1$–$C_4$ alkyl or halogen; wherein the mole percent of W is from about 58% to about 95%; the mole percent of X is from about 3% to about 65%; the mole percent of Y is from about 1 % to about 20%; and the mole percent from Z is from about 1 % to about 10%; said resin polymer having a molecular weight of from about 5,000 to about 200,000.

B. Water soluble cationic temporary wet strength polymers having aldehyde units which have molecular weights of from about 20,000 to about 200,000, and are of the formula:

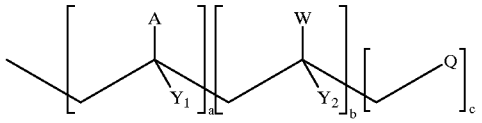

wherein A is

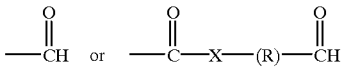

and X is —O—, —NH—, or —$NCH_3$— and R is a substituted or unsubstituted aliphatic group; $Y_1$ and $Y_2$ are independently —H, —$CH_3$, or a halogen, such as C1 or F; W is a non-nucleophilic, water-soluble nitrogen h-eterocyclic moiety; and Q is a cationic monomeric unit. The mole percent of "a" ranges from about 30% to about 70%, the mole percent of "b" ranges from about 30% to about 70%, and the mole percent of "c" ranges from about 1% to about 40%.

The temporary wet strength resin may be any one of a variety of water soluble organic polymers comprising aldehydic units and cationic units used to increase the dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769; and 5,217,576. Among the preferred temporary wet strength resins that are used in practice of the present invention are modified starches sold under the trademarks Co-Bond® 1000 and Co-Bond® 1000 Plus by Nations Starch and Chemical Company of Bridgewater, N.J. Prior to use, the cationic aldehydic water soluble polymer is prepared by preheating an aqueous slurry of approximately 5% solids maintained at a temperature of approximately 240° Fahrenheit and a pH of about 2.7 for approximately 3.5 minutes. Finally, the slurry is quenched and diluted by adding water to produce a mixture of approximately 1.0% solids at less than about 130° F.

Co-Bond® 1000 is a commercially available temporary wet strength resin including an aldehydic group on cationic corn waxy hybrid starch. The hypothesized structure of the molecules are set forth as follows:

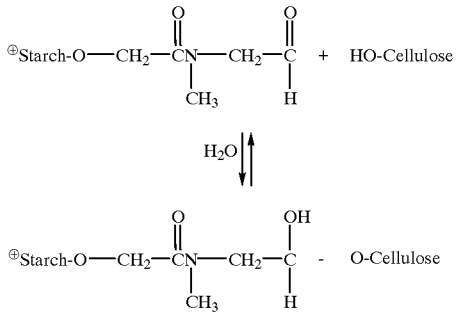

Other preferred temporary wet strength resins, also available from the National Starch and Chemical company are sold under the trademarks Co-Bond® 1600 and Co-Bond® 2500. These starches are supplied as aqueous colloidal dispersions and do not require preheating prior to use.

Suitably the Parez wet strength agents may also be used. A representative wet strength agent is Parez 745 which is glyoxylated polyacrylamide.

In the preferred embodiment, in addition to the temporary wet strength agent, the one-ply absorbent paper in the form of a bathroom tissue, facial tissue, or napkin also contains one or more softeners. These softeners are suitably nitrogen containing organic compounds preferably cationic nitrogenous softeners and may be selected from trivalent and tetravalent cationic organic nitrogen compounds incorporating long fatty acid chains; compounds including imidazolines, amino acid salts, linear amine amides, tetravalent or quaternary ammonium salts, or mixtures of the foregoing. Other suitable softeners include the amphoteric softeners which may consist of mixtures of such compounds as lecithin, polyethylene glycol (PEG), castor oil, and lanolin. For optimum results the softeners should be dispersible in water at a temperature of about 1° C. to 100° C. suitably 1° C. to 40° C. preferably at ambient temperatures. For maximum perception of softness in the tissue, the softeners should have a melting point below 40° C.

The present invention may be used with a particular class of softener materials—amido amine salts derived from partially acid neutralized amines. Such materials are disclosed in U.S. Pat. No. 4,720,383; column 3, lines 40–41. Also relevant are the following articles: Evans, *Chemistry and Industry*, Jul. 5, 1969, pp. 893–903; Egan, *J. Am. Oil Chemist's Soc.*, Vol. 55 (1978), pp. 118–121; and Trivedi et al., *J. Am. Oil Chemist's Soc.*, June 1981, pp. 754–756. All of the above are incorporated herein by reference. As indicated therein, softeners are often available commercially only as complex mixtures rather than as single compounds. While this discussion will focus on the predominant species, it should be understood that commercially available mixtures would generally be used to practice the invention.

The softener having a charge, usually cationic softeners, can be supplied to the furnish prior to web formation, applied directly onto the partially dewatered web or may be applied by both methods in combination. Alternatively, the softener may be applied to the completely dried, creped sheet, either on the paper machine or during the converting process. Softeners having no charge are applied at the dry end of the papermaking process.

The softener employed for treatment of the furnish is provided at a treatment level that is sufficient to impart a perceptible degree of softness to the paper product but less than an amount that would cause significant runability and sheet strength problems in the final commercial product. The amount of softener employed, on a 100% active basis, is suitably from about 1.0 pound per ton of furnish up to about 10 pounds per ton of furnish; preferably from about 2 to about 7 pounds per ton of furnish.

Imidazoline-based softeners that are added to the furnish prior to its formation into a web have been found to be particularly effective in producing soft absorbent paper products in the form of bathroom tissue, facial tissue, and napkin products and constitute a preferred embodiment of this invention. Of particular utility for producing the soft absorbent paper products of this invention are the cold-water dispersible imidazolines. These imidazolines are formulated with alkoxylated diols, alkoxylated polyols, diols and polyols to produce softeners which render the usually insoluble imidazoline softeners water dispersible at temperatures of 0°–100° C. suitably at 0°–40° C. and preferably at 20°–25° C. Representative initially water insoluble imidazoline softeners rendered water dispersible by formulation of these with water soluble polyols, diols, alkoxylated polyols and alkoxylated diols include Witco Corporation's Arosurf PA 806 and DPSC 43/13 which are water dispersible versions of tallow and oleic-based imidazolines, respectively.

Figure 7A:
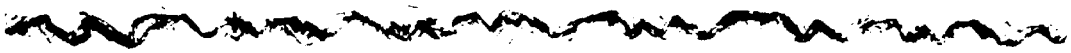
FIGS. 7A and 7B are micrmgraphs at 50 times magnification of the single-ply product of this invention, and an, absorbent, commercial two-ply product, respectively.
Figure 7B:
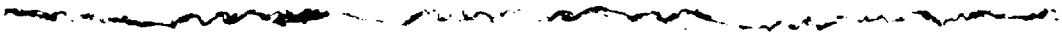
FIG. 7B PRIOR ART
Figures 1, 8A:
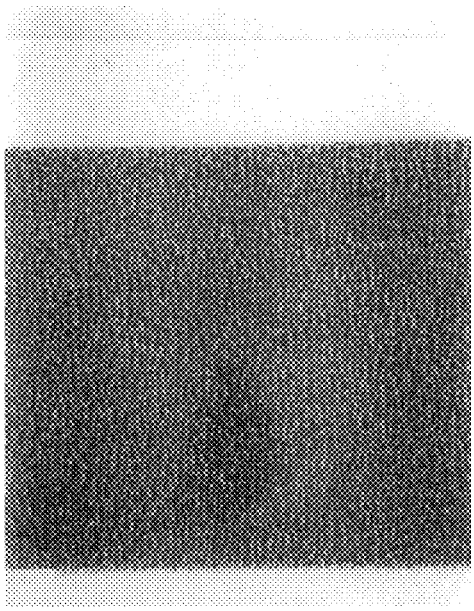
Figures 2, 8A:
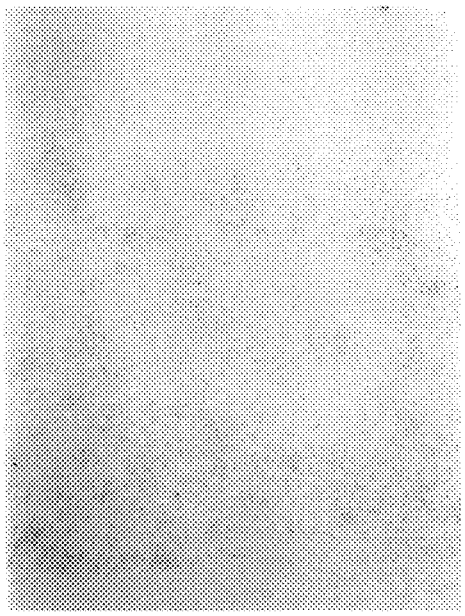
Figures 1, 8B:
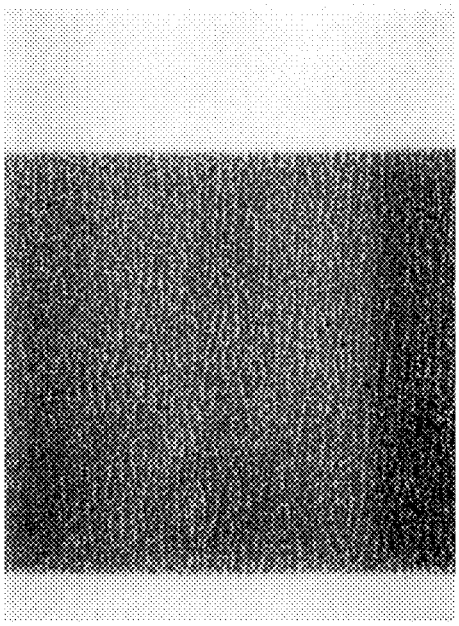
Figures 2, 8B:
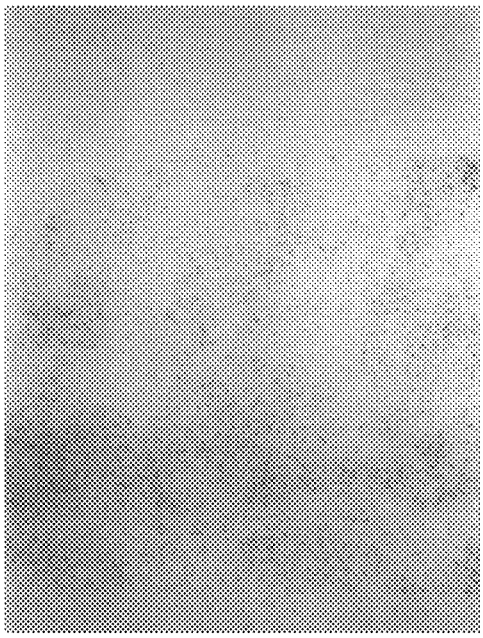
Figures 1, 8C:
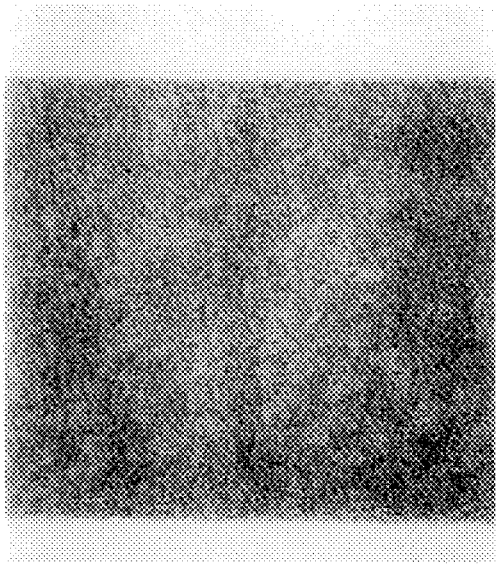
Figures 2, 8C:
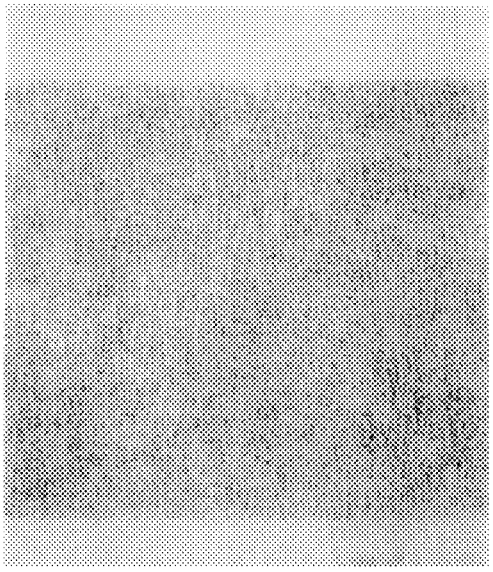

Treatment of the partially dewatered web with the softener can be accomplished by various means. For instance, the treatment step can comprise spraying, as shown in FIGS. 7A and 7B, applying with a direct contact applicator means, or by employing an applicator felt. It is often preferred to supply the softener to the air side of the web from position 52 shown in FIG. 9, so as to avoid chemical contamination of the paper making process. It has been found in practice that a softener applied to the web from either position 52 or position 53 shown in FIG. 9 penetrates the entire web and uniformly treats it.

Useful softeners for spray application include softeners having the following structure:

$$[(RCO)_2EDA]HX$$

wherein EDA is a diethylenetriamine residue, R is the residue of a fatty acid having from 12 to 22 carbon atoms, and X is an anion or $$[(RCONHCH_2CH_2)_2NR']HX$$

wherein R is the residue of a fatty acid having from 12 to 22 carbon atoms, R' is a lower alkyl group, and X is an anion.

More specifically, preferred softeners for application to the partially dewatered web are Quasoft® 218, 202, and 209-JR made by Quaker Chemical Corporation which contain a mixture of linear amine amides and imidazolines.

Another suitable softener is a dialkyl dimethyl fatty quaternary ammonium compound of the following structure:

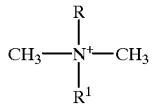

wherein R and $R^1$ are the same or different and are aliphatic hydrocarbons having fourteen to twenty carbon atoms preferably the hydrocarbons are selected from the following: $C_{16}H_{35}$ and $C_{18}H_{37}$.

A new class of softeners having a melting range of about 0–40° C. are particularly effective in producing the soft one-ply tissue of this invention. These softeners comprise imidazoline moieties formulated with organic compounds selected from the group consisting of aliphatic diols, alkoxylated aliphatic diols, aliphatic polyols, alkoxylated aliphatic polyols and/or a mixture of these. Preferably, these softeners are dispersible in water at a temperature of about 1° C. to about 40° C. and have a melting range below 40° C. The imidazoline moiety is of the formula:

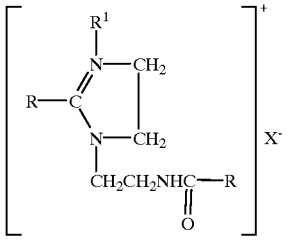

wherein X is an anion and R is selected from the group of saturated and unsaturated paraffinic moieties having a carbon chain length of $C_{12}$ to $C_{20}$ and $R^1$ is selected from the group of saturated paraffinic moieties having a carbon chain length of $C_1$ to $C_3$. Suitably the anion is methyl sulfate or ethyl sulfate or the chloride moiety. The preferred carbon chain length is $C_{12}$ to $C_{18}$. The preferred diol is 2,2,4 trimethyl 1,3 pentane diol and the preferred alkoxylated diol is ethoxylated 2,2,4 trimethyl 1,3 pentane diol. In general, these softeners are dispersible in water at a temperature of about 1°–100° C., usually 1°–40° C., preferably 20°–25° C. These softeners have a melting range below 40° C.

The web is dewatered preferably by an overall compaction process. The web is then preferably adhered to a Yankee dryer. The adhesive is added directly to the metal of the Yankee, and advantageously, it is sprayed directly on the surface of the Yankee dryer drum. Any suitable art recognized adhesive may be used on the Yankee dryer. Suitable adhesives are widely described in the patent literature. A comprehensive but non-exhaustive list includes U.S. Pat. Nos. 5,246,544; 4,304,625; 4,064,213; 4,501,640; 4,528,316; 4,883,564; 4,684,439; 4,886,579; 5,374,334; 5,382,323; 4,094,718; and 5,281,307. Adhesives such as glyoxylated polyacrylamide, and polyaminoamides have been shown to provide high adhesion and are particularly suited for use in the manufacture of the one-ply product. The preparation of the polyaminoamide resins is disclosed in U.S. Pat. No. 3,761,354 which is incorporated herein by reference. The preparation of polyacryamide adhesives is disclosed in U.S. Pat. No. 4,217,425 which is incorporated herein by reference. Typical release agents can be used in accordance with the present invention; however, the amount of release, should one be used at all, will often be below traditional levels.

The web is then creped from the Yankee dryer and calendered. It is necessary that the product of the present invention have a relatively high machine direction stretch. The final product's machine direction stretch should be at least about 15%, preferably at least about 18%. Usually the products machine direction stretch is controlled by fixing the % crepe. The relative speeds between the Yankee dryer and the reel are controlled such that a reel crepe of at least about 18%, more preferably 20%, and most preferably 23% is maintained. This high reel crepe also distinguishes the process of this invention from prior art processes where the reel crepe is kept below 18%. The one-ply tissues of this invention have the high bulk and low tensile strength favored by the consumer but unavailable on the market from CWP paper making mills using prior art manufacturing methods. Creping is preferably carried out at a creping angle of from about 65 to about 85 degrees, preferably about 70 to about 80 degrees, and more preferably about 75 degrees. The creping angle is defined as the angle formed between the surface of the creping blade's edge and a line tangent to the Yankee dryer at the point at which the creping blade contacts the dryer.

Optionally to obtain maximum softness of the one-ply tissue, the web is embossed. The web may be embossed with any art recognized embossing pattern, including, but not limited to, overall emboss patterns, spot emboss patterns, micro emboss patterns, which are patterns made of regularly shaped (usually elongate) elements whose long dimension is 0.050 inches or less, or combinations of overall, spot, and micro emboss patterns.

In one embodiment of the present invention, the emboss pattern of the printed one-ply product may include a first set of bosses which resemble stitches, hereinafter referred to as stitch-shaped bosses, and at least one second set of bosses which are referred to as signature bosses. Signature bosses may be made up of any emboss design and are often a design which is related by consumer perception to the particular manufacturer of the tissue. It should be noted that all paper products of this invention are printed either before or after embossing and optionally both the Yankee and air side can be printed. Usually only one side is printed.

In another aspect of the present invention, a paper product is embossed with a wavy lattice structure which forms polygonal cells. These polygonal cells may be diamonds, hexagons, octagons, or other readily recognizable shapes. In one preferred embodiment of the present invention, each cell is filled with a signature boss pattern. More preferably, the cells are alternatively filled with at least two different signature emboss patterns.

Figure 6:
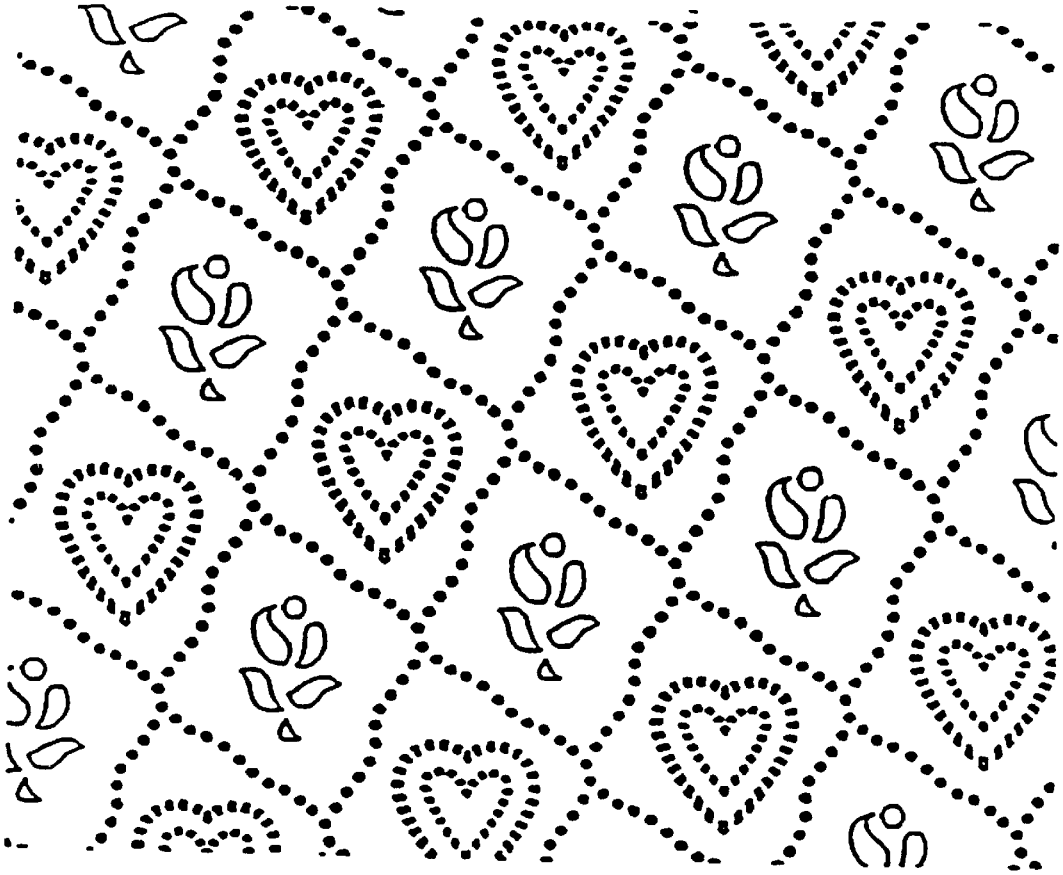
FIG. 6 illustrates the double heart emboss pattern.

In another preferred embodiment, one of the signature emboss patterns is made up of concentrically arranged elements. These elements can include like elements for example, a large circle around a smaller circle, or differing elements, for example a larger circle around a smaller heart. In a most preferred embodiment of the present invention, at least one of the signature emboss patterns are concentrically arranged hearts as can be seen in FIG. 6. The use of concentrically arranged emboss elements in one of the signature emboss patterns adds to the puffiness effect realized in the appearance of the absorbent paper product in the form of a one ply bathroom tissue, facial tissue or napkin. The puffiness associated with this arrangement is the result not only of appearance but also of an actual raising; of the paper product upward. Again, in a most preferred embodiment, another signature emboss element is a flower.

In one embodiment of the present invention, emboss elements are formed having the uppermost portions thereof formed into crenels and merlons, herein after referred to as "crenulated emboss elements." By analogy, the side of such an emboss element would resemble the top of a castle wall having spaced projections which are merlons and depressions there between which are crenels. In a preferred embodiment, at least one of the signature emboss patterns is formed of crenulated emboss elements. More preferably, the signature boss pattern is two concentrically arranged hearts, one or both of which is crenulated.

In a preferred embodiment of the present invention, the signature bosses have a height of between 10 thousandths and 90 thousandths of an inch. The crenels are preferably at a depth of at least 3 thousandths of an inch. It is understood that the use of merlons which are unequally spaced or which differ in height are embraced within the present invention.

According to the present invention, when the web or sheets are formed into a roll, the bathroom tissue is aligned so that the bosses are internal to the roll and the debossed side of the bathroom tissue is exposed. In the present invention, the boss pattern is offset from the machine direction in the cross direction, the machine direction being parallel to the free edge of the web, by more than 10° to less than 170°.

In one embodiment of the present invention, the boss pattern combines stitch-shaped bosses with a first signature boss made up of linear continuous embossments and a second signature boss pattern made up of crenulated embossments. The overall arrangement of the pattern is selected so that when the sheets are formed into a roll, the signature bosses fully overlap at a maximum of three locations in the roll, more preferably at least two locations, the outermost of these being at least a predetermined distance, e.g., about an eighth of an inch, inward from the exterior surface of the roll. Moreover, the overall average boss density is substantially uniform in the machine direction of each strip in the roll. The combined effect of this arrangement is that the rolls possess very good roll structure and very high bulk.

The signature bosses are substantially centrally disposed in the cells formed by the intersecting flowing lines and serve to greatly enhance the bulk of the tissue while also enhancing the distortion of the surface thereof. At least some of the signature bosses are continuous rather than stitch-shaped and can preferably be elongate. Other of the signature bosses are crenulated and, preferably, are also substantially centrally disposed in cells formed by the intersecting flowing lines. The signature bosses enhance the puffy or filled appearance of the sheet both by creating the illusion of shading as well as by creating actual shading due to displacement of the sheet apparently caused by puckering of surrounding regions due to the embossing or debossing of the signature bosses.

One preferred emboss pattern is made up of a wavy lattice of dot shaped bosses having hearts and flowers within the cells of the lattice. FIG. 6 is a depiction of a preferred emboss pattern for use with the present invention. It is also preferred that the emboss pattern of the present invention be formed, at least in part, of crenulated emboss elements. As previously discussed, a crenulated emboss element is one that has a wide base with smaller separated land areas at the apex, resembling, for example, the top of a castle wall. Such an emboss pattern further enhances the bulk and softness of the absorbent paper product. The emboss elements are preferably less than 100 thousandths of an inch in height, more preferably less than 80 thousandths of an inch, and most preferably 30 to 70 thousandths of an inch.

In the macro embossing process discussed above, the typical tissue embossing process involves the compression and stretching of the flat tissue base sheet between a relatively soft (40 Shore A) roll and a hard roll which has relatively large "macro" signature emboss elements (FIG. 6). This embossing improves the aesthetics of the tissue and the structure of the tissue roll. However, the thickness of the base sheet between the signature emboss elements is actually reduced. This lowers the perceived bulk of a conventional wet press (CWP) one-ply product made by this process. Also, this process tends to make the tissue two-sided, as the male emboss elements create protrusions or knobs on only one side of the sheet.

Figure 18:
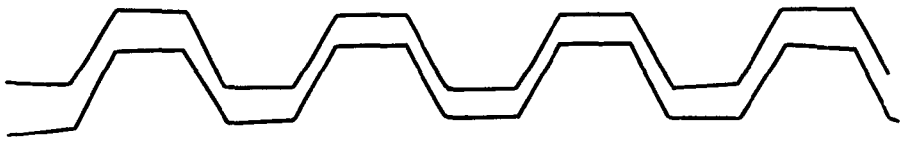
FIG. 18 illustrates the engagement of mated emboss rolls suitable for micro embossing the one-ply absorbent paper products which is printed on one or both sides prior to or after embossing.
Figure 19:
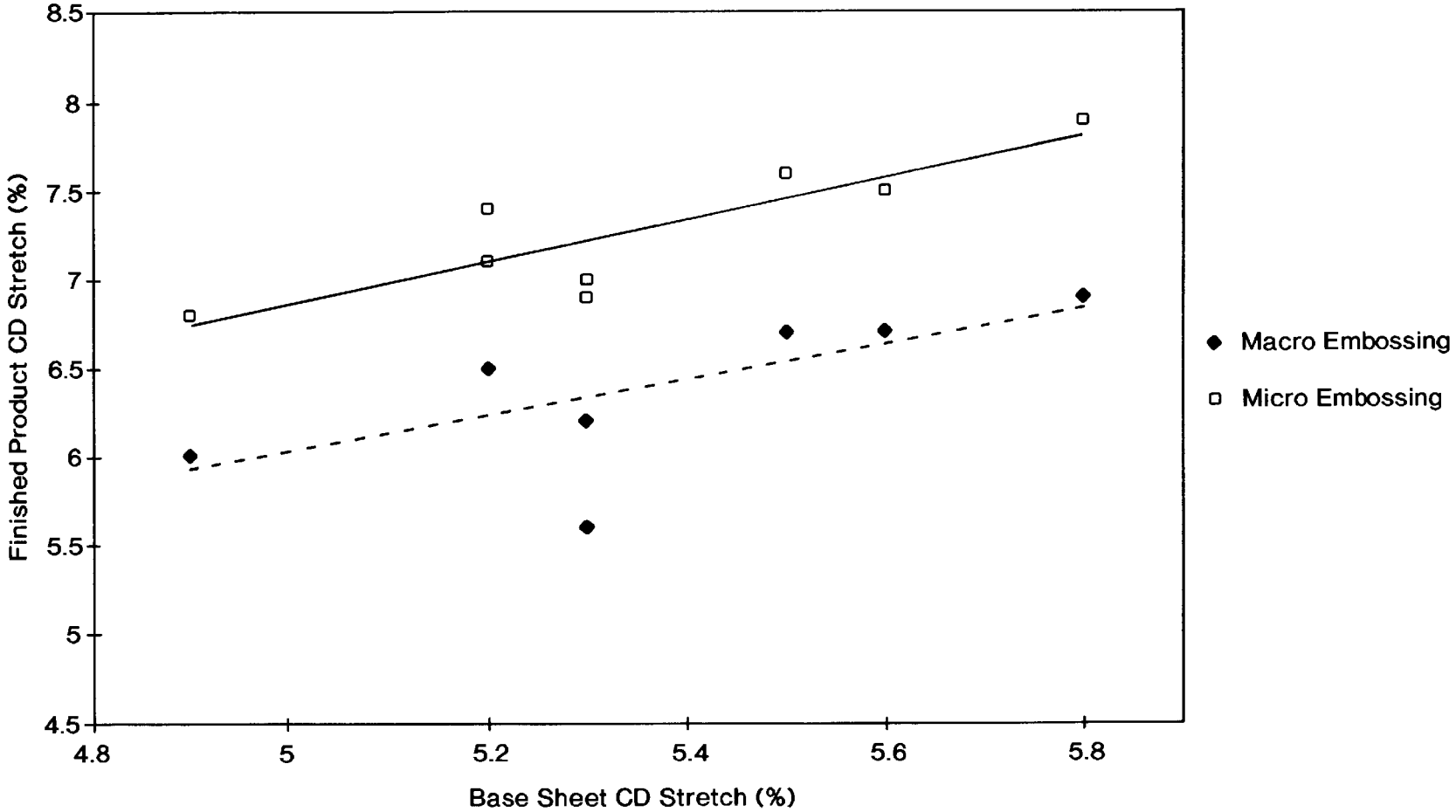
FIG. 19 is a graphical representation of the % CD stretch in the finished product and the % CD stretch in the base sheet.

Our printing process is particularly suitable for one-ply absorbent paper products wherein the paper product is embossed between two hard rolls each of which contain both micro male and female elements although some signature on macro elements can be present. The micro male elements of one emboss roll are engaged or mated with the female elements of another mirror image emboss roll as can be seen in FIG. 18. These emboss rolls can be made of materials such as steel or very hard rubber. In this process, the base sheet is only compressed between the sidewalls of the male and female elements. Therefore, base sheet thickness is preserved and bulk perception of a one-ply product is much improved. Also, the density and texture of the pattern improves bulk perception. This mated process and pattern also creates a softer absorbent paper product such as a bathroom tissue because the top of the bathroom tissue protrusions remain soft and uncompressed.

The male elements of the emboss pattern are non-discrete, that is, they are not completely surrounded by flat land area. There are approximately an equal number of male and female elements on each emboss roll. This increases the perceived bulk of the product and makes both sides of the emboss tissue symmetrical and equally pleasing to the touch.

The micro embossing provides for better cleansing of the skin than a typically embossed CWP one-ply tissue which is very smooth in the unembossed areas. The surface of the CWP product which has been micro embossed is better than that of a typical through-air-dried (TAD) product in that it has texture but more uniformly bonded fibers. Therefore the fibers on the surface of the bathroom tissue do not pill or ball up, especially when the tissue becomes wet. In contrast, there are significant portions of the typical textured TAD tissue surface where fibers are weakly bonded. These fibers tend to pill when the tissue becomes wet, even when a significant amount of, wet strength has been added to the fibers.

A preferred micro emboss pattern on which one or both sides are printed is shown in FIGS. 14A–1, 14A–2, 14A–3 and 14B. It contains diamond shaped male, female and mid-plane elements which all have a preferred width of 0.023 inches. The width is preferably between about 0.005 inches and about 0.070 inches, more preferably between about 0.015 inches and about 0.045 inches, most preferably between about 0.025 inches and about 0.035 inches. The shape of the elements can be selected as circles, squares or other easily understood shapes. When a micro and macro pattern are used, the distance between the end of the macro elements and the start of the micro elements is preferably between about 0.007 inches and about 1 inch, more preferably between about 0.005 and 0.045, and most preferably between about 0.010 and about 0.035. The height of the male elements above the mid-plane is preferably about 0.0155 inches and the depth of the female elements is preferably about 0.0155 inches. The angle of the sidewalls of the elements is preferably between about 10 and about 30 degrees, more preferably between about 18 and about 23 degrees, most preferably about 21 degrees. In a most preferred embodiment, the elements are about 50% male and about 50% female.

Patterns such as those shown in FIGS. 14A–1, 14A–2, 14A–3 and 14B can be combined with one or more signature emboss patterns to create printed absorbent paper products of the present invention. Signature bosses are made up of any emboss design and are often a design which is related by consumer perception to the particular manufacturer of the tissue.

More preferred emboss patterns for the present invention are shown in FIGS. 15A–1, 15A–2, 15A–3, 15B–1, 15B–2 and 15B–3. These patterns are exact mirror images of one another. These emboss patterns combine the diamond micro pattern in FIGS. 14A–1, 14A–2, 14A–3 and 14B with a large, signature or "macro" pattern. This combination pattern provides aesthetic appeal from the macro pattern as well as the improvement in perceived bulk and texture created by the micro pattern and give superior printed absorbent paper products. The macro portion of the pattern is mated so that it does not reduce softness by increasing the friction on the back side of the sheet. In addition to providing improved aesthetics, this pattern minimizes nesting (the complete overlap of embossing elements) and improves roll structure by increasing the repeat length for the pattern from 0.0925 inches to 5.0892 inches.

The design of the macroelements in the more preferred emboss pattern preserves strength of the tissue. This is done by starting the base of the male macro elements at the mid-plane of the micro elements as shown in FIG. 15B–1, 15B–2 and 15B–3. The female macro elements are started at the mid-plane of the micro elements as shown in FIGS. 15A–1, 15–2 and 15A–3. This reduces the stretching of the sheet from the mid-plane by 50%. However, because the macro elements are still 31 mils in height or depth, they still provide a crisp, clearly defined pattern.

The more preferred emboss pattern has the bases of male micro elements and the opening of female micro elements kept at least 0.014 inches away from the base of the male macro elements or openings of female macro elements. This prevents the emboss rolls from plugging with the absorbent paper product.

Figures 1, 15A:
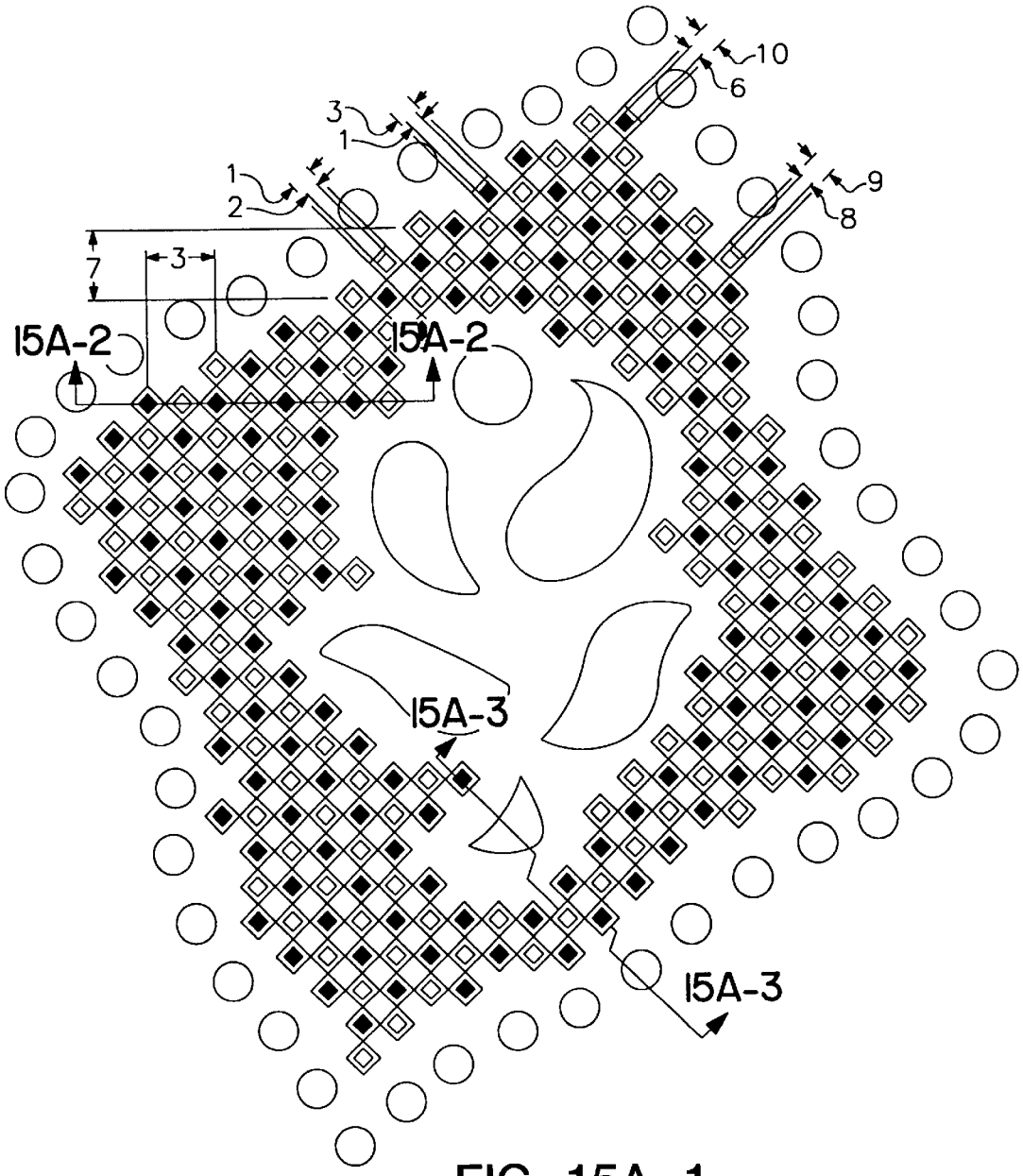
Figures 2, 15A:
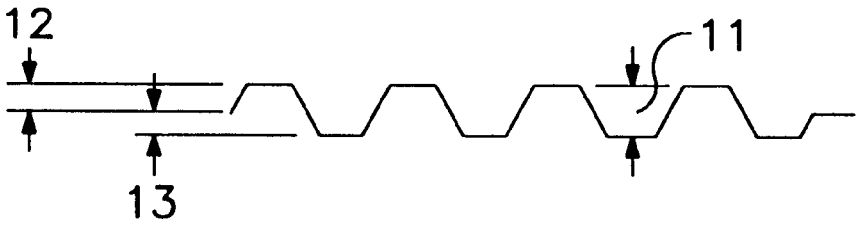
Figures 3, 15A:
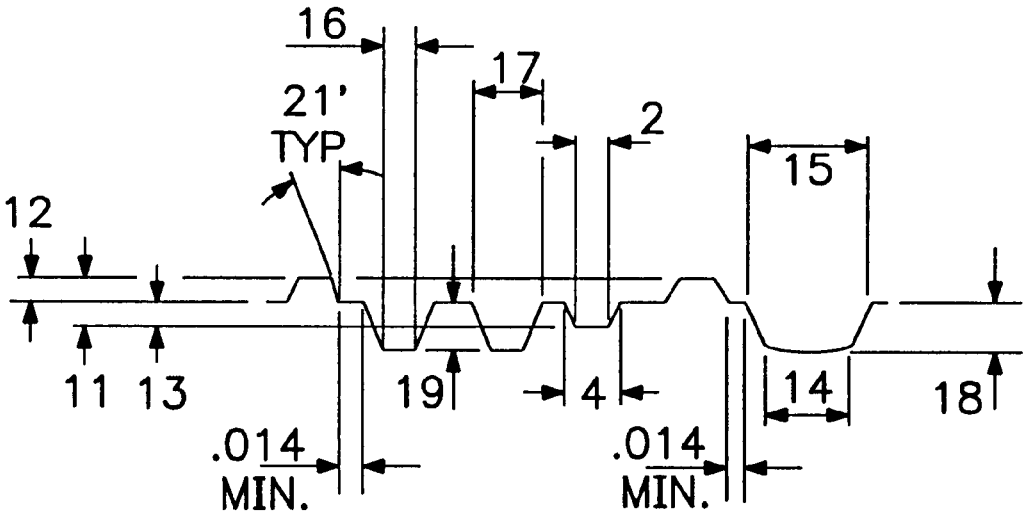
Figures 1, 15B:
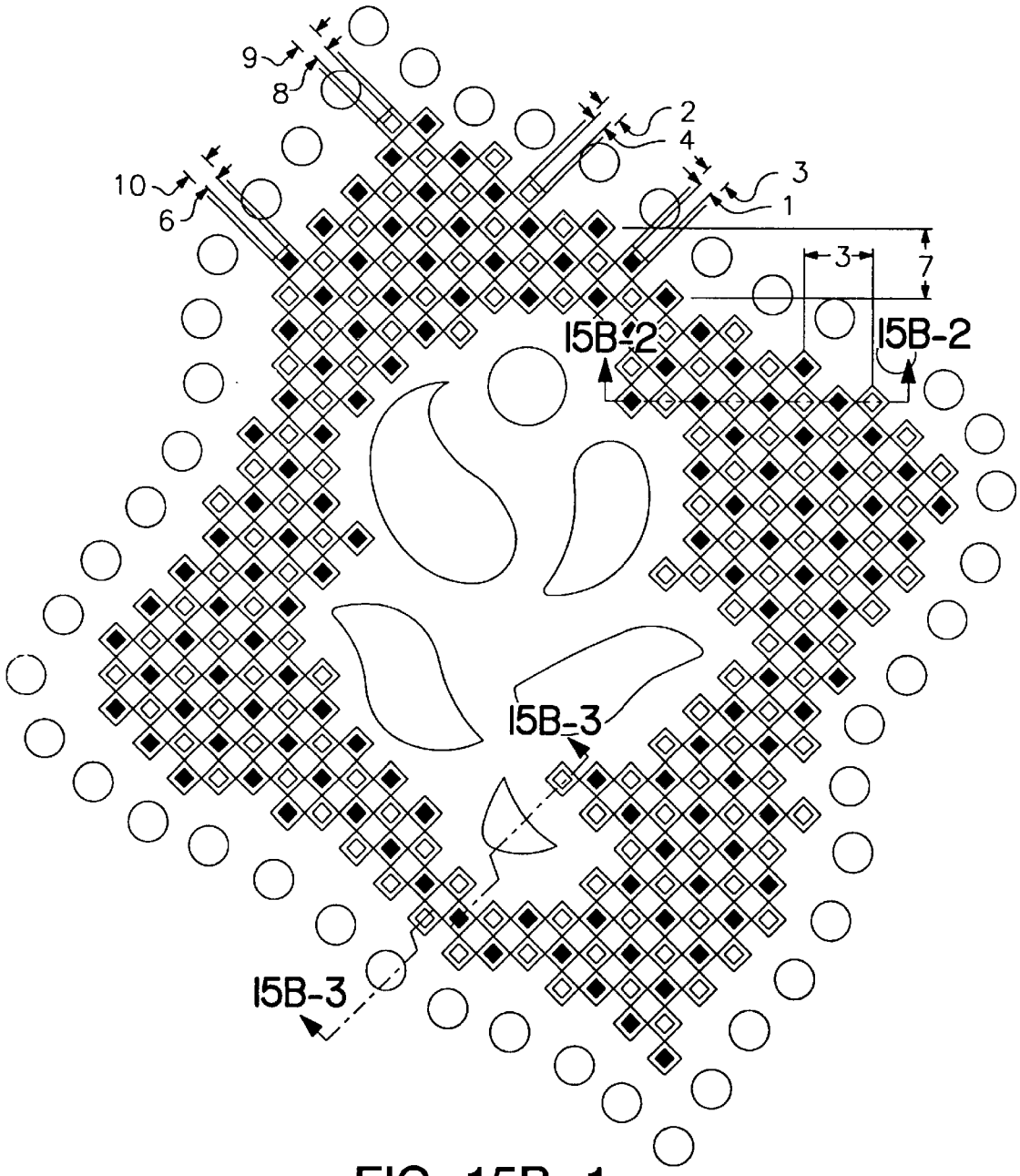
Figures 2, 15B:
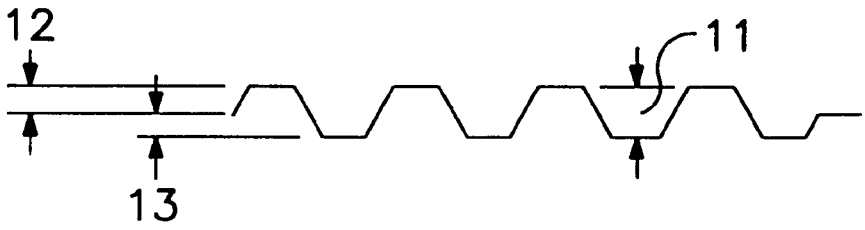
Figures 3, 15B:
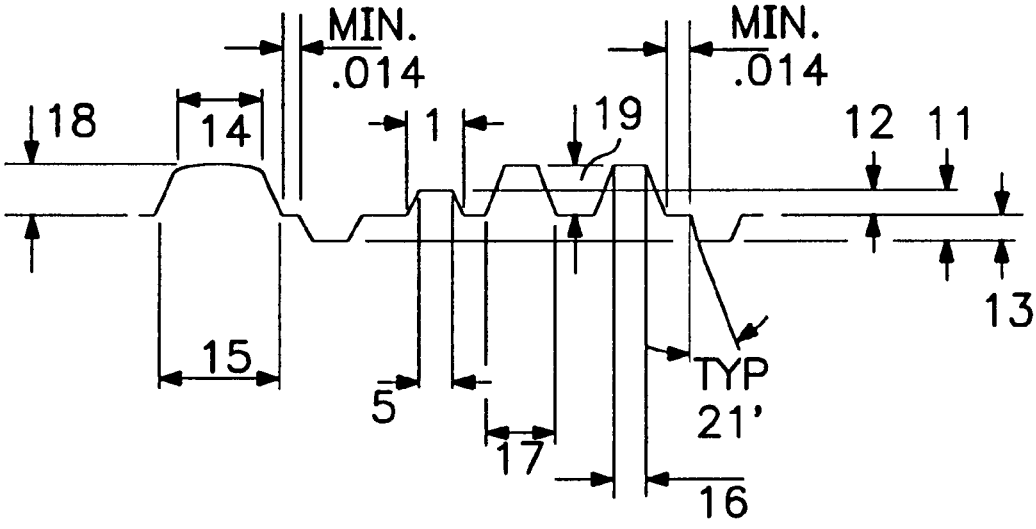
Figure 15C:
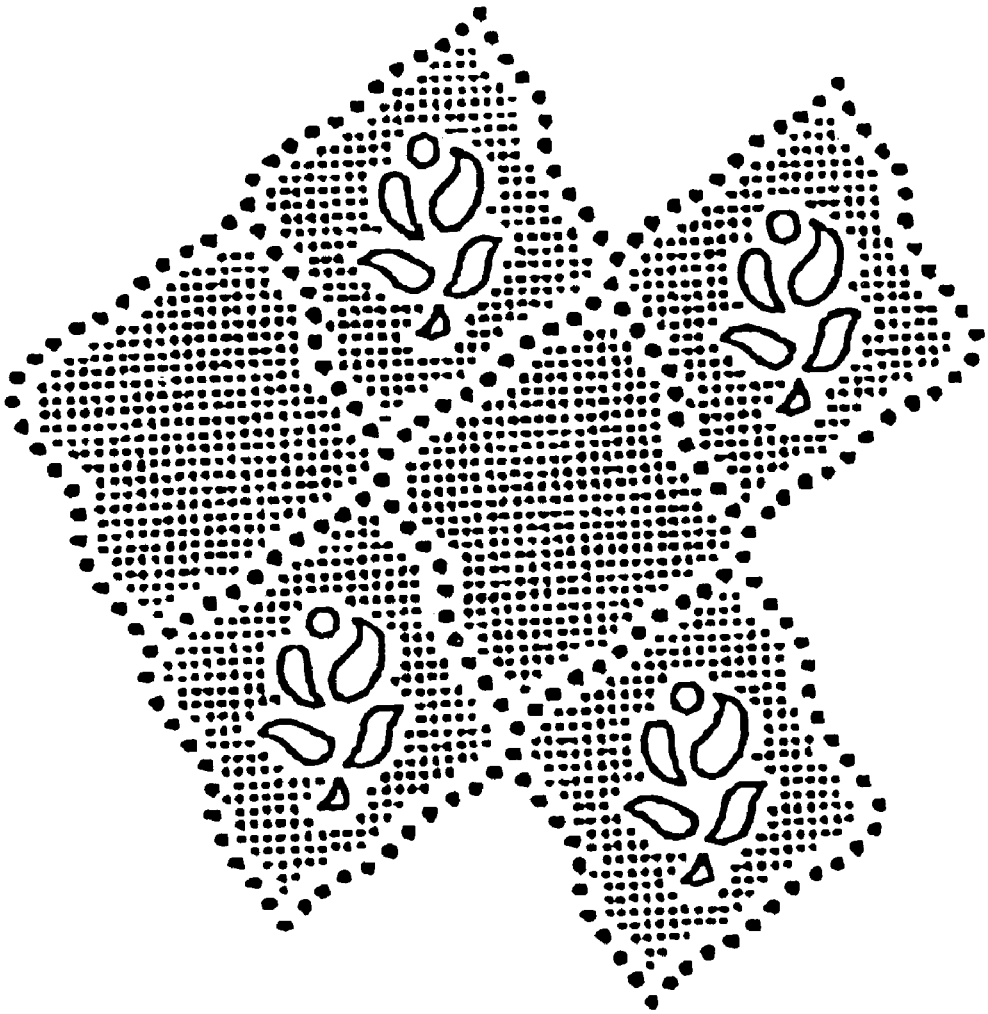
Figure 16:
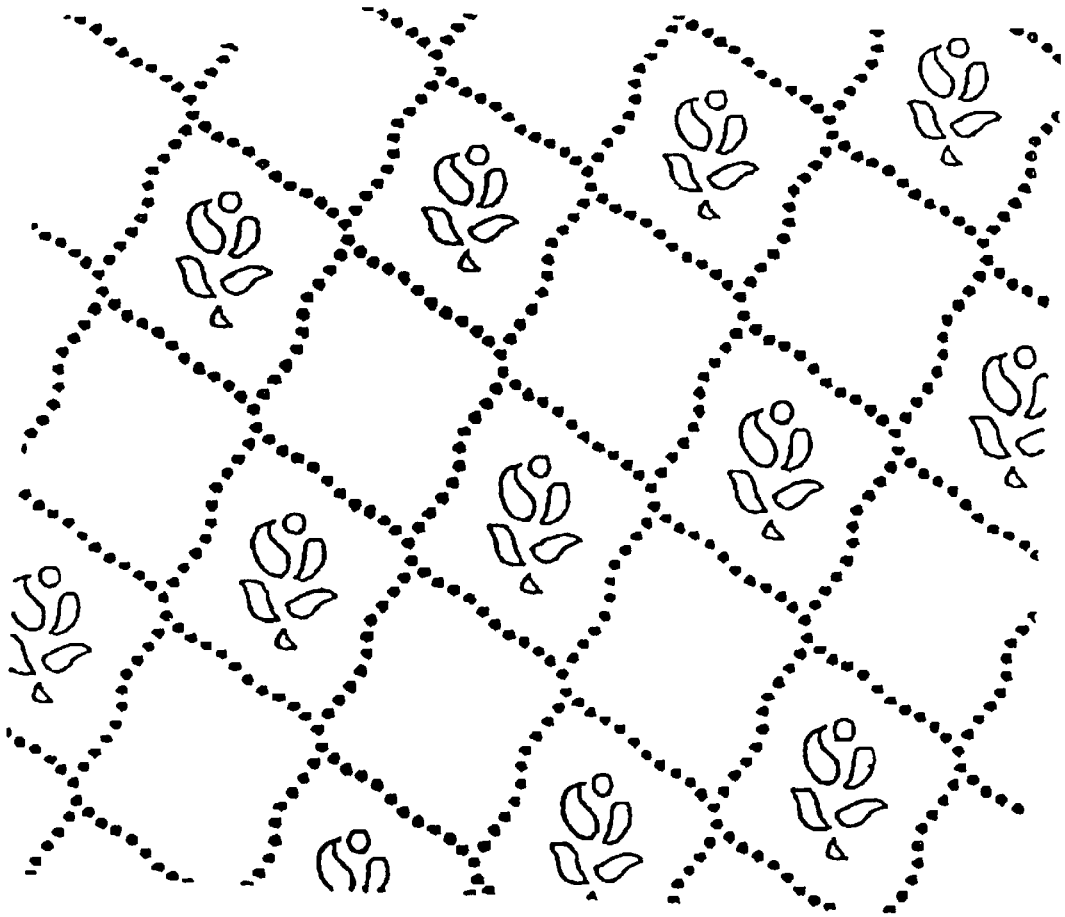
FIG. 16 illustrates another prior art macro art pattern suitable for embossing one-ply absorbent paper products which are printed on one side or both sides prior to or after embossing.

It is also possible to put some of the male macro elements going one direction and the rest of them going the other direction. This may further reduce any sidedness in the product. FIGS. 15C and 16 show the actual size of the preferred patterns.

The basis weight of the single-ply bathroom tissue, facial tissue, or napkin is desirably from about 12.5 to about 25 lbs./3000 sq. ft. ream, preferrably from about 17 to about 20 lbs./ream. The caliper of the absorbent paper product of the present invention may be measured using the Model II Electronic Thickness Tester available from the Thwing-Albert Instrument Company of Philadelphia, Pa. The caliper is measured on a sample consisting of a stack of eight sheets of the absorbent paper using a two-inch diameter anvil at a 539±10 gram dead weight load. Single-ply absorbent paper product of the present invention have a specific (normalized for basis weight) caliper after calendering and embossing of from about 2.6 to 4.2 mils per 8 plies of absorbent paper sheets per pound per 3000 square foot ream, the more preferred absorbent paper having a caliper of from about 2.8 to about 4.0, the most preferred absorbent papers have a caliper of from about 3.0 to about 3.8. In the papermaking art, it is known that the size of the roll in the final product is dependent on the caliper of a bathroom tissue and the number of sheets contained in the roll.

Tensile strength of the absorbent paper products produced in accordance with the present invention is measured in the machine direction and cross-machine direction on an Instron Model 4000: Series IX tensile tester with the gauge length set to 4 inches. The area of tissue tested is assumed to be 3 inches wide by 4 inches long. In practice, the length of the samples is the distance between lines of perforation in the case of machine direction tensile strength and the width of the samples is the width of the roll in the case of cross-machine direction tensile strength. A 20 pound load cell with heavyweight grips applied to the total width of the sample is employed. The maximum load is recorded for each direction. The results are reported in units of "grams per 3-inch"; a more complete rendering of the units would be "grams per 3-inch by 4-inch strip." The total (sum of machine and cross machine directions) dry specific tensile of the printed paper products of the present invention, when normalized for basis weight, will be between 40 and 200 grams per 3 inches per pound per 3000 square foot ream, suitably between 40 and 150 grams per 3 inches per 3000 square foot ream, preferably between 40 and 75 grams per 3 inches per 3000 square root ream. The ratio of MD to CD tensile is also important and should be between 1.2 and 2.75, preferably between 1.5 and 2.5.

The wet tensile of the tissue of the present invention is measured using a three-inch wide strip of tissue that is folded into a loop, clamped in a special fixture termed a Finch Cup, then immersed in water. The Finch Cup, which is available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of 7.0±0.1 and the tensile is tested after a 5 second immersion time. The wet tensile of the absorbent paper of the present invention will be at least 2.75 grams per three inches per pound per 3000 square foot ream in the cross direction as measured using the Finch Cup and can have values of 7.5, 15 and 20 grams per three inches per pound per 3000 square foot ream when the absorbent paper product has a specific total tensile strength of about 75, 150 and 200 grams per 3 inches per pound per 3000 square foot ream respectively. Normally, only the cross direction wet tensile is tested, as the strength in this direction is normally lower than that of the machine direction and the absorbent paper is more likely to fail in use in the cross direction.

Softness is a quality that does not lend itself to easy quantification. J. D. Bates, in "Softness Index: Fact or Mirage?" TAPPI, Vol. 48 (1965), No. 4, pp. 63A–64A, indicates that the two most imporant readily quantifiable properties for predicting perceived softness are (a) roughness and (b) what may be referred to as stiffness modulus. Bathroom tissue, facial tissue, and napkin produced according to the present invention has a more pleasing texture as measured by sidedness parameter or reduced values of either or both roughness and stiffness modulus (relative to control samples). Surface roughness can be evaluated by measuring geometric mean deviation in the coefficient of friction (GM MMD) using a Kawabata KES-SE Friction Tester equipped with a fingerprint-type sensing unit using the low sensitivity range. A 25 g stylus weight is used, and the instrument readout is divided by 20 to obtain the mean deviation in the coefficient of friction. The geometric mean deviation in the coefficient of friction or overall surface friction is then the square root of the product of the deviation in the machine direction and the cross-machine direction. When the absorbent paper has a specific total tensile strength of between 40 and 75 grams per 3 inches per pound per 3000 square foot ream, the GM MMD of the single-ply paper product of the current invention is preferably no more than about 0.225, is more preferably less than about 0.215, and is most preferably about 0.150 to about 0.205. When the specific total tensile strength is between 150 and 200 grams per 3 inches per pound per 3000 square foot ream the GM MMD is no more than 0.250. The tensile stiffness (also referred to as stiffness modulus) is determined by the procedure for measuring tensile strength described above, except that a sample width of 1 inch is used and the modulus recorded is the geometric mean of the ratio of 50 grams load over percent strain obtained from the load-strain curve. The specific tensile stiffness of said web is preferably from about 0.5 to about 1.2 g/inch/% strain per pound of basis weight and more preferably from about 0.6 to about 1.0 g/inch/% strain per pound of basis weight, most preferably from about 0.7 to about 0.8 g/inch/% strain per pound of basis weight. When the absorbent paper product has a specific wet total tensile strength of between 40 and 75 grams per 3 inches per pound per 3000 square foot ream, the specific geometric mean tensile stiffness is between 0.5 and 1.2 grams per inch per percent strain per pound per 3000 square foot ream. When the specific total tensile strength is between 40 and 150 grams per 3 inches per pound per 3000 square foot ream the specific geometric mean tensile stiffness is between 0.5 and 2.4 grams per inch per percent strain per pound per 3000 square foot ream and when the specific total tensile strength is between 40 and 200 grams per 3 inches per pound per 3000 square foot ream, the specific geometric mean tensile stiffness is between 0.5 and 3.2 grams per inch per percent strain per pound per 3000 square foot ream.

To quantify the degree of sidedness of a single-ply absorbent paper in the form of a bathroom tissue, facial tissue, or napkin we use a quantity which we term sidedness parameter or S. We define sidedness parameter S as:

$$S = \frac{1}{2}\frac{[GM\ MMD]_H}{[GM\ MMD]_L}\{[GM\ MMD]_H + [GM\ MMD]_L\}$$

where $[GM\ MMD]_H$ and $[GM\ MMD]_L$ are the geometric mean friction deviations or overall surface friction of the two sides of the sheet. The "H" and "L" subscripts refer the higher and lower values of the friction deviation of the two sides—that is the larger friction deviation value is always placed in the numerator. For most creped products, the air side friction deviation will be higher than the friction deviation of the Yankee side. S takes into account not only the relative difference between the two sides of the sheet but also the overall friction level. Accordingly, low S values are preferred. The sidedness of the one-ply printed absorbent paper product having a specific tensile strength of between 40 and 75 grams per 3 inches per pound per 3000 square foot ream should be from about 0.160 to about 0.275; preferably less than about 0.250; and more preferably less than about 0.225. When the printed absorbent paper product of this invention has a specific total tensile strength between 150 to 200 grams per 3 inches per pound per 3000 square foot ream the sidedness of the one ply absorbent paper product is below 0.30.

Formation of bathroom tissue, facial tissue, and napkins of the present invention as represented by Kajaani Formation Index Number should be at least about 50, preferably about 55, more preferably at least about 60, and most preferably a, least about 65, as determined by measurement of transmitted light intensity variations over the area of the sheet using a Kajaani Paperlab 1 Formation Analyzer which compares the transmitivity of about 250,000 subregions of the sheet. The Kajaani Formation Index Number, which varies between about 20 and 122, is widely used through the paper industry and is for practical purposes identical to the Robotest Number which is simply an older term for the same measurement.

TAPPI 401 OM-88 (Revised 1988) provides a procedure for the identification of the types of fibers present in a sample of paper or paperboard and an estimate of their quantity. Analysis of the amount of the softener/debonder chemicals retained on the printed absorbent paper of this invention can be performed by any method accepted in the applicable art. For the most sensitive cases, we prefer to use x-ray photoelectron spectroscopy ESCA to measure nitrogen levels, the amounts in each level being measurable by using the tape pull procedure described above combined with ESCA analysis of each "split." Normally the background level is quite high and the variation between measurements quite high, so use of several replicates in a relatively modern ESCA system such as at the Perkin Elmer Corporation's model 5,600 is required to obtain more precise measurements. The level of cationic nitrogenous softener/debonder such as Quasoft® 202-JR can alternatively be determined by solvent extraction of the Quasoft® 202-JR by an organic solvent followed by liquid chromatography determination of the softener/debonder. TAPPI 419 OM-85 provides the qualitative and quantitative methods for measuring total starch content. However, this procedure does not provide for the determination of starches that are cationic, substituted, grafted, or combined with resins. These types of starches can be determined by high pressure liquid chromatography. (TAPPI, Journal Vol. 76, Number 3.)

The following examples are not to be construed as limiting the invention as described herein.

EXAMPLE 1

(Samples 1–9)

Figure 1:
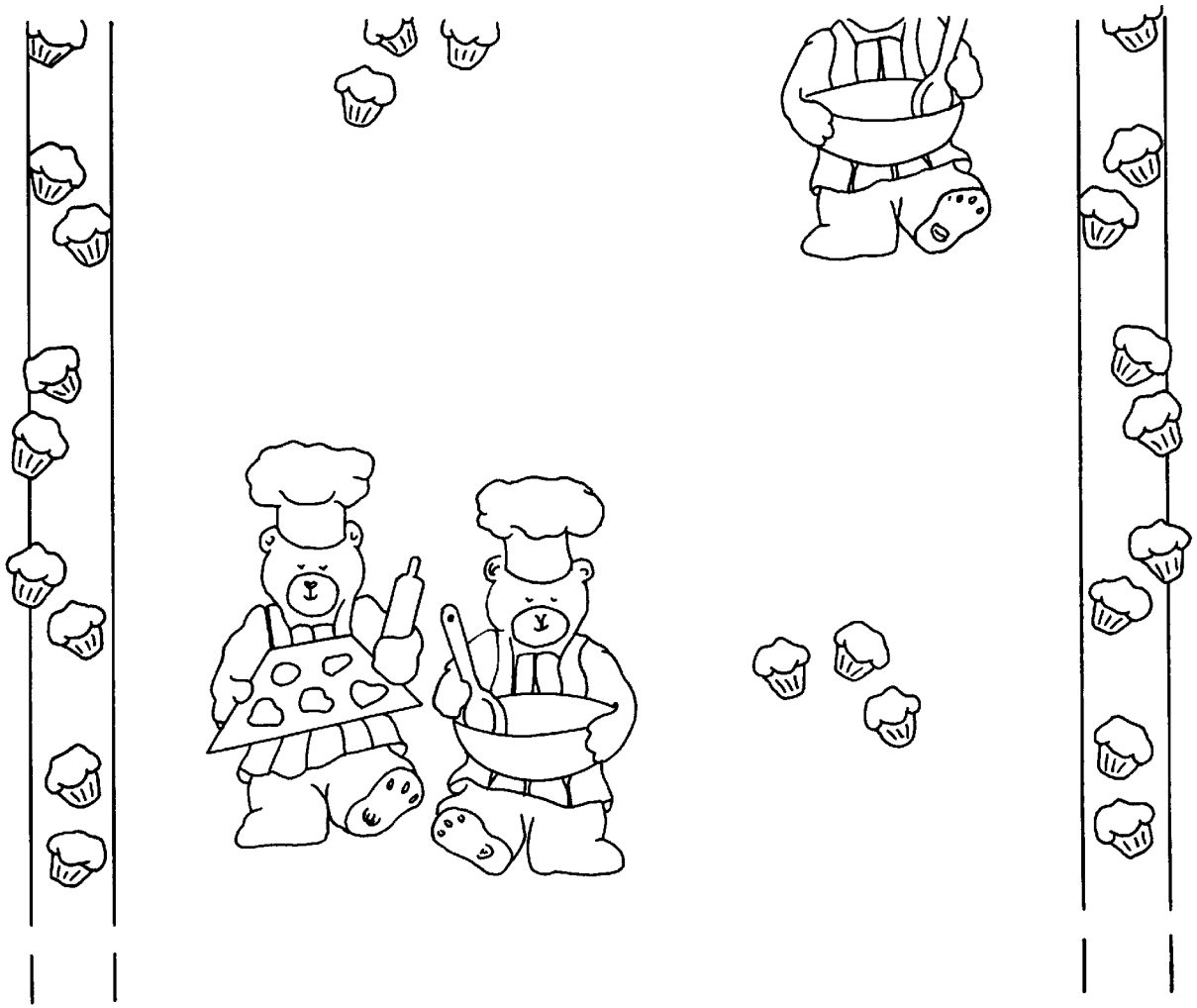
FIG. 1 illustrates the Bear and Cupcake print pattern printed using a flexographic printing process prior to or after embossing of the one-ply absorbent paper product. One or both sides of the paper can be printed.
Figure 2:
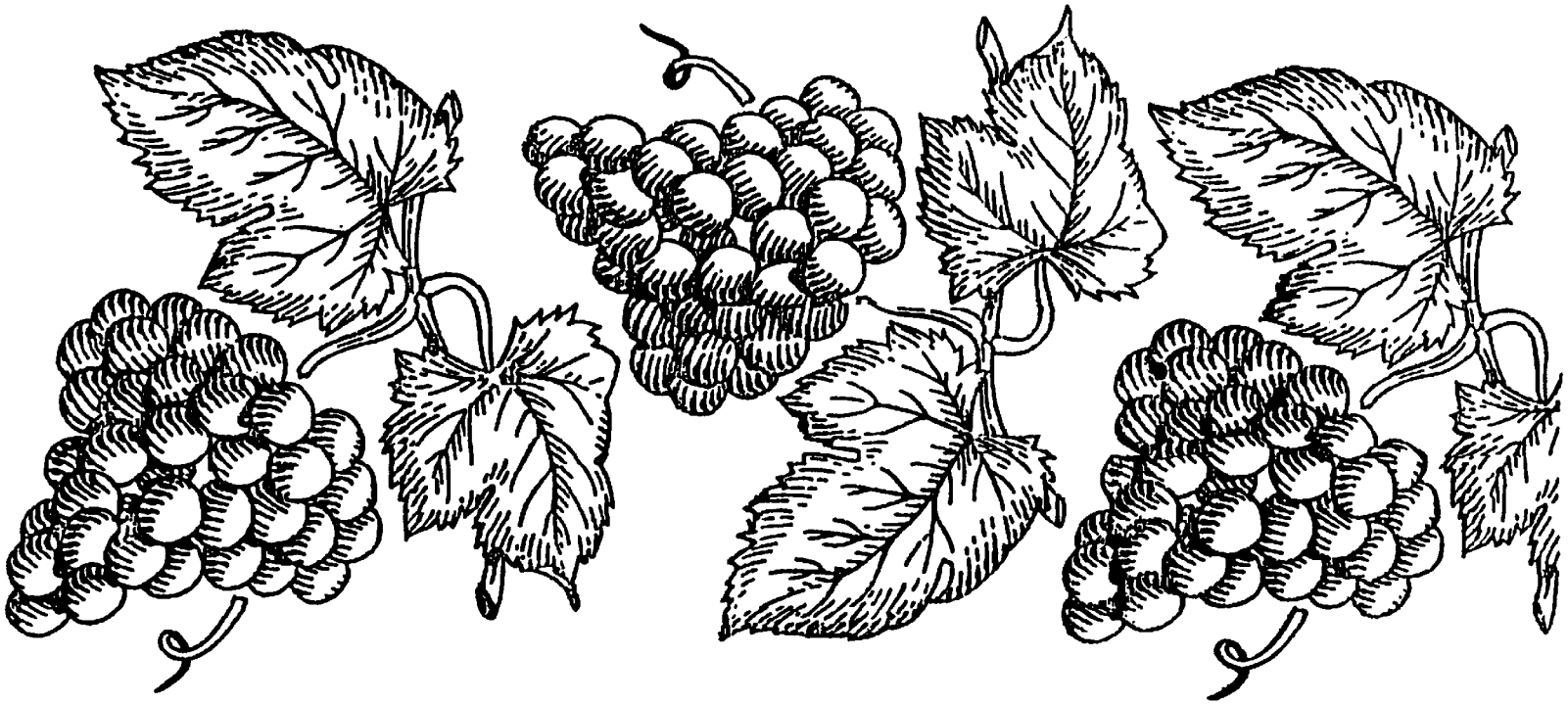
FIG. 2 illustrates the Bordelaise print pattern printed using a rotogravure or flexographic printing process prior to or after embossing of the one-ply absorbent paper product. One or both sides of the paper are printed.
Figure 3:
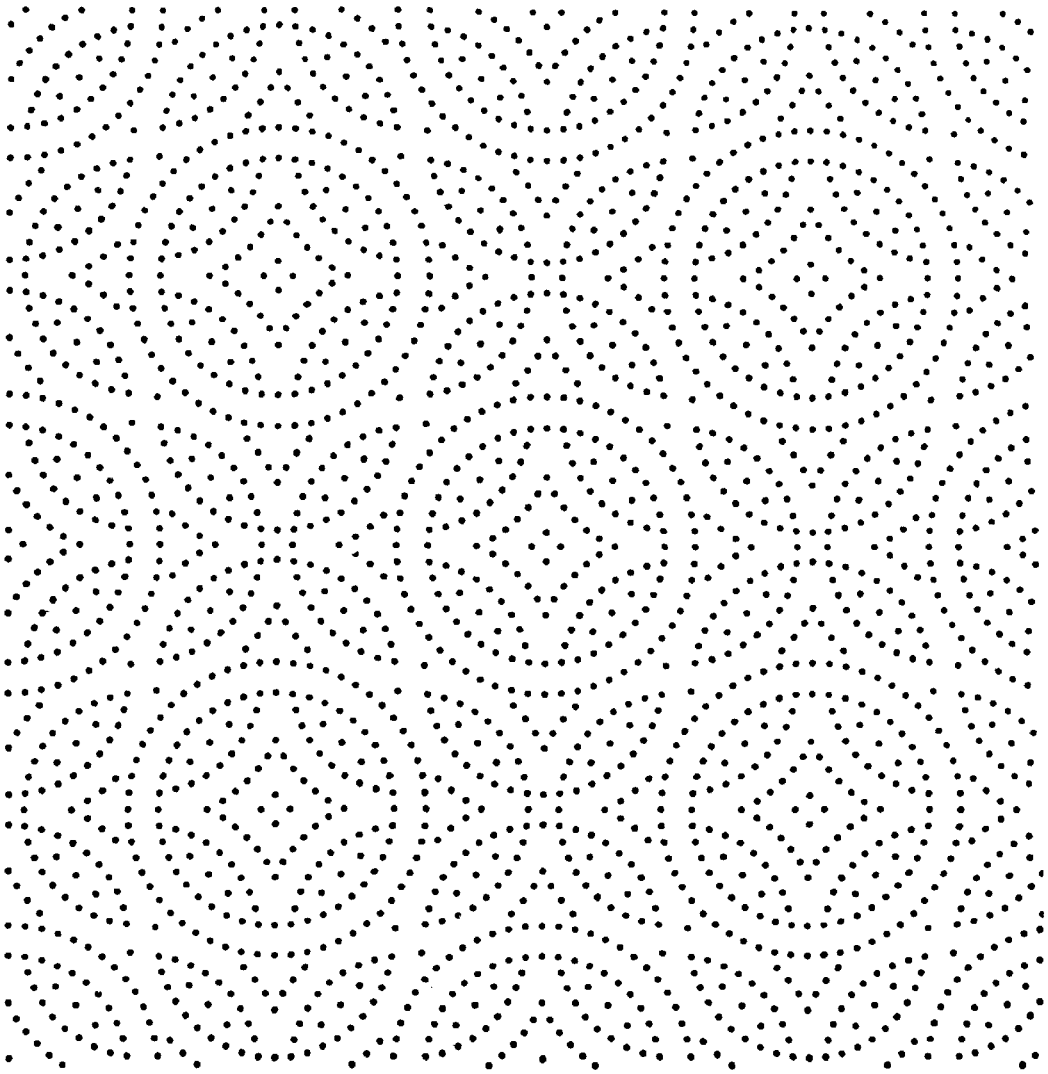
FIG. 3 illustrates the Arabesque emboss pattern.

Embossed, one-ply tissue substrate was printed with napkin/towel ink formulations using flexographic printing process on the pilot printing press in Milford, Ohio. Successful flexographic printing on one-ply bathroom tissue substrate was demonstrated. Prior to printing, the base sheet was embossed using the Arabesque emboss pattern shown in FIG. 3. Print equipment set-up included a 4.2 Billion Cubic Microns per in.$^2$ (BCM), 360 line/inch anilox roll and flexographic plates (AP55 Vinyl—Towel "Bear and Cupcake" print pattern and NR 850R rubber—napkin "Bordelaise" print pattern) mounted on 22" repeat, directly. One-ply embossed tissue substrates were successfully printed in a variety of ink colors. Table 1 shows the specific inks and ink dilutions that were used for each sample. FIGS. 1 and 2 show the "Bear and Cupcake" and "Bordelaise" print patterns, respectively. FIG. 3 shows the "Arabesque" emboss.

TABLE 1

Flexographic Printing Samples

| Sample Number | Ink Color | Progressive Inks Company Ink ID | Ink Ratio Water:Ink |
|---|---|---|---|
| 1 | Pink 203U | WTM60129 | 5:1 Mix |
| 2 | Cranberry 213U | WTM60128 | 3:2 Mix |
| 3 | Orchid Blue 2718U | WTM60127 | 3.15:1 Mix |
| 4 | Green 3255U | WTM60106 | 3:1 Mix |
| 5 | Pink 190U | WTM60120 | 3:1 Mix |
| 6 | Red 185U | WTM60108 | 1.5:1 Mix |
| 7 | BIue 291U | WTM60107 | 3.5:1 Mix |
| 8 | Peach 170U | WTM60110 | 3:1 Mix |
| 9 | Purple 521U | WTM60109 | 2:1 Mix |

EXAMPLE 2

(Samples 10–12)

Figure 4:
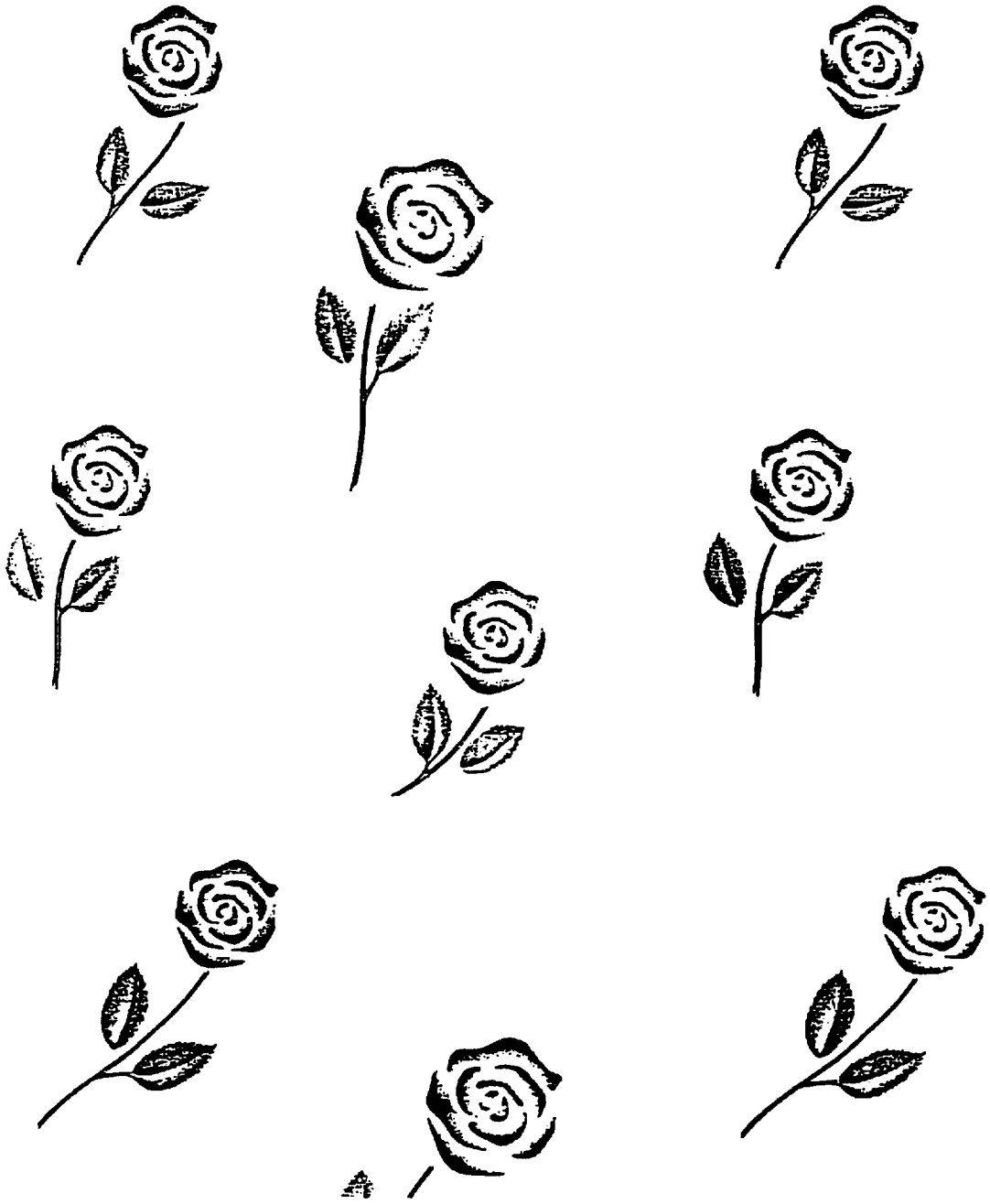
FIG. 4 illustrates the Rose print pattern printed using a rotogravure printing process prior to or after embossing of the one-ply absorbent paper product. One or both sides of the paper can be printed.

Unembossed, one-ply bathroom tissue was printed on the pilot press in Milford, Ohio, using the rotogravure process in combination with the QNBT™ "Rose" pattern print cylinder shown in FIG. 4. Successful rotogravure printing on one-ply bathroom tissue substrate was demonstrated. The tissue base sheet has a furnish blend of 10% Northern Softwood, 40% Southern Hardwood, and 50% Green Bay Secondary fiber. The physical properties of the base sheet used in Example 2 are shown in Table 2. Printing ink information for Example 2 is listed in Table 3.

TABLE 2

Base Sheet Physicals

| GB Reel Number | Basis Weight (lb/ream) | Front Caliper (mils/8 sheets) | Front Caliper (mils/8 sheets) | MD Dry Tensile (g/3") | MD Stretch (%) | CD Dry Tensile (g/3") | CD Wet Tensile (g/3") | GM Modulus |
|---|---|---|---|---|---|---|---|---|
| 594103 | 19.56 | 50.6 | 47.9 | 1220 | 30.8 | 732 | 88 | 25.3 |

TABLE 3

Printed Rotogravure Samples

| Sample Number | Ink Color | Progressive Inks ID | Ink Ratio Water:Ink |
|---|---|---|---|
| 10 | Peach | WTM 60141 | 15:1 |
| 11 | Rose | WTM 60142 | 15:1 |
| 12 | Blue | WTM 60143 | 15:1 |

EXAMPLE 3

(Samples 13–20)

Figure 5:
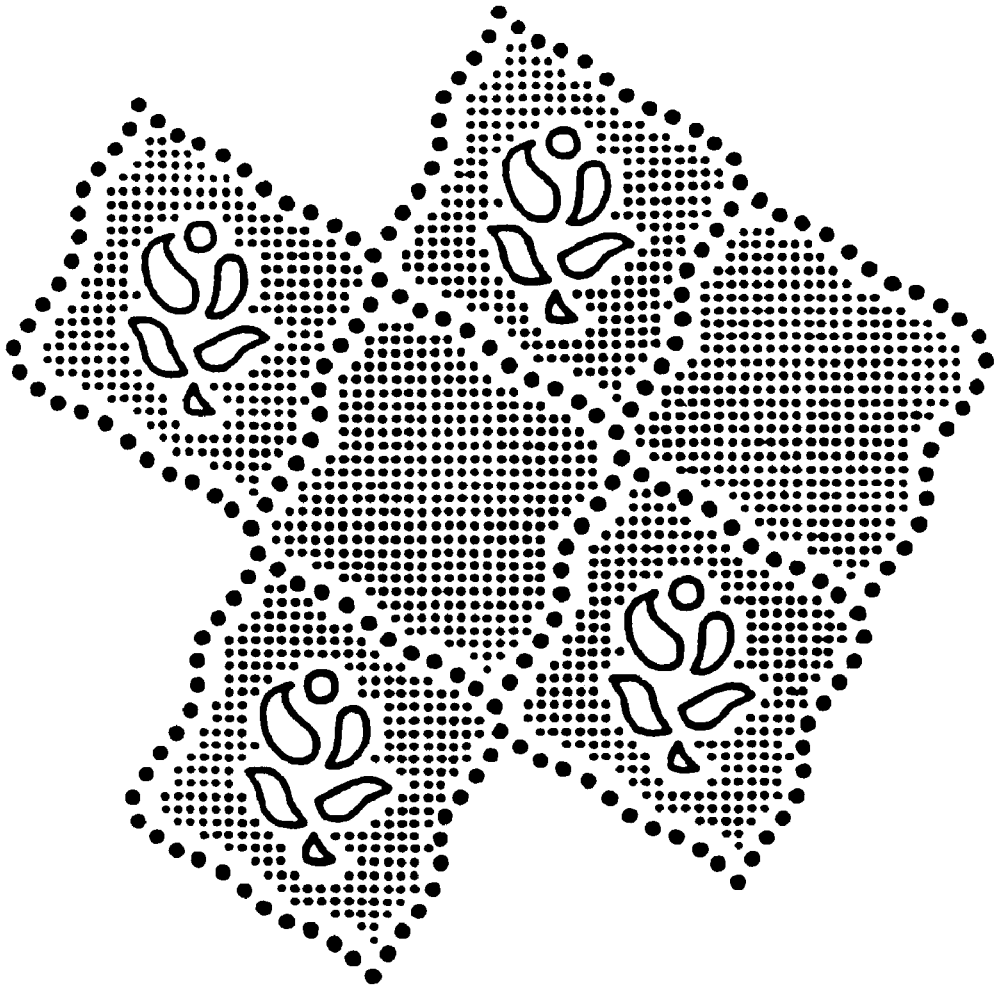
FIG. 5 illustrates the flower emboss pattern which can be macro embossed or micro embossed as shown in FIGS. 15*a, b*, and *c*.

Unembossed, one-ply tissue substrates were successfully printed on the pilot press using the rotogravure process in combination with the QNBT™ "Rose" pattern print cylinder. The focus of the printing portion of this example was to ascertain whether our novel process and product would encounter common printing problems relative to one-ply substrate, namely ink migration through the sheet, ink buildup on the impression roll, plugging of the gravure roll engraving, and overall print quality. The printed base sheet was later successfully embossed on NTC CL#5 using mated micro-macro (M3), steel to steel and Double Hearts, rubber to steel embossing. The primary focus of the embossing portion of this example was to ascertain that printed one-ply tissue substrate can be successfully embossed without incurring emboss process problems such as printed areas of the substrate sticking to the emboss rolls, resulting in plugged emboss elements or wrapping of the sheet around the emboss rolls. The mated micro-macro emboss pattern and non-mated double hear emboss pattern shown in FIGS. 5 and 6 respectively were used. None of these problems occurred. Embossing variables included print color, emboss pattern and sheet count. The base sheet furnish consisted of 20% western softwood, 30% premium northern hardwood, 35% Halsey secondary fiber, and 15% Halsey broke. The physical properties of the base sheet, finished one-ply prototypes and two-ply controls (Halsey two-ply QNBT) are shown in Table 4. Printing ink information for samples in Example 3 is listed in Table 5. The "Rose print pattern is shown in FIG. 4.

TABLE 4

Physical Properties - Example 3

| Sample No. | Sheet Count | Color | Basis Weight (lbs/ream) | Caliper (mils/8 sheets) | MD Dry Tensile (g/3") | CD Dry Tensile (g/3") | MD Dry Stretch (%) | CD Wet Tensile (g/3") | Roll Diameter (in.) | Roll Compression (%) | Friction Deviation (gm mmd) Tensile | Sided-Ness | Modulus (g/in/%) | Sensory Softness | Sensor Bulk |
|---|---|---|---|---|---|---|---|---|---|---|---|---|---|---|---|
| 13.1 | Base | Unprinted | 18.3 | 44.3 | 1021 | 534 | 21.3 | 96.2 | | | .173 | .216 | 26.2 | | |
| 13.2 | Base | Blue | 18.0 | 40.4 | 903 | 495 | 15.3 | 86.7 | | | .174 | .183 | 20.3 | | |
| 13.3 | 280 | Blue | 17.8 | 65.2 | 710 | 317 | 14.1 | 63.4 | 4.13 | 24.9 | .182 | .207 | 14.9 | 16.53 | −0.65 |
| 21 | 280 (Control) | Blue (2-Ply QNBT) | 18.9 | 66.1 | 1008 | 362 | 13.1 | 20.4 | 4.26 | 25.1 | .168 | | 20.1 | 17.27 | −0.36 |
| 14.1 | Base | Unprinted | 18.2 | 42.2 | 1036 | 597 | 18.6 | 108.9 | | | .192 | .199 | 25.5 | | |
| 14.2 | Base | Rose | 18.6 | 41.4 | 1022 | 554 | 19.7 | 97.5 | | | .167 | .185 | 25.9 | | |
| 14.3 | 280 | Rose | 18.0 | 62.7 | 739 | 307 | 14.8 | 62.6 | 4.14 | 25.4 | .184 | .208 | 15.7 | 16.65 | −0.55 |
| 22 | 280 (Control) | Rose (2-Ply QNBT) | 19.2 | 66.0 | 1141 | 406 | 13.9 | 22.0 | 4.26 | 24.6 | .159 | | 21.9 | 17.24 | −0.20 |
| 15.1 | Base | Unprinted | 18.5 | 42.5 | 979 | 556 | 16.4 | 94.9 | | | .170 | .174 | 29.0 | | |
| 15.2 | Base | Peach | 18.3 | 42.6 | 936 | 501 | 16.8 | 84.2 | | | .178 | .187 | 19.2 | | |
| 15.3 | 280 | Peach | 17.9 | 63.8 | 699 | 321 | 13.4 | 63.6 | 4.10 | 24.4 | .182 | .205 | 15.8 | 16.43 | −0.40 |
| 23 | 280 (Control) | Peach (2-Ply QNBT) | 19.0 | 66.9 | 962 | 379 | 12.3 | 20.9 | 4.20 | 22.6 | .171 | | 22.6 | 17.01 | −0.21 |
| 16.1 | Base | Unprinted | 18.5 | 42.5 | 979 | 556 | 16.4 | 94.9 | | | .170 | .174 | 29.0 | | |
| 16.2 | Base | Peach | 18.3 | 42.6 | 936 | 501 | 16.8 | 84.2 | | | .178 | .187 | 19.2 | | |
| 16.3 | 560 (M3) | Peach | 17.9 | 51.0 | 705 | 305 | 13.4 | 60.2 | 4.84 | 17.8 | .170 | .180 | 17.0 | 17.19 | −0.94 |
| 17.1 | Base | Unprinted | 18.5 | 42.5 | 979 | 556 | 16.4 | 994.9 | | | .170 | .174 | 29.0 | | |
| 17.2 | Base | Peach | 18.3 | 42.6 | 936 | 501 | 16.8 | 84.2 | | | .178 | .187 | 19.2 | | |
| 17.3 | 560 (Double Hearts) | Peach | 17.7 | 51.0 | 695 | 287 | 10.7 | 62.2 | 4.85 | 15.9 | .179 | .204 | 16.4 | 16.95 | −0.88 |
| 18.1 | Base | Unprinted | 18.4 | 43.0 | 868 | 590 | 16.3 | 98.0 | | | .174 | .191 | 29.6 | | |
| 18.2 | 280 | Blue | 17.9 | 69.9 | 707 | 290 | 12.4 | 58.7 | 4.15 | 3.21 | .095 | .235 | 15.0 | | |
| 19.1 | Base | Unprinted | 18.3 | 42.5 | 1082 | 555 | 19.2 | 102.2 | | | .201 | .203 | 29.8 | | |
| 19.2 | Base | Rose | 18.4 | 42.9 | 1033 | 508 | 16.1 | 93.5 | | | .164 | .179 | 20.5 | | |
| 19.3 | 280 | Rose | 17.8 | 67.7 | 735 | 306 | 12.9 | 65.4 | 4.13 | 3.18 | .198 | .231 | 15.7 | | |
| 20.1 | Base | Unprinted | 19.1 | 44.3 | 1097 | 559 | 19.2 | 102.4 | | | .187 | .190 | 32.9 | | |

TABLE 4-continued

Physical Properties - Example 3

| Sample No. | Sheet Count | Color | Basis Weight (lbs/ream) | Caliper (mils/8 sheets) | MD Dry Tensile (g/3") | CD Dry Tensile (g/3") | MD Dry Stretch (%) | CD Wet Tensile (g/3") | Roll Diameter (in.) | Roll Compression (%) | Friction Deviation (gm mmd) Tensile | Sided-Ness | Modulus (g/in/%) | Sensory Softness | Sensor Bulk |
|---|---|---|---|---|---|---|---|---|---|---|---|---|---|---|---|
| 20.2 | Base | Peach | 18.1 | 40.8 | 1115 | 479 | 15.7 | 91.6 | | | .183 | .198 | 21.1 | | |
| 20.2 | 280 | Peach | 17.6 | 69.1 | 719 | 305 | 11.4 | 64.7 | 4.18 | 3.16 | .213 | .254 | 16.7 | | |

TABLE 5

Printed Rotogravure Samples

| Sample Number | Ink Color | Progressive Inks Ink ID | Ink Ratio Water:Ink |
|---|---|---|---|
| 13 | 545U-Blue | WTM 60143R | 15:1 Mix |
| 14 | 494U-Rose | WTM 60142R | 15:1 Mix |
| 15 | 177U-Peach | WTM 60141R | 15:1 Mix |
| 16 | 177U-Peach | WTM 60141R | 15:1 Mix |
| 17 | 177U-Peach | WTM 60141R | 15:1 Mix |
| 18 | 545U-Blue | WTM 60143R | 15:1 Mix |
| 19 | 494U-Rose | WTM 60142R | 15:1 Mix |
| 20 | 177U-Peach | WTM 60141R | 15:1 Mix |

EXAMPLE 4

(Samples 18.3 and 18.4)

"Air-Side" vs. "Yankee-Side" printing was demonstrated on the pilot printing press using the rotogravure process in combination with the QNBT™ "Rose" pattern print cylinder. The primary focus of this portion of the run was to observe and document any differences between air-side and Yankee side printing. No visual differences in print quality were observed. Other printing issues relative to one-ply substrate, namely ink migration through the sheet, ink buildup on the impression roll and plugging of the gravure roll engraving were acceptable and similar for both sides. The base sheet furnish consisted of 20% western softwood, 30% premium northern hardwood, 35% Halsey secondary fiber, and 15% Halsey broke. Printing ink information for samples in Example 4 is shown in Sample number 18 of Table 5. The "Rose" print pattern is sown in FIG. 4. Physical properties of base sheets printed on the Yankee and air sides are shown in Table 6.

The single-ply invention base sheet was produced on a commercial paper machine and is a three-layer stratified sheet with a basis weight of 19.5 pounds per 3000 square feet. The outer layers (20% each) are comprised of Old Town Premium HWK, while the center layer (60%) is comprised of 25% Wauna B 16 SWK, 50% Halsey secondary fiber, and 25% broke. The two-ply commercial base sheet is a two-layer (per ply) stratified sheet, with each ply having a basis weight of 9.83 pounds per 3000 square feet. The Yankee side layer (25% of the total furnish) contains 100% Old Town Premium HWK. The air side layer (75% of the total furnish) contains 65% Halsey secondary fiber, 15% Wauna B 16 SWK, and 20% broke. Base sheet physical properties and microscopy data are shown in Tables 7 and 8, respectively. FIGS. 7A and 7B show cross-sectional differences in caliper between the two base sheets.

Printed samples were produced on a Geiger Tool & Mfg. Gravure proofer using a 175 line screen test tone cylinder. Impression nip was set at 3/16-inch nip width with a 68 Shore A impression roller. Speed control was set at a 1.5 level. Progressive Ink WTM 60143 QNBT blue tissue ink was run at a 15:1 water-to-ink mixture. This ink mixture is used to produce QNBT Soft Print® at Green Bay East, Old Town, Naheola, and Halsey mills. Two plies were run through the nip: one each of single-ply (19.5 pounds per 3000 square feet) and one ply (9.83 pounds per 3000 square feet) of a two-ply substrate. Physical property data for the two substrates are shown in Table 7. Microscopy data for the two substrates are shown in Table 8. The substrate position was varied so that the single-ply top or two-ply top (Yankee) side was printed, thus total thickness and print impression remained constant at all times. An additional sample was produced by printing on the bottom (air) side of the single-ply substrate.

Samples were measured with an X-Rite 938 spectrodensitometer. The 100% solid tone was measured for L*C*H° color space coordinates and ΔEcmc using a 4 mm aperture, D65 light source, 100 standard observer, and 2:1:1 factor setting. As described in the X-Rite Color Guide and Glossary, L*C*H° is a three-dimensional cylindrical representation of color, where L* depicts Lightness, C* depicts

TABLE 6

Physical Properties of Yankee-Side vs. Air Side Printing on One-Ply Tissue Base Sheet

| Sample Number | Sheet Count | Color | Basis Weight (lbs/ream) | Caliper (mils/ 8 sheets) | MD Dry Tensile (g/3") | CD Dry Tensile (g/3") | MD Dry Stretch (%) | CD Wet Tensile (g/3") | Friction Deviation (gm mmd) | Sidedness | Tensile Modulus (g/in/%) |
|---|---|---|---|---|---|---|---|---|---|---|---|
| 18.3 | Base (Yankee) | Blue | 18.6 | 41.7 | 945 | 505 | 15.4 | 89.4 | .168 | .190 | 23.2 |
| 18.4 | Base (Air Side) | Blue | 18.4 | 40.2 | 965 | 477 | 16.2 | 83.6 | .193 | .193 | 24.8 |

ROTOGRAVURE (EXAMPLES 5–7, FIGS. 10A AND 10B)

EXAMPLE 5

Two bathroom tissue base sheets with distinctly different basis weights were compared for printing characteristics.

Chroma (saturation) and H° depicts Hue angle. CMC tolerancing is a modification of the L*C*H°, providing better agreement between visual assessment and instrumentally measured color difference. The CMC calculation mathematically defines and ellipsoid around the standard color with semi-axis corresponding to hue, chroma, and lightness and allows for a user defined acceptance level. The X-Rite 938 Operation Manual defines ΔEcmc as a single numeric value that expresses total color difference between a sample and a standard. A standard Whatman #1 filter paper was used as a backing during measurement. Each measurement reported is an average of three measurements. Differences in ΔEcrmc were used to quantify similarity or differences in print appearance between the samples. At a total color difference (ΔEcmc) value of ≦1.0, a typical observer would not detect differences in appearance between samples.

This example (Table 9) demonstrates that an average observer would not perceive visible color differences between substrates. With the close proximity of ΔEcmc values (≦1.0) between the invention top (Yankee side) surface and the bottom (air side) surface, one can also conclude that the surfaces offer equivalent printing characteristics.

TABLE 7

Physical Property Data for Single-Ply and Two-Ply Substrates

| Sample | Basis Weight lb/ 300 ft$^2$ | Caliper Mils/8 sheets | MD Tensile g/3 in. | CD Tensile g/3 in. | MD Stretch % | CD Stretch % | CD Wet Tensile g/3 in. | GM MMD Friction 8 Spa-W | GM MMD Friction Top-W | GM MMD Friction Bot-W | Sid-ed-ness | GM Modulus g/% Stretch | Parker Print Yankee (microns) | Parker Print Air Side (microns) |
|---|---|---|---|---|---|---|---|---|---|---|---|---|---|---|
| Commercial 2-Ply Top printed ply) | 9.83 | 24.7 | 682 | 287 | 15.4 | 5.8 | NA | 0.172 | 0.165 | 0.178 | 0.185 | 21.8 | 8.18 | 8.76 |
| Single Ply | 19.5 | 51.9 | 1052 | 699 | 29.9 | 3.5 | 99 | 0.240 | 0.217 | 0.262 | 0.289 | 27.0 | 10.23 | 10.89 |

TABLE 8

Microscopy Data for Single-Ply and Two-Ply Substrates

| Sample | Robotest Formation Index | Crepes Per Centimeter | Apparent Bulk (um) | Flat Sheet Caliper (um) | Base Sheet Caliper (um) | Percent Void Area | Sidedness Index | Wavelength (um) | Crepe Amplitude (um) |
|---|---|---|---|---|---|---|---|---|---|
| Commercial 2-Ply (Top printed ply) | 77.40 | 55.1 | 112 | 29.2 | 37.7 | 3.1 | 0.0084 | 180.4 | 62.8 |
| Single Ply | 66.63 | 47.1 | 205 | 64.4 | 91.0 | 3.2 | −0.0220 | 209.1 | 131.2 |

TABLE 9

Total Color Difference In Single-Ply Top and Bottom vs. Two-Ply Top Gravure Solid Tone

| Sample | L* | C* | H° | ΔEcmc |
|---|---|---|---|---|
| Commercial 2-Ply (Printed Top Ply) | 67.03 | 23.99 | 256.03 | — |
| Single-Ply Top | 66.33 | 23.43 | 256.45 | 0.43 |
| Single-Ply Bottom | 68.13 | 22.67 | 255.73 | 0.85 |

EXAMPLE 6

This replicate example (Table 10) further demonstrates that top and bottom surfaces offer equivalent printing characteristics as defined by ΔEcmc≦1.0. These samples were printed under the same conditions and on the same substrates as described in Example 5.

TABLE 10

Total Color Difference: Single-Ply Top vs. Single-Ply Bottom Gravure Solid Tone

| Sample | L* | C* | H° | ΔEcmc |
|---|---|---|---|---|
| Single-Ply Top (Yankee Side) | 66.17 | 22.99 | 256.49 | — |
| Single-Ply Bottom (Air Side) | 68.64 | 22.23 | 255.41 | 0.81 |

EXAMPLE 7

This example shows distinct differences in strikethrough between two-ply and single-ply samples printed with the Geiger Gravure Proofer under the same printing conditions and on the same substrates as described in Example 5. Specifically, the example demonstrates that the ink strikethrough level for the top ply of a printed two-ply product is greater than that observed for the single-ply tissues of this invention. Strikethrough can be described as ink migration through the sheet, and in this example, onto the backing ply. Strikethrough differences between the two-ply commercial base sheet and the single-ply invention are demonstrated in FIGS. 8A2, 8B2, and 8C2. In this example, the backing ply was measured for ink transfer using the same X-Rite settings described in Example 5. The amount of ink on the backing ply was compared to white, non-print areas. As in Examples 5 and 6, the two-ply and single-ply substrates were paired during printing, varying the ply positions according to which substrate was to be printed, keeping total thickness and total basis weight (29.33 lb. per 3000 square feet) constant. The ΔEcmc values in Table 11 indicate that strikethrough was much greater for the lower basis weight sample, and further suggests that the amount of strikethrough is a function of basis weight. Robotest Formation Index and percentage Void Area data shown in Table 8 do not suggest that sheet formation or percentage void volume contributed to ink strikethrough differences. The C* value or saturation level of the ink appears to have the greatest influence in the ΔEcmc differences and can be readily observed in the photographs of the back plies seen in FIGS. 8A2, 8B2, and 8C2. Similar ΔEcmc values for the Single-Ply Top (Yankee Side) and Single-Ply Bottom (Air Side) samples confirm similar print characteristics for both sides, which corresponds to their low sidedness (<0.300) as seen in Table 7.

TABLE 11

Ink Strike through On Back Ply
Gravure Solid Tone

| Sample | Basis Weight | L* | C* | H° | ΔEcmc |
|---|---|---|---|---|---|
| Commercial 2-Ply (Printed Top Ply) | 9.83 lb./3000 $ft^2$ | 82.91 | 12.57 | 248.83 | 12.09 |
| Single-Ply Top (Yankee Side) | 19.5 lb./3000 $ft^2$ | 92.35 | 3.37 | 244.50 | 4.67 |
| Single-Ply Bottom (Air Side) | 19.5 lb./3000 $ft^2$ | 91.92 | 3.99 | 245.24 | 5.19 |

FLEXOGRAPHIC (EXAMPLES 8–9, FIGS. 11A AND 11B)

EXAMPLE 8

This example (Table 12) indicates similar print characteristics between the top (Yankee) surfaces of the two substrates, but an observable difference was indicated between the commercial two-ply and the one-ply invention back (air) sides. These differences were not seen in a replicate sample (Table 13) where a low ΔEcmc value of <1.0 was obtained.

These flexographic print samples were produced using an Early Flexo Hand Proofer set with a 200 line per inch quad engraved anilox roller and 70 Shore A durometer rubber roller. The anilox and rubber roller are easily changed to permit alternative roller combinations to be utilized. In addition to samples produced with the 200 quad anilox, samples with a 360 line quad anilox were evaluated. Progressive Ink WTM 60107 Blue ink at a 1:1 water-to-ink mixture was used.

TABLE 12

Total Color Difference in Single-Ply Top and Bottom vs. Commercial Two-Ply
Flexographic Hand Proofer (200 Quad)

| Sample | L* | C* | H° | ΔEcmc |
|---|---|---|---|---|
| Commercial Two-Ply (Printed Top Ply) | 68.33 | 16.27 | 257.94 | — |
| Single-Ply Top (Yankee Side) | 70.31 | 15.29 | 257.43 | 0.71 |
| Single-Ply Bottom (Air Side) | 71.97 | 13.71 | 257.48 | 1.61 |

TABLE 13

Total Color Difference in Single-Ply Bottom (Repeat) vs. Commercial Two-Ply Top
Flexographic Hand Proofer (200 Quad)

| Sample | L* | C* | H° | ΔEcmc |
|---|---|---|---|---|
| Commercial Two-Ply (Printed Top Ply) | 68.28 | 16.61 | 258.08 | — |
| Single Ply Bottom | 71.30 | 14.61 | 257.39 | 0.95 |

Prior to printing, comparative samples were butted side-by-side to provide the same pressure and speed conditions. An aliquot of 1:1 water-to-ink mixture was then pipetted into the nip between the anilox and rubber roller. The Progressive Inks ID was the same as that described in Sample 12 of Table 3. The proofer was then drawn down over the substrates with as even a speed and pressure as possible. Ink was transferred to the substrates directly from the anilox roller. The amount and quality of transfer was controlled by the skill of the operator. Motorized proofing units exist but were not available for our use.

Samples were measured with the X-Rite 938 spectrodensitometer at identical settings used for the rotogravure measurement as described in Sample 5. Samples were compared for ΔEcmc total color difference, also as described in Sample 5. The observable difference in ΔEcmc seen between the single-ply back (air) sides in Tables 12 and 13 were likely influenced by speed and pressure differences between the two runs.

EXAMPLE 9

This example illustrates that there is no observable difference in print appearance when comparing respective top to bottom sides of commercial two-ply and the single-ply invention, as shown by ΔEcmc values of <1.0 in Table 14. Both substrates are the same as those described in Sample 5 with the same physical properties shown in Tables 7 and 8. The samples were printed with the Early Flexo Hand Proofer described in Example 8, but with a 360 line per inch quad engraved anilox roller instead of the 200 quad roller. Color difference measurements were made with the X-Rite 938 spectrodensitomer at the same settings described in Sample 5.

TABLE 14

Total Color Difference in Single-Ply Top vs. Single-Ply Bottom and Commercial Two-Ply Top vs. Commercial Two-Ply Bottom
Flexographic Hand Proofer (360 Quad)

| Sample | L* | C* | H° | ΔEcmc |
|---|---|---|---|---|
| Commercial Two-Ply (Printed Top Ply) | 67.49 | 16.95 | 257.91 | — |
| Commercial Two-Ply (Printed Bottom Ply) | 67.12 | 17.19 | 258.08 | 0.23 |
| Single-Ply Top | 85.05 | 6.21 | 248.27 | — |
| Single-Ply Bottom | 85.80 | 5.47 | 249.65 | 0.41 |

Letterpress

EXAMPLE 10

A Little Joe Model S78 Offset Swatching Press was utilized to produce letterpress printed samples. A BASF FARII 0.107-inch thick photopolymer plate sample was mounted in place of the offset blanket in the press. The inking form was shimmed to provide an approximate 0.004-inch interference to the plate during contact for ink transfer. Printing takes place by transfer of ink to the photopolymer plate followed by continued travel to a substrate sample holder shimmed for 0.004-inch interference. Ink is transferred by the raised image on the plate directly to the substrate. Five grams of Sun Chemical glycol letterpress WKD51043L ink was distributed by brayer on the inking plate prior to three passes to the ink form. The Sun Chemical ink is currently used to produce Northern® one-ply printed napkins.

Both single-ply and two-ply base sheets as described in Example 5 can be printed by letterpress. However, both substrates showed problems with mottled ink lay and fiber pick on the raised surface of the printing plate. Modification to the printing plate type and ink formulations are recommended based on these preliminary results.

EXAMPLE 11

Successful printing on one-ply tissue substrate was demonstrated on full in-line converting on a commercial line. One-ply substrate was printed with the QNBT™ "Rose" pattern in three colors (blue, rose and peach) in-line prior to embossing with the Double Hearts emboss pattern. Printed one-ply QNBT™ bathroom tissue was made into both 280-count and 560-count products. A limited amount of product was made at commercial machine speeds of between 900 and 1200 ft/min. The focus of the printing portion of this trial was to observe and document printing issues relative to one-ply substrate, namely ink migration through the sheet, ink buildup on the impression roll, plugging of the gravure roll engraving, and overall print quality. The base sheet furnish consisted of 20% western softwood, 30% premium northern hardwood, 35% Halsey secondary fiber, and 15% Halsey broke. Physical properties and sensory softness/bulk ratings for this example are shown in Table 15. The "Rose" print pattern is shown in FIG. 4.

TABLE 15

Physical Properties and Sensory Softness/Bulk

| Sample Number | Sheet Count | Colors | Basis Weight (lbs/ream) | Caliper (mils/8 sheets) | MD Dry Tensile (g/3") | CD Dry Tensile (g/3") | MD Dry Stretch (%) | CD Wet Tensile (g/3") | Roll Dia. (inches) | Roll Comp. (%) | Friction deviation (gm mmd) | Sidedness | Tensile Modulus (g/in/%) | Sensory Softness | Bulk |
|---|---|---|---|---|---|---|---|---|---|---|---|---|---|---|---|
| 24 | 280 | Blue, Rose, Peach | 18.7 | 68.9 | 686 | 319 | 18.7 | 61.0 | 4.24 | 23.4 | .183 | .230 | 12.6 | 15.66 | −0.87 |
| 25 | 560 | Blue, Rose, Peach | 18.4 | 57.0 | 748 | 349 | 19.6 | 67.7 | 4.89 | 12.6 | .182 | .185 | 15.4 | 16.08 | −0.87 |

EXAMPLE 12

One-ply tissue base sheets were made on a pilot paper machine as shown in FIG. 9 from a furnish containing a 2/1 blend of Southern Hardwood Kraft (HWK)/Southern Softwood Kraft (SWK). Six pounds per ton of a cationic temporary wet strength agent (CoBond® 1000) were added to the furnish. Two and one-half pounds per ton of a tertiary-amine-based softener (Quasoft® 218) were applied to the sheets. The strength of the tissue sheets was controlled by wet-end addition of an imidazoline-based softener/debonder. The base sheets were made at different levels of % stretch, with the stretch being changed by changing the % crepe. In this case, the % crepe levels employed were 25% and 20%. The physical properties of the base sheets are shown in Table 16.

TABLE 16

Physical Properties of One-Ply Base Sheets

| Product | Basis Weight (lbs./ream) | Caliper (mils/8 sheets) | Specific Caliper (mils/8 sheets/Lbs./Ream) | MD Tensile (grams/3 inches) | CD Tensile (grams/3 inches) | Specific Total Tensile (grams/3 in./lbs./ream) | Tensile Ratio | MD Stretch (%) | Tensile stiffness (grams/inch/%) | Specific Tensile stiffness (grams/inch/%/lbs/ream) | Friction Deviation |
|---|---|---|---|---|---|---|---|---|---|---|---|
| Lower Stretch | 18.4 | 43.6 | 2.37 | 802 | 508 | 71.2 | 1.58 | 19.1 | 28.0 | 1.52 | 0.170 |
| Higher Stretch | 17.9 | 45.2 | 2.53 | 819 | 534 | 75.6 | 1.53 | 27.2 | 22.5 | 1.26 | 0.173 |

The base sheets were converted to 560-count finished products by embossing them with a spot emboss pattern containing crenulated elements. The emboss pattern was the one shown in FIG. 6. Both base sheets were embossed at an emboss depth of 0.070". The physical properties of the embossed products are shown in Table 17. This sheet is printed using flexographic printing after embossing as shown in Example 1, or it is printed prior to embossing using the rotogravure printing process as shown in Example 3. Printed samples of both base sheets (lower stretch and higher stretch) were produced on a Geiger Tool & Mfg. Gravure proofer as described in Example 5. L*C*H° and ΔEcmc measurements were taken as described in Example 5 and are shown in Table 18.

TABLE 17

Physical Properties of 560-Count One-Ply Embossed Products

| Product | Basis Weight (lbs./Ream) | Caliper (mils/8 sheets) | Specific Caliper (mils/8 sheets/Lbs/3000 sq. ft. ream) | MD Tensile (grams/3 inches) | CD Tensile (grams/3 inches) | Specific Total Tensile (grams/3 inches/lbs/3000 sq. ft. Ream) | Tensile Ratio | MD Stretch (%) | Tensile stiffness (grams/inch/%) | Specific Tensile stiffness (grams/inch/%/lbs/3000 sq. ft. ream) | Friction Deviation |
|---|---|---|---|---|---|---|---|---|---|---|---|
| Lower Stretch | 18.3 | 57.0 | 3.11 | 612 | 309 | 50.3 | 1.98 | 15.1 | 18.2 | 0.99 | 0.164 |
| Higher Stretch | 18.2 | 54.5 | 2.99 | 753 | 414 | 64.1 | 18.2 | 22.6 | 17.4 | 0.96 | 0.181 |

TABLE 18

L*C*H° Color Measurements and Total Color Difference (ΔEcmc) Examples 12–15

| Sample | Sample Type | L* | C* | H° | ΔEcmc |
|---|---|---|---|---|---|
| Lower Stretch | Base Sheet | 67.84 | 23.25 | 255.47 | 0.43 |
| Higher Stretch | Base Sheet | 67.57 | 23.59 | 255.41 | 0.43 |
| Products #1, #5, #7 | Base Sheet | 68.21 | 23.59 | 255.86 | 0.25 |
| Product #2 | Base Sheet | 65.98 | 23.55 | 256.25 | 0.27 |
| Product #2 | Embossed Product | 67.94 | 23.55 | 256.57 | —(Control) |
| Product #3 | Base Sheet | 68.26 | 23.59 | 256.22 | 0.17 |
| Product #3 | Embossed Product | 67.71 | 23.81 | 256.86 | 0.21 |
| Products #4, #6, #8 | Base Sheet | 67.76 | 23.29 | 254.97 | 0.57 |
| Product #4 | Embossed Product | 67.69 | 23.51 | 255.40 | 0.43 |

By comparing the MD and CD tensile strength of the two products prior to and after embossing, it can be seen that the lower-stretch tissue lost much more strength during the embossing than did the product having the higher level of stretch. The MD and CD tensile loss for the lower-stretch product was 24 and 39% respectively. The loss in MD and CD tensile for the higher-stretch product was only 8 and 22% respectively. It is believed that the higher stretch level allows the tissue sheet to conform more easily to the emboss elements, resulting in less rupturing of fiber-to-fiber bonds during the emboss process. Thus, although the strength of the two base sheets were very similar, the higher-stretch tissue has a finished product strength more than 25% greater than that of the lower-stretch tissue.

The two products were tested for sensory softness by a trained softness panel and found to have equal softness. This test result also demonstrates the superiority of the higher-stretch product, as it is well known that strength and softness are inversely related, and it would be expected that the weaker product would exhibit a higher softness level. Thus, the increased level of % stretch can be used to produce, at a given softness level, a product having superior strength. Alternatively, for a given finished-product strength level, employing a higher % stretch would allow use of a weaker, and thus softer, base sheet, allowing a softer finished product to be made.

EXAMPLE 13

Three one-ply tissue base sheets were produced on a pilot paper machine, as set forth in Example 12, from a furnish containing 50% Northern Softwood Kraft, 50% Northern Hardwood Kraft. Two of the base sheets were made at a targeted basis weight of 19 lbs. per 3000 square foot ream, the third as a targeted weight of 21 lbs. per 3000 square foot ream. All three base sheets were made to the same tensile targets. Where necessary, a cationic potato starch was added to the softwood kraft portion of the furnish to control the sheet strength. All of the base sheets were treated with a sprayed softening compound in the amount of 2.5 lbs. of softener (Quasoft® 218) per ton of fiber. The softener was applied to the Yankee side of the sheet while the sheet was on the felt shown in FIG. 9 from position 53. For one of the sheets made at the targeted basis weight of 19 lbs./ream (Product 1, below), a temporary wet strength agent, glyoxal, was applied to the sheet in the amount of 5 lbs. per ton of fiber. The wet strength agent was applied to the air side of the sheet as shown in FIG. 9 from position 52. The other 19 lbs./ream sheet (Product 2) and the sheet made at the 21 lbs./ream target level (Product 3) were not treated with the temporary wet strength agent. The three base sheets were all produced at 25% crepe and had base sheet MD stretch values of 30.6%, 31.1%, and 30.4% for Products 1, 2 and 3, respectively. All three base sheets were converted to 280 count finished product rolls by embossing the base sheet with a spot emboss pattern which contained crenulated elements. The physical properties of the embossed products are shown in Table 19. As can be seen from the table, the basis weight of all three products was decreased during the converting operation due to the tension applied to the base sheet webs during the embossing and winding process. The one-ply tissue base sheets are printed using flexographic printing after embossing as shown in Example 1 or they are embossed prior to printing using the rotogravure printing process as shown in Example 3. Printed samples of base sheets used in converting Products 1, 2, and 3 were produced on a Geiger Tool & Mfg. Gravure proofer as described in Example 5. Printed samples of embossed products 2 and 3 were also produced. L*C*H° and ΔEcmc measurements were taken as described in Example 5 and are shown in Table 18.

TABLE 19

Physical Properties of One-Ply Tissue Products

| Product Number | Basis Weight (lbs./3000 sq. ft. ream) | Caliper (mils/8 sheets) | Specific Caliper (mils/8 sheets/ lbs/3000 sq. ft. ream) | MD Tensile (g/3") | CD Tensile (g/3") | Specific Total Tensile (g/3"/ lbs/3000 sq. ft. ream) | Tensile Ratio | MD Stretch (%) | CD Wet Tensile (grams/ 3 in) | Specific CD Wet Tensile (grams/3 in/lbs./ sq. foot ream) | Tensile stiffness (grams/ in/%) | Specific Tensile stiffness (grams/in/ %/lbs/ sq. ft. ream) | Friction Deviation | Sidedness |
|---|---|---|---|---|---|---|---|---|---|---|---|---|---|---|
| 1 | 17.54 | 66.5 | 3.79 | 694 | 334 | 58.6 | 2.08 | 22.8 | 89 | 5.07 | 13.0 | 0.74 | 0.192 | 0.225 |
| 2 | 17.72 | 70.0 | 3.95 | 662 | 320 | 55.4 | 2.07 | 22.0 | 28 | 1.58 | 13.6 | 0.77 | 0.191 | 0.225 |
| 3 | 19.18 | 70.7 | 3.69 | 631 | 332 | 50.2 | 1.90 | 21.6 | 22 | 1.15 | 13.4 | 0.70 | 0.192 | 0.225 |

The three products were fielded in Monadic Home Use Tests to determine consumer reaction to the products. Test respondents were asked to rate the products for overall quality and for several attributes as being "Excellent," "Very Good," "Good," "Fair," or "Poor." The results of these ratings were tabulated by assigning numerical values to the responses with values ranging from a 5 for an "Excellent" rating to a 1 for a "Poor" rating. For each of the products a weighted average for the tissue's overall quality and for each of the attributes questioned was calculated. The average scores for overall quality and for several important tissue attributes for the three products are shown in Table 20.

TABLE 20

Monadic Home Use Test Results

| Product # | Overall Rating | Softness Rating | Strength Rating | Thickness Rating | Absorbency Rating |
|---|---|---|---|---|---|
| 1 | 3.78 | 4.16 | 3.95 | 3.67 | 3.98 |
| 2 | 3.61 | 4.25 | 3.65 | 3.52 | 3.87 |
| 3 | 3.75 | 4.18 | 3.81 | 3.69 | 3.91 |

From the table it can be seen that all three products were rated as being approximately equal in softness, with Product 2 having the highest rating of the three. However, Product 1, the tissue containing the temporary wet strength agent, was rated superior to Product 2, the product with no temporary wet strength agent, for overall performance as well as strength, thickness, and absorbency. Product 1 is also rated as equal to or better than Product 3 for overall quality and for its individual attributes despite the fact that Product 3 has a basis weight advantage of more than 1.5 lbs./ream. Thus, the results shown here demonstrate that use of a temporary wet strength agent to impart wet strength to a product can be used to improve the perception of that product, especially in regard to strength related attributes. Alternatively, use of a temporary wet strength agent can allow generation of an equal or superior product at a substantially lower basis weight, resulting in a significant fiber savings.

The foregoing tests and the related other tests set forth in the following examples are described in the Blumkenship and Green textbook "*State of the Art Marketing Research NTC Publishing Group*," Lincolnwood, Ill., 1993.

EXAMPLE 14

A one-ply tissue base sheet was produced on a pilot paper machine, as set forth in Example 12, from a furnish containing 50% Southern Softwood Kraft, 50% Southern Hardwood Kraft at a targeted basis weight of 19 lbs. per 3000 square foot ream. A cationic potato starch was added to the softwood kraft portion of the furnish in the amount of 5.5 lbs. of starch per ton of fiber to control the sheet strength. The base sheet was treated with a sprayed softening compound in the amount of 2.5 lbs. of softener (Quasoft® 218) per ton of fiber. The softener was applied to the Yankee side of the sheet while the sheet was on the felt as shown in FIG. 9 from position 53. A temporary wet strength agent, glyoxal, was applied to the sheet in the amount of 5 lbs. of wet strength agent per ton of fiber. This was applied as shown in FIG. 9 from position 52. The base sheet was made using a crepe percentage of 25% and exhibited a MD stretch value of 27.8%. The base sheet was converted to a 280 count finished product by embossing the base sheet with a spot emboss pattern which contained crenulated elements. This pattern is shown in FIG. 6. The physical properties of the embossed product (designated Product 4) are shown in Table 21. This sheet is printed using flexographic printing after embossing as shown in Example 1 or the sheet is printed prior to embossing using the rotogravure printing process as shown in Example 3. Printed samples of base sheet and embossed product for Product 4 were produced on a Geiger Tool & Mfg. Gravure proofer as described in Example 5. L*C*H° and ΔEcmc measurements were taken as described in example 5 and are shown in Table 18.

TABLE 21

Physical Properties of One-Ply Tissue Product

| Product Number | Basis Weight (lbs/3000 sq. ft. ream) | Caliper (mils/8 sheets) | Specific Caliper (mils/8 sheets/ lbs./ sq. ft. ream) | MD Tensile (g/3") | CD Tensile (g/3") | Specific Total Tensile (g/3"/ lbs/ sq. ft. ream) | Tensile Ratio | MD Stretch (%) | CD Wet Tensile (g/3") | Specific CD Wet Tensile (g/3"/ lbs./3000 square foot ream) | Tensile stiffness (grams/ in/%) | Specific Tensile stiffness (g/in/%/ lbs/3000 sq. ft. Ream) | Friction Deviation | Sidedness |
|---|---|---|---|---|---|---|---|---|---|---|---|---|---|---|
| 4 | 18.28 | 70.7 | 3.86 | 578 | 346 | 53.5 | 1.67 | 18.3 | 96 | 5.25 | 14.1 | 0.77 | 0.200 | 0.227 |

The embossed product was fielded in a Monadic Home Use Test. It was expected that this product would be rated by consumers as being less preferred than the products described in the previous example since Product 4 was made using Southern hardwoods and softwoods which were substantially coarser than the Northern fibers used to make Products 1, 2, and 3. Typical coarseness values for the fibers used in the four products are shown in Table 22.

TABLE 22

Typical Coarseness Values for Fiber Furnish Used in Examples 7 and 8

| Fiber | Coarseness (milligrams/ 100 meters) |
|---|---|
| Northern Softwood Kraft (Products 1, 2, and 3) | 18.9 |
| Northern Hardwood Kraft (Products 1, 2, and 3) | 9.9 |
| Southern Softwood kraft (Product 4) | 30.5 |
| Southern Hardwood Kraft (Product 4) | 14.3 |

It is well known that the use of a coarser fiber furnish generally results in a product having lower softness. However, the results of the Monadic Home Use Test, listed in Table 23, showed that the tissue product made using the Southern furnish was regarded by the panel as essentially equal to those made using the Northern fibers with respect to overall quality and for the other important tissue properties.

TABLE 23

Monadic Home Use Test Results

| Product Number | Overall Rating | Softness Rating | Strength Rating | Thickness Rating | Absorbency Rating |
|---|---|---|---|---|---|
| 4 | 3.77 | 4.11 | 3.85 | 3.71 | 3.84 |

The base sheets that were used to make Products 1 and 4 were also converted using the same emboss pattern as shown in FIG. 6 to finished product rolls having 500 sheets each. These products were also tested in Monadic Home Use Tests. The physical properties of the two products and results from the Monadic Home Use Tests are shown in Tables 24 and 25 respectively. In these tables Product 5 refers to the 500-count tissue product made from the same base sheet as that used to make Product 1, while Product 6 refers to the 500-count product made from the same base sheet that was used for Product 4. Printed samples of base sheets used in converting Products 5 and 6 were produced on a Geiger Tool & Mfg. Gravure proofer as described in Example 5. L*C*H° and ΔEcmc measurements were taken as described in example 5 and are shown in Table 18.

TABLE 24

Physical Properties of 500 Count One-Ply Tissue Products

| Product Number | Basis Weight (lbs./3000 sq. ft. ream) | Caliper (mils/8 sheets) | Specific Caliper (mils/8 sheets/ lbs./3000 sq. ft. ream) | MD Tensile (g/3") | CD Tensile (g/3") | Specific Total Tensile (g/3"/ lbs./ sq. ft. ream) | Tensile Ratio | MD Stretch (%) | CD Wet Tensile (g/3") | Specific CD Wet Tensile (g/3"/ lbs./3000 sq. ft. ream) | Tensile stiffness (g/in/%) | Specific Tensile stiffness (g/in/%/ lbs./3000 sq. ft. ream) | Friction Deviation | Sidedness |
|---|---|---|---|---|---|---|---|---|---|---|---|---|---|---|
| 5 | 18.11 | 67.0 | 3.70 | 740 | 341 | 59.7 | 2.17 | 23.8 | 96 | 5.30 | 12.6 | 0.70 | 0.201 | 0.234 |
| 6 | 18.16 | 63.6 | 3.50 | 598 | 357 | 52.6 | 1.68 | 19.7 | 96 | 5.29 | 15.8 | 0.87 | 0.196 | 0.221 |

TABLE 25

Monadic Home Use Test Results

| Product Number | Overall Rating | Softness Rating | Strength Rating | Thickness Rating | Absorbency Rating |
|---|---|---|---|---|---|
| 5 | 3.89 | 4.16 | 4.06 | 3.87 | 4.12 |
| 6 | 4.03 | 4.43 | 4.18 | 4.18 | 4.24. |

The results of the Monadic Home Use Tests show that for perceived overall quality and performance in several important tissue attributes, including softness, the product made using the coarser Southern furnish is at least equivalent or superior to the product made using the less coarse Northern furnish. This result indicates that equivalently soft products of the current invention can be made using fibers having a wide range of coarseness values.

EXAMPLE 15

As a further test of the technologies used in the current invention to deliver high-performance products, two one-ply tissue products were tested against commercial two-ply products in Paired Home Use Tests. In these tests, a consumer is asked to use both products sequentially and then to state a preference between the two products for overall performance and for each of several individual attributes. The first of these one-ply tissue products was produced from the same base sheet as was used to make Product 1 in Example 13. This tissue, designated Product 7, was compared with a commercial product that, like Product 7, employed Northern hardwoods and softwoods in its furnish. The other one-ply product, Product 8, was made from the same base sheet as was Product 4 in Example 14. This tissue product was compared to a commercial product whose furnish contained Southern hardwood and softwood fibers, as did Product 8. Both of the one-ply products were embossed using the emboss pattern shown in FIG. 5, while the two commercial products were embossed with the emboss pattern shown in FIG. 5. The physical properties of the four products, all of which had a sheet count of 280, are shown in Table 26.

The results of the paired comparison tests are shown in Tables 27 and 28 for the products made using the Northern and Southern furnishes, respectively. The values recorded in the tables are the number of consumers (out of 100) that preferred the particular product for the specified attribute. The number of consumers who had an equal preference for both products is also recorded. As can be seen from the tables, the one-ply products performed equal to or better than the two-ply commercial products for all attributes tested. These results indicate that the combination of low dry tensile strength, adequate temporary wet strength, high crepe ratio, use of chemical softeners, and embossing using a pattern containing crenulated elements has resulted in a one-ply product equal or superior to a two-ply tissue. When this product is printed prior to embossing as shown in Example 3 or after embossing as shown in Example 1, a printed one-ply tissue is obtained which is equal to or superior to a two-ply printed tissue produced at much lower expenditure of fiber thus saving both cost and trees. Printed samples of base sheets used in converting Products 7 and 8 were produced on a Geiger Tool & Mfg. Gravure proofer as described in Example 5. L*C*H° and ΔEcmc measurements were taken as described in example 5 and are shown in Table 18.

EXAMPLE 16

One-ply base sheets were made from a furnish containing a 2/1 blend of Southern HWK/Southern SWK. The base sheets were treated with 3 lbs./ton of softener which was added to the stock prior to its being formed into a paper web. For one of the base sheets, the softener used was a dialkyl dimethyl quaternary amine, for the other a cyclic imidazoline quaternary amine. Both base sheets were sprayed with 2.5 lbs./ton of a linear amine amide softener, which was applied from position 53 as shown in FIG. 9, and 12 lbs./ton of a non-cationically charged wet strength agent, which was sprayed onto the sheet from position 52 as shown in FIG. 9. Refining of the entire furnish was used to control the base sheet strength to the targeted level. Both base sheets were converted to 560-count finished products using the emboss pattern shown in FIG. 6. The sheets were embossed at a depth of 0.065 inches. The physical properties of the converted products are shown in Table 26. These sheets are printed after embossing as shown in Example 1 or before embossing as shown in Example 3.

The two products were tested for sensory softness by a trained softness panel. The product containing the imidazoline-based softener was judged to be softer than the tissue made using the dialkyl dimethyl softener. The difference in softness was statistically significant at the 95% confidence level, showing that use of the imidazoline softener resulted in a superior product. Use of this class of softeners constitutes a preferred embodiment of the present invention.

TABLE 26

Physical Properties of One-Ply Tissue Products

| Softener Used | Basis Weight (lbs./sq. ft. ream) | Caliper (mils/8 sheets) | Specific Caliper (mils/8 sheets/lbs/sq. ft. ream) | MD Tensile (g/3") | CD Tensile (g/3") | Specific Total Tensile (g/3"/lbs./sq. ft. ream) | Tensile Ratio |
|---|---|---|---|---|---|---|---|
| Dialkyl Dimethyl Quaternary | 18.69 | 54.2 | 2.90 | 627 | 322 | 50.8 | 1.95 |
| Imidazoline Quaternary | 18.62 | 58.2 | 3.13 | 590 | 290 | 47.3 | 2.03 |

TABLE 26-continued

Physical Properties of One-Ply Tissue Products

| Product | MD Stretch (%) | CD Wet Tensile (g/3") | Specific CD Wet Tensile (g/3"/lbs./sq. ft. ream) | Tensile stiffness (g/in/%) | Specific Tensile stiffness (g/in/%/lbs./sq. ft. ream) | Friction Deviation | Sidedness |
|---|---|---|---|---|---|---|---|
| Dialkyl Dimethyl Quaternary | 17.4 | 56 | 3.01 | 18.6 | 1.00 | 0.175 | 0.180 |
| Imidazoline Quaternary | 16.2 | 54 | 2.90 | 17.0 | 0.91 | 0.177 | 0.197 |

TABLE 27

Results of Paired Consumer Test - Northern Furnish Product

| Attribute | No. Preferring One-Ply Product | No. Preferring Two-Ply Product | No. Having No Preference |
|---|---|---|---|
| Overall Performance 53 | 32 | 16 | — |
| Softness | 46 | 27 | 27 |
| Strong/Doesn't Fall Apart | 36 | 33 | 31 |
| Absorbency | 39 | 30 | 31 |
| Product Seems More Quilted | 59 | 19 | 22 |
| Layers Separate Less | 38 | 24 | 38 |
| Cleansing Ability | 35 | 30 | 35 |
| More Comfortable to Use | 46 | 26 | 28 |
| Feels Thick/Substantial | 50 | 30 | 19 |
| Tears More Evenly | 32 | 24 | 44 |
| Sheet Has Attractive Appearance | 43 | 18 | 39 |

TABLE 28

Results of Paired Consumer Test - Southern Furnish Product

| Attribute | No. Preferring One-Ply Product | No. Preferring Two-Ply Product | No. Having No Preference |
|---|---|---|---|
| Overall Performance 53 | 36 | 11 | — |
| Softness | 45 | 38 | 17 |
| Strong/Doesn't Fall Apart | 40 | 27 | 33 |
| Absorbency | 34 | 26 | 40 |
| Product Seems More Quilted | 48 | 36 | 16 |
| Layers Separate Less | 37 | 21 | 42 |
| Cleansing Ability | 32 | 21 | 47 |
| More Comfortable to Use | 41 | 37 | 22 |
| Feels Thick/Substantial | 43 | 38 | 19 |
| Tears More Evenly | 41 | 18 | 41 |
| Sheet Has Attractive Appearance | 42 | 19 | 39 |

EXAMPLE 17

An aqueous dispersion of softener was made by mixing appropriate amount with deionized water at room temperature. Mixing was accomplished by using a magnetic stirrer operated at moderate speeds for a period of one minute. The composition of softener dispersion is shown in Table 29 below.

TABLE 29

| Composition | Weight (%) |
|---|---|
| Imidazoline | 67.00 |
| TMPD (2,2,4 trimethyl 1,3 pentane diol) | 9.24 |
| TMPD-IEO (ethoxylated TMPD) | 14.19 |
| TMPD-2E0 (ethoxylated TMPD) | 6.60 |
| TMPD-3E0 (ethoxylated TMPD) | 1.32 |
| TMPD-4E0 (ethoxylated TMPD) | 0.66 |
| Other | 0.99 |

Depending on the concentration of softener in water, the viscosity can range from 20 to 800 cp. at room temperature. A unique feature of this dispersion is its stability under high ultracentrifugation. An ultracentrifuge is a very high speed centrifuge in which the centrifugal force of rotation is substituted for the force of gravity. By whirling colloidal dispersions in cells placed in specially designed rotors, accelerations as high as one million times that of gravity can be achieved. When this dispersion was subjected to ultracentrifugation for 8 minutes at 7000 rpm, no separation of the dispersion occurred. The distribution of the particle size of softener in the dispersion as measured by the Nicomp Submicron particle size analyzer is presented in Table 30.

TABLE 30

| Weight % | Particle Size (nanometers) |
|---|---|
| 12 | 162 |
| 88 | 685 |

EXAMPLE 18

Tissue treated with softener made in Example 17 was produced on a pilot paper machine. The pilot paper machine is a crescent former operated in the waterformed mode. The furnish was either a 2/1 blend of Northern HWK and Southern SWK or a 2/1 blend of Northern HWK and Northern SWK. A predetermined amount (10 lbs./ton) of a cationic wet strength additive (CoBond 1600), supplied by National Starch and Chemical Co., was added to the furnish.

An aqueous dispersion of the softener was added to the furnish containing the cationic wet strength additive at the fan pump as it was being transported through a single conduit to the headbox. The stock comprising of the furnish, the cationic wet strength additive, and the softener was delivered to the forming fabric to form a nascent/embryonic web. The sheet was additionally sprayed with Quasoft 202JR softener while on the felt. Dewatering of the nascent web occurred via conventional wet pressing process and drying on a Yankee dryer. Adhesion and release of the web from the Yankee dryer was aided by the addition of adhesive (Betz 97/5 Betz 75 at 2.5 lbs./ton) and release agents (Houghton 8302 at 0.07 lbs./ton), respectively. Yankee dryer temperature was approximately 190° C. The web was creped from the Yankee dryer with a square blade at an angle of 75 degrees. The basesheets were converted to 560 count products by embossing them with a spot embossing pattern containing crenulated elements at emboss penetration depth of 0.070". The softened tissue paper product has a basis weight of 18–19 lbs./ream, MD stretch of 18–29%, approximately 0.05 to 0.8% of softener by weight of dry paper, a CD dry tensile greater than 180 grams/3 inches and a CD wet tensile greater than 50 grams/3". This tissue paper is printed after Embossing as sown in Example 1 or before embossing as shown in Example 3.

EXAMPLE 19

Tissue papers containing different levels of softener were made according to the method set forth in Example 18. The properties of the softened tissue papers are shown Table 31.

TABLE 31

| Softener Level (lbs./ton) | Furnish | Basis Weight (lbs./rm.) | Total Tensile (g/3") | GM Modulus (g % Strain) | Surface Sensory Friction Softness* (GM MMD) | |
|---|---|---|---|---|---|---|
| 1 | 2/1 NHWK/ SSWK | 18.4 | 968 | 12.9 | .169 | 17.03 |
| 3 | 2/1 NHWK/ NSWK | 18.6 | 1034 | 14.1 | .189 | 17.88 |
| 3 | 2/1 NHWK/ NSWK | 19.67 | 1000 | 12.6 | .185 | 19.12 |

*A difference of 0.4 sensory softness units is significant at 95% level of significance.

EXAMPLE 20

Tissue paper was made on a commercial paper machine, a suction breast roll former operated in the waterformed mode. The furnish was comprised of 60% Southern HWK and 30% secondary fiber and 10% Northern SWK. A predetermined amount (10#/ton) of a cationic wet strength additive (CoBond 1600), supplied by National Starch and Chemical Co., was added to the furnish.

An aqueous dispersion of the softener was added to the furnish containing the cationic wet strength additive, at the fan pump, as it was being transported through a single conduit to the headbox. The stock comprising of the furnish, the cationic wet strength additive and the softener was delivered to the forming fabric to form a nascent/embryonic web. The sheet was additionally sprayed with Quasoft 202JR softener while on the felt. Dewatering of the nascent web occurred via conventional wet pressing process and drying on a Yankee dryer. Adhesion and release of the web from the Yankee dryer was aided by the addition of the adhesive and release agents at 2 and at 0.07 lbs./ton), respectively. Yankee dryer temperature was approximately 190° C. The web was creped from the Yankee dryer with a square blade at an angle of 78 degrees. The basesheets were converted to 560 count products by embossing them with a spot embossing pattern containing crenulated elements. The softened tissue paper product has a basis weight of 18–19 lbs./ream, MD stretch of 19–29%, approximately 0.05 to 0.8% of softener by weight of dry paper, a CD dry tensile greater than 180 grams/3 inches and a CD wet tensile greater than 50 grams/3". The softened tissue has a sensory softness greater than 16.4. The sheet is printed after embossing as shown in Example 1 or before embossing as shown in Example 3.

EXAMPLE 21

In order to understand the mechanism of retention and softening attributed to V475/TMPD-1EO when applied to tissue products of this invention, data was obtained on the particle size distributions of water dispersions of V475/TMPD-1EO and V475/PG. The 475/TM PD-1EO formulation contained 75% V475 and 25% TM PD-1EO. The V475/PG formulation contained 90% V475 and 10% propylene glycol. The dispersions were prepared using either boiling water (100° C.) or room temperature water (22°) and mixed for 2 minutes using either high or low shear conditions. In all cases, the dispersions were 5% by weight in V475. Low shear was defined as mixing with a magnetic stirrer using a 1 inch stir bar for 2 minutes at approximately 1000 rpm. High shear was defined as mixing with a Waring blender using a 4-blade propeller for 2 minutes at approximately 10,000 rpm, Speed of rotation was measured with a stroboscope.

The Nicomp, Model 270 submicron particle size analyzer was used to measure the particle size distribution for each dispersion. The data show that V475/PG could not be dispersed in room temperature water with a magnetic stirrer. The V475/PG could be dispersed in room temperature water when mixed under high shear conditions.

Our data demonstrate that extremely small particle size, less than 20 nm, usually about 15 nm were obtained with V475/TMPD-1EO formulation when mixed with boiling water under high shear conditions. Under the same conditions of temperature and shear, the smallest particle sized obtained with the V475/PG formulation were in the 200 nm range. The presence of TMPD aids in producing dispersions that have a higher population of smaller particles. Particle size may play a roll in differentiating the performance of the PG and TMPD versions of V475. Some of these particles are small enough to enter the wails of the fiber. It is believed that the softener which penetrates the fiber wall has improved product performance compared to softener which remain completely on the surface of the fiber. The results are set forth in Table 32.

TABLE 32

| | Low Shear, 22° C. | | Low Shear, 100° C. | | High Shear, 22° C. | | High Shear, 100° C. | |
|---|---|---|---|---|---|---|---|---|
| Sample | Size (nm) | Vol. % | Size (nm) | Vol. % | Size (nm) | Vol. % | Size (nm) | Vol. % |
| TMPD | 695 | 94 | 1005 | 92 | 160 | 74 | 238 | 1 |
| | 135 | 6 | 218 | 8 | 51 | 26 | 57 | 22 |
| | | | | | | | 15 | 77 |
| PG | Could Not Disperse | | 960 | 94 | 224 | 100 | 193 | 100 |
| | | | 188 | 6 | | | | |

EXAMPLE 22

One-ply tissue base sheets made from a variety of furnish blends were embossed using both macro embossing and micro embossing. The macro emboss pattern is shown in FIG. 6 while the micro emboss is shown in FIGS. 14A–1, 14A–2, 14A–3 and 14B. The base sheets were embossed to produce finished products having similar strength levels. The specific furnish blends and embossed product tissue strengths are shown in Table 33. The total tensile is defined as the sum of the machine direction and cross direction tensile strengths, while the specific total tensile is the ratio of the total tensile and the basis weight.

TABLE 33

One-Ply Tissue Products

| Product # | Furnish Blend | Emboss Technology | Basis Weight (lb/ream) | Total Tensile (gm/3") | Specific Total Tensile (gm/3"/lb/rm) |
|---|---|---|---|---|---|
| 1 | 2/1 Northern Hardwood/ Northern Softwood | Macro Emboss | 19.4 | 911 | 47.0 |
| 2 | 2/1 Northern Hardwood/ Northern Softwood | Micro Emboss | 18.6 | 843 | 45.3 |
| 3 | 2/1 Northern Hardwood/ Southern Softwood | Macro Emboss | 18.8 | 844 | 44.9 |
| 4 | 2/1 Northern Hardwood/ Southern Softwood | Micro Emboss | 18.5 | 891 | 48.2 |
| 5 | 1/1 Southern Hardwood/ Southern Softwood | Macro Emboss | 18.1 | 1054 | 58.2 |
| 6 | 1/1 Southern Hardwood/ Southern Softwood | Micro Emboss | 17.5 | 1097 | 62.7 |

Figure 17:
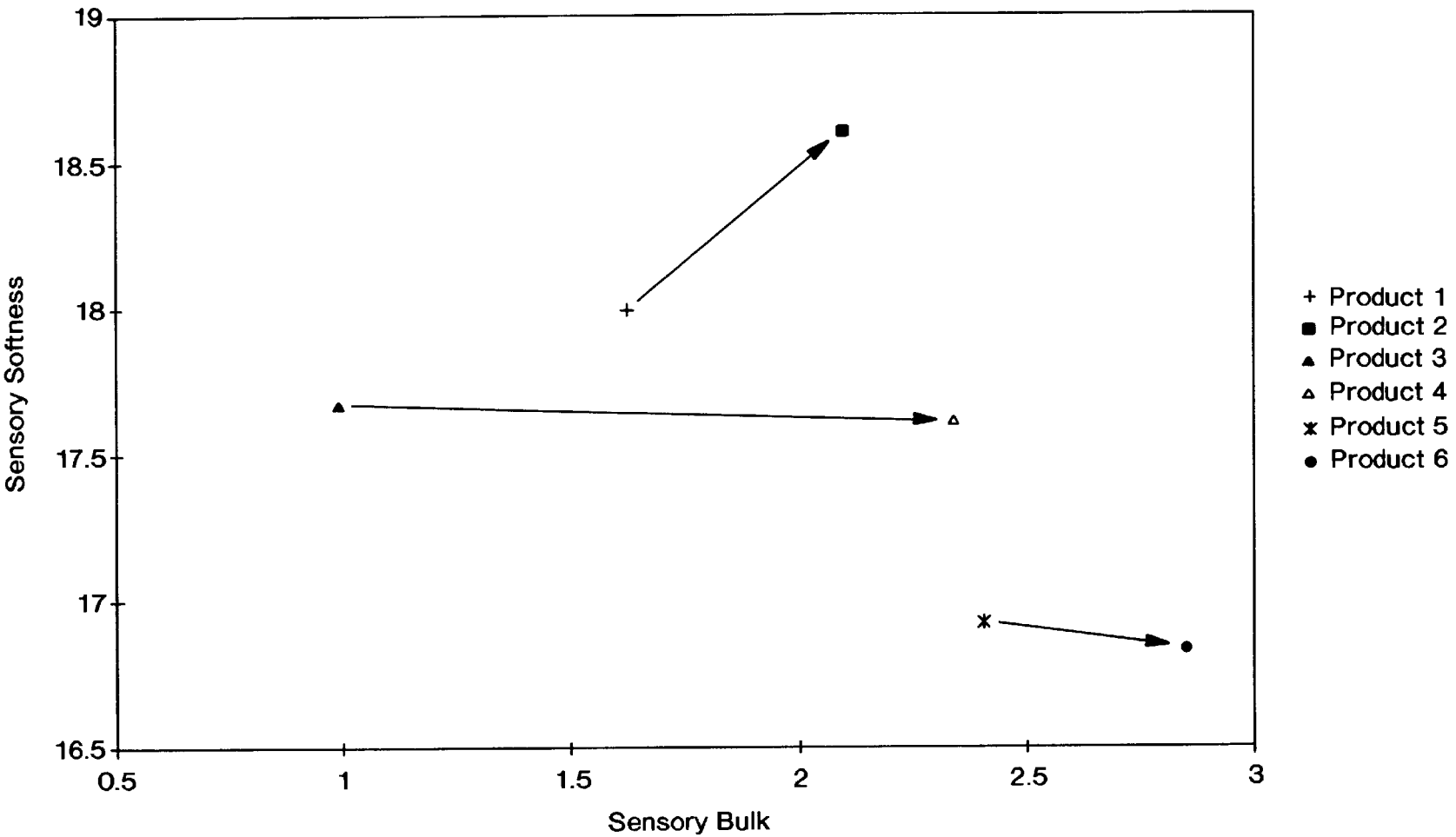
FIG. 17 is a graphical representation of sensory softness versus sensory bulk.

The products shown in Table 33 were tested for sensory softness and sensory bulk by a trained sensory panel. The results of these tests are shown in FIG. 17. The arrows in the figure are used to connect products made from the same base sheet. As can be seen from the figure, the sensory softness of the two products made from a given base sheet are roughly equal, while, for each pair, the tissue product using micro embossing has greater sensory bulk than does the product of the prior art. The differences for each pair are statistically significant at the 95% confidence level. Both macro emboss and micro emboss tissue are printed on one or both sides either before or after embossing.

EXAMPLE 23

A one-ply tissue base sheet was made on a crescent former paper machine from a furnish containing 10% Northern Softwood Kraft, 40% Southern Hardwood Kraft, and 50% Secondary Fiber. Twelve pounds per ton of a modified cationic starch (CoBond® 1600) was applied to the furnish to provide temporary wet strength. The furnish was also treated with 3.5 pounds per ton of an imidazoline-based softener (Arosurf® PA 806) to control tensile strength and impart softness. Two and one-half pounds per ton of a spray softener (Quasoft® 209JR) was applied to the sheet while it was on a pressing felt. The sheet was creped from the Yankee dryer at a moisture content of four percent. The crepe angle was 73.5 degrees and the percent reel crepe was 25%. The sheet was calendered such that the caliper of the uncalendered tissue base sheet was reduced by approximately 20–25%. The physical properties of the tissue base sheet are shown in Table 34.

TABLE 34

One-Ply Base Sheet Physical Properties

| Basis Weight (lbs/ream) | Caliper (mils/ 8 sheet) | Machine Direction Tensile (grams/3 in) | Cross Direction Tensile (grams/3 in) | Machine Direction Stretch (%) | Cross Direction Stretch (%) | Cross Direction Wet Tensile (grams/3 in) | Tensile Modulus (grams/in/ % strain) | Friction Deviation |
|---|---|---|---|---|---|---|---|---|
| 19.4 | 45.34 | 840 | 640 | 29.9 | 5.3 | 89 | 22.4 | 0.170 |

The base sheet was converted to a single-ply tissue product by embossing the base sheet using standard embossing. The sheet was embossed between a hard roll that had been engraved with the emboss pattern shown in FIG. 6 and a soft roll (Shore A hardness=40). The emboss depth was 0.100". The product was wound to produce finished tissue rolls having 280—4.5"×4.5"—tissue sheets per roll. The finished single-ply product was tested for physical properties and for sensory softness by a trained panel. The results of these tests are shown in Table 35.

TABLE 35

Physical Properties and Sensory Softness of Embossed One-Ply Tissue Product-Prior Art

| Basis Weight (lb/ream) | Caliper (mils/8 sht) | Machine Direction Tensile gr/3") | Cross Direction Tensile (gr/3") | Machine Direction Stretch % | Cross Direction Stretch % | Cross Direction Wet Tensile (gr/3") | Tensile Modulus (gr/3") | Friction Deviation | Machine Direction TEA (g/mm) | Cross Direction TEA (g/mm) | Sensory Softness | Specific Caliper (mils/8 sht/lb/ream) | Specific Total Tensile (gr/3"/lb/ream) | Specific CD Wet Tensile (gr/3"/lb/ream) | Specific Tensile Modulus (gr/in/%/strain/lb/ream) |
|---|---|---|---|---|---|---|---|---|---|---|---|---|---|---|---|
| 18.7 | 69.2 | 634 | 369 | 22.5 | 5.5 | 69 | 13.9 | 0.184 | 0.942 | 0.134 | 16.07 | 3.70 | 53.6 | 3.69 | 0.74 |

The sensory softness value of the embossed product is well below that of a premium quality tissue product. This result is believed to be based in part on the high level of Southern Hardwood and Secondary Fiber contained in the tissue's furnish, both of which are known to be disadvantageous in producing soft one-ply tissue products.

The base sheet was also embossed using the mated micro emboss technology. The sheet was embossed between two engraved hard rolls. The pattern used is shown in FIGS. 15A–1, 15A–2, 15A–3, 15B–1, 15–2, 15B–3, 15C, and in FIG. 5. The emboss gap between the emboss sleeves was 0.014 inches. After embossing, the sheet was calendered between the emboss unit's feed rolls which were set to a gap of 0.006 inches. This step was necessary to control the product's roll diameter to the desired level. The finished tissue product had 280 sheets, each measuring 4.5"×4.5". The finished products were tested for physical properties and for softness by a trained sensory panel. The results of these tests are shown in Table 36.

TABLE 36

Physical Properties and Sensory Softness of Embossed One-Ply Tissue Product-Current Invention

| Basis Weight (lb/ream) | Caliper (mils/8 sht) | Machine Direction Tensile gr/3") | Cross Direction Tensile (gr/3") | Machine Direction Stretch % | Cross Direction Stretch % | Cross Direction Wet Tensile (gr/3") | Tensile Modulus (gr/3") | Friction Deviation |
|---|---|---|---|---|---|---|---|---|
| 18.6 | 67.1 | 625 | 356 | 20.6 | 6.9 | 64 | 13.2 | 0.200 |

| Machine Direction TEA (g/mm) | Cross Direction TEA (g/mm) | Sensory Softness | Specific Caliper (mils/8 sht/lb/ream) | Specific Total Tensile (gr/3"/lb/ream) | Specific CD Wet Tensile (gr/3"/lb/ream) | Specific Tensile Modulus (gr/in/%/strain/lb/ream) |
|---|---|---|---|---|---|---|
| 0.712 | 0.154 | 17.30 | 3.61 | 52.7 | 3.44 | 0.71 |

As can be seen by comparing the values in Tables 35 and 36, the physical properties of the two products are quite similar. However, the sensory softness of the product made using micro embossing is much higher than that when using macro embossing and is in the range of premium tissue products, demonstrating that the use of micro embossing provides a way to produce conventional wet-press one-ply tissue products having premium softness levels from fiber blends that are known to be inimical to producing soft tissue products using any tissue making process. These products are suitable for printing on one or both sides either before or after embossing.

EXAMPLE 24

As has been shown in the previous example, it is difficult, using macro embossing, to produce a soft, CWP one-ply product from a furnish containing high percentages of coarse Southern fiber and/or recycled fiber. Because of this difficulty, most premium tissue products made from these furnish types have been produced in a two-ply format. In order to compare the one-ply product of using micro embossing with two-ply technology, a two-ply tissue product of similar basis weight to that of the one-ply tissue products was produced using the same furnish blend. For the two-ply product, no temporary wet strength agent or softening compounds were added to the furnish, as these chemicals are not typically included in two-ply tissue products. The tissue base sheet was creped from the Yankee dryer at a moisture content of 4%, a percent crepe of 20% and creping angle of 73.5 degrees. The base sheets were calendered to a targeted caliper of 29 mils/8 sheets.

Two base sheets were plied together and embossed to produce a two-ply tissue product using the emboss pattern shown in FIG. 16. The tissues were plied such that the air sides of the two base sheets faced each other on the inside of the product. This plying strategy insures that the softer Yankee sides of the two-ply product are the only sides that are contacted by the user. The plied base sheets were embossed using macro embossing technology in which the sheets were embossed between an engraved hard roll and a soft (Shore A hardness=40) roll. The emboss depth was 0.080 inches. The product was wound to produce finished tissue rolls having 280—4.5"×4.5"—two-ply tissue sheets per roll. The finished product was tested for physical properties and for sensory softness by a trained panel. The results of these tests are shown in Table 37. The wet tensile strength was not measured for this product because it contained no temporary wet strength agent and its wet tensile would be expected to be so low as to be of no practical significance (less than 40 grams/3 inches in the cross direction).

TABLE 37

Physical Properties and Sensory Softness of Embossed One-Ply Tissue Product

| Basis Weight (lb/ream) | Caliper (mils/8 sht) | Machine Direction Tensile gr/3") | Cross Direction Tensile (gr/3") | Machine Direction Stretch % | Cross Direction Stretch % | Cross Direction Wet Tensile (gr/3") | Tensile Modulus (gr/in/% strain) | Friction Deviation |
|---|---|---|---|---|---|---|---|---|
| 18.2 | 69.1 | 1024 | 411 | 16.3 | 6.7 | — | 17.4 | 0.162 |

| Machine Direction TEA (g/mm) | Cross Direction TEA (g/mm) | Sensory Softness | Specific Caliper (mils/8 sht/lb/ream) | Specific Total Tensile (gr/3"/lb/ream) | Specific CD Wet Tensile (gr/3"/lb/ream) | Specific Tensile Modulus (gr/in/%/strain/lb/ream) |
|---|---|---|---|---|---|---|
| 1.060 | 0.176 | 17.44 | 3.79 | 78.8 | — | 0.96 |

As can be seen by comparing this data with that from Tables 35 and 36, the sensory softness of the two-ply product is only slightly above that of the one-ply product made using the micro embossing, while both of these products have softness values well above that of the prior art one-ply tissue product. The difference in sensory softness between the two-ply and the micro embossed one-ply product is not statistically significant (95% confidence limit), while the difference between the softness values of the macro embossed bathroom tissue and that of the one-ply tissue made using macro embossing are statistically significant at the same confidence limit. One or both sides of the micro embossed bathroom tissue are printed either before or after embossing.

EXAMPLE 25

The product having undergone micro embossing exhibits higher embossed CD stretch as compared to products embossed using macro embossing. This higher CD stretch results in a more flexible product and one having a lower tensile stiffness in the cross machine direction. This lower CD stiffness is of particular importance for one-ply CWP products as the CD tensile stiffness is typically much higher than that of the machine direction and controls the overall product stiffness level.

Eight one-ply tissue base sheets having a variety of furnish blends were made on a crescent former paper machine. These base sheets were each embossed using macro embossing technology and the micro embossing technology as described in Example 23. The physical properties of the base sheets and finished products were measured. FIG. 17 shows the CD stretch of the embossed tissues as a function of their base sheet CD stretches. The figure shows that the micro emboss technology provides an increased CD stretch as compared with that of the prior art irrespective of whether it is printed on one side, both sides, prior to embossing or after embossing.

Figure 20:
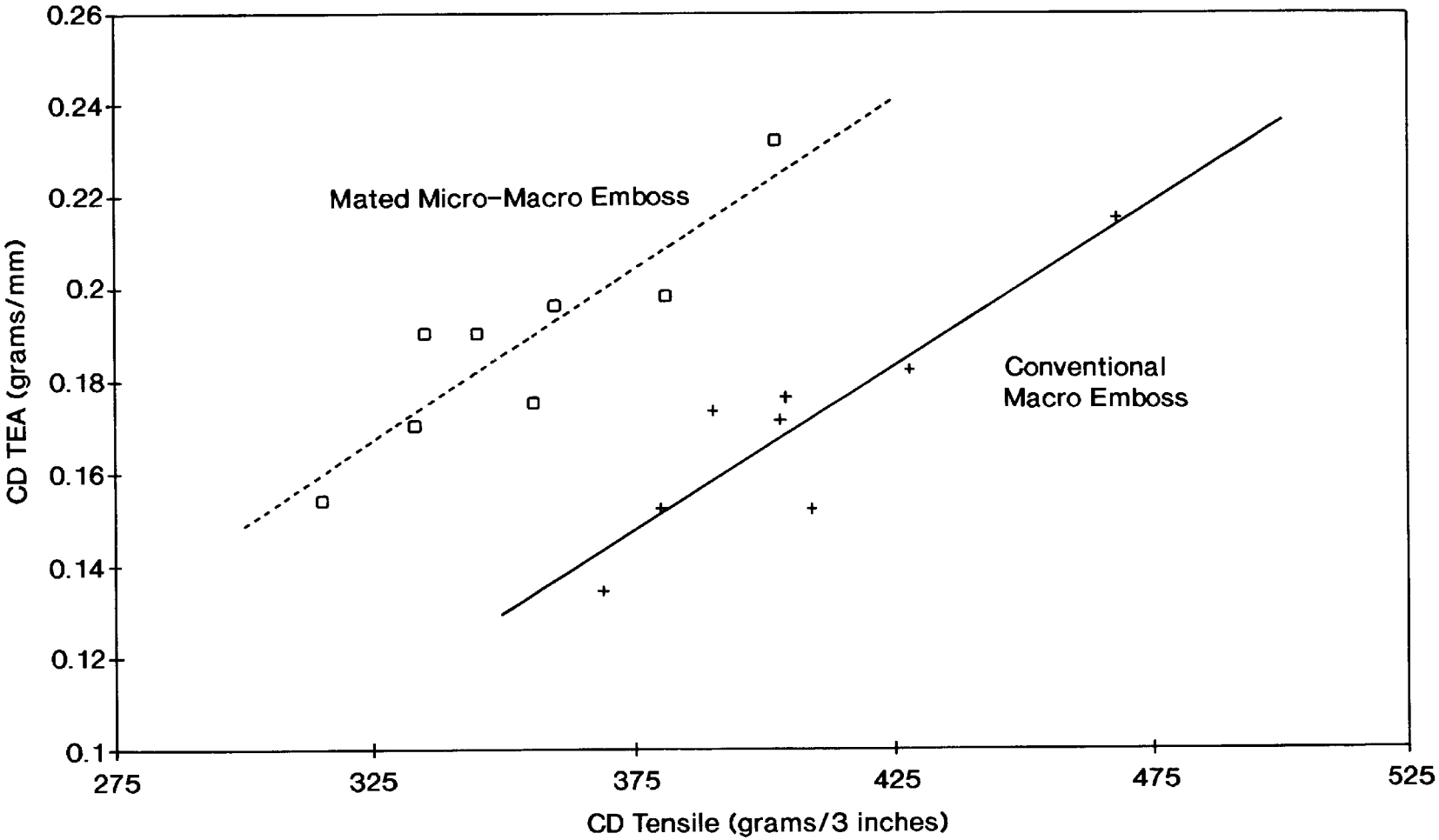
FIG. 20 is a graphical representation of the % CD tensile energy absorption and the CD tensile strength of the finished product.

FIG. 20 compares the CD TEA of the same eight pairs of products as a function of the tissues' CD tensile. It can be seen that, at similar values of CD tensile strength, the products using micro embossing have a higher CD tensile energy absorption than do those that employed macro embossing. This improved CD TEA should correlate to an improvement in perceived strength in use of the printed tissue.

EXAMPLE 26

A one-ply CWP tissue base sheet was produced on a commercial tissue machine from a furnish containing 10% Northern Softwood Kraft, 40% Southern Hardwood Kraft, and 50% Secondary Fiber. The furnish was treated with 10 pounds per ton of a temporary wet strength starch (Co-Bond 1600) to impart wet strength and 4 pounds per ton of an imidazoline-based debonder (Arosurf PA 806) to control the base sheet tensile. Two pounds per ton of a softener (Quasoft 218 JR) was sprayed onto the sheet while it was on the felt. The sheet was creped from the Yankee dryer at a moisture content of four percent using 24 percent reel crepe. The base sheet was also embossed using the mated micro emboss technology. The sheet was embossed between two engraved hard rolls and employed the pattern shown in FIGS. 15A–1, 15A–2, 15A–3, 15B–1, 15B–2, 15B–3, 15C, and FIG. 5. The emboss gap between the emboss rolls was 0.013 inches. The product was wound to produce rolls that contained 280 sheets each measuring 4.5×4.5 inches. The physical properties and sensory softness of this embossed product are shown in Table 38. In addition, the same base sheet was embossed using the mated emboss process to produce a product having a sheet count of 560, with each sheet measuring 4.5×4.5 inches. For this product, the gap between the emboss rolls was 0.014 inches and the emboss unit's feed rolls were set at a gap of 0.004 inches. The physical properties and sensory softness of this product are also shown in Table 38.

TABLE 38

Physical Properties and Sensory Softness of Embossed One-Ply Tissue Products

| Basis Weight (lb/ream) | Caliper (mils/8 sht) | Machine Direction Tensile gr/3") | Cross Direction Tensile (gr/3") | Machine Direction Stretch % | Cross Direction Stretch % | Cross Direction Wet Tensile (gr/3") | Tensile Modulus (gr/in/% strain) | Friction Deviation |
|---|---|---|---|---|---|---|---|---|
| | | | | 280 Sheets | | | | |
| 18.3 | 67.2 | 569 | 320 | 21.8 | 5.1 | 78 | 13.6 | 0.214 |
| | | | | 560 Sheets | | | | |
| 18.2 | 53.7 | 670 | 335 | 22.7 | 5.3 | 83 | 15.9 | 0.223 |

TABLE 38-continued

Physical Properties and Sensory Softness of Embossed One-Ply Tissue Products

| Machine Direction TEA (g/mm) | Cross Direction TEA (g/mm) | Sensory Softness | Specific Caliper (mils/8 sht/lb/ream) | Specific Total Tensile (gr/3"/lb/ream) | Specific CD Wet Tensile (gr/3"/lb/ream) | Specific Tensile Modulus (gr/in/%/strain/lb/ream) |
|---|---|---|---|---|---|---|
| | | | 280 Sheets | | | |
| 0.776 | 0.113 | 17.02 | 3.67 | 48.6 | 4.26 | 0.74 |
| | | | 560 Sheets | | | |
| 0.917 | 0.122 | 16.99 | 2.95 | 55.2 | 4.56 | 0.87 |

The one-ply tissue product described above was tested in a Monadic Home Use Test to determine the reaction of consumers to the product. Also tested were commercial (store-shelf) two-ply CWP products that were produced at the same mil as was the one-ply product. The two-ply products were embossed using macro emboss technology and were made to both 280 and 560 sheet counts. The physical properties and sensory softness of the commercial two-ply products are shown in Table 39.

TABLE 40

Monadic Use Test Results for One- and Two-Ply Products

| Product | Overall Rating | Softness | Strength | Thickness | Absorbency |
|---|---|---|---|---|---|
| 1 ply, 280 count | 3.64 | 3.90 | 3.82 | 3.55 | 3.84 |

TABLE 39

Physical Properties and Sensory Softness of Embossed Two-Ply Tissue Products

| Basis Weight (lb/ream) | Caliper (mils/8 sht) | Machine Direction Tensile gr/3") | Cross Direction Tensile (gr/3") | Machine Direction Stretch % | Cross Direction Stretch % | Cross Direction Wet Tensile (gr/3") | Tensile Modulus (gr/in/% strain) | Friction Deviation |
|---|---|---|---|---|---|---|---|---|
| | | | | 280 Sheets | | | | |
| 18.6 | 66.7 | 1056 | 375 | 13.8 | 5.7 | 22 | 23.3 | 1.192 |
| | | | | 560 Sheets | | | | |
| 18.6 | 55.5 | 1029 | 403 | 12.6 | 5.2 | 22 | 31.0 | 0.183 |

| Machine Direction TEA (g/mm) | Cross Direction TEA (g/mm) | Sensory Softness | Specific Caliper (mils/8 sht/lb/ream) | Specific Total Tensile (gr/3"/lb/ream) | Specific CD Wet Tensile (gr/3"/lb/ream) | Specific Tensile Modulus (gr/in/%/strain/lb/ream) |
|---|---|---|---|---|---|---|
| | | | 280 Sheets | | | |
| 1.036 | 0.155 | 16.87 | 3.59 | 76.9 | 1.18 | 1.25 |
| | | | 560 Sheets | | | |
| 0.938 | 0.144 | 17.77 | 2.98 | 77.0 | 1.18 | 1.67 |

In a Monadic Home Use Test, participants are asked to rate a single product as to its overall quality and for several key tissue attributes. The product can be rated as "Excellent," "Very Good," "Good," "Fair," or "Poor" for overall performance and for each attribute. To compare products that have been consumer tested in this way, a numerical value is assigned to each response. The values range from a 5 for an "Excellent" rating to a 1 for a "Poor" rating. This assignment allows an average rating (between 1 and 5) to be calculated for the product in each attribute area and for overall performance. Table 40 shows the results of the Monadic Home Use tests for overall performance and for several important tissue attributes for the one-and two-ply products described above. These results show that for both 280 and 560-count tissues, the one-ply printed products produced in accordance with the current invention are equivalent in overall quality and for important tissue attributes to the commercially-marketed two-ply tissues.

TABLE 40-continued

Monadic Use Test Results for One- and Two-Ply Products

| Product | Overall Rating | Softness | Strength | Thickness | Absorbency |
|---|---|---|---|---|---|
| 2 ply, 280 count | 3.47 | 3.79 | 3.81 | 3.37 | 3.84 |
| 1 ply, 560 count | 3.69 | 3.84 | 3.99 | 3.60 | 3.93 |
| 2 ply, 560 count | 3.78 | 3.77 | 3.74 | 3.60 | 3.75 |

Printing Methods

The one-ply absorbent paper products in the form of a bathroom tissue, facial tissue, and napkin were printed utilizing a gravure or flexographic process. In the gravure process the printing image is engraved into a cylinder in the form of cells which become filled with ink. Printing is achieved by passing the absorbent paper product between the gravure cylinder at FIG. 10B (61) and an impression roller (64) under pressure.

The printing unit of a gravure press often consists of an ink fountain pan (62A) in which the etched cylinder rotates in a fluid ink. A metal or plastic doctor blade (62B), which reciprocates from side to side, scrapes excess ink from the cylinder surface. The substrate is fed from reels into a nip between the etched cylinder and a rubber covered impression roller which supplies the pressure needed to transfer ink from the cells to the paper substrate. The printed web may run through a heated drying system where the solvents are evaporated and extracted, and the ink is thus dried. In gravure printing each color should be nominally dry before the succeeding color is printed over it, therefore each printing unit may have its own integral drying equipment. The ink which is supplied to each unit, is pumped up to the ink fountain pan and continuously circulated, and usually viscosity control is incorporated in this system. Because each printing unit may have an integral drying system and impression roller, most presses consist of units arranged in line, as shown in FIG. 13C, where the web travels between units in a horizontal plane. As the impression cylinder is not gear driven, but obtains its drive through contact with the gravure cylinder, cylinders of different size can be used to provide variable print repeat dimensions within certain limits.

The function of the doctor blade is to remove surplus ink from the surface of the cylinder leaving the ink in the cells. There are many possible configurations for the doctor blade and they have an effect on the printed result. The thickness of the blade is generally 0.006 to 0.040 inches. Doctor blades in reciprocating designs are usually supported by a backing blade to give extra support. A reverse angle manifold system can be utilized (FIG. 10A) where the doctor blade does not normally require oscillation.

Doctor blades are normally made to reciprocate by up to 6 cm. This gives a better wipe and disperses paper fibers which may get trapped under the blade. Blade mountings must have adjustments to cope with different sizes of cylinder and also movement for making the blade exactly parallel with the cylinder axis.

The impression roll has a steel core with a rubber covering. It is a relatively hard rubber up to 90 shore A durometer and the pressure applied between it and the printing cylinder is high in relation to other processes.

Gravure printing frequently suffers from dot skip resulting in a speckle appearance, caused by individual cells not printing on "rough" paper surface. In this context it is the smoothness of the substrate under pressure which matters and consequently an uncoated, but compressible paper such as the one-ply absorbent paper utilized herein prints very well.

Gravure configurations, are set forth in FIGS. 10A and 10B. Most gravure printing is done on web-fed presses, which provide facilities for supporting and controlling the supply reel during unwinding. A variety of equipment can be used for both manual and automatic splicing. Tension control systems are used to provide stability of web movement to the first printing unit and through multiple units including the last print unit. Most often, multi-color gravure presses are of an in-line design as shown in FIG. 13C.

Flexography is a rotary print process in which the printing images are raised above non-printing areas like that in the letterpress process. A liquid ink with a low viscosity is normally used which is mostly solvent-based or water based, and dries mainly by solvent evaporation. FIGS. 11A and 11B illustrate preferred flexographic processes utilized in the printing of the one-ply absorbent paper product of this invention. The flexographic process is suitable for printing on one-ply bathroom tissue, one-ply facial tissue, and one-ply napkins.

A low printing pressure is used in the process because of the relatively soft printing plates that are suitably used.

In the flexographic process, the application of ink to the surface of the printing plate is conducted by means of a engraved (anilox) roller. The result is a simple ink feed system that consists of not more than two rollers (FIG. 11B) for a conventional design.

Although most flexographic printing is reel to reel, the machines enable relative changes in the print repeat length to be made simply based on the press gearing.

The printing unit consists of three basic parts as shown in FIGS. 11A, 11B, and 11C:

(1) the inking unit (67);

(2) the plate cylinder (66); and (3) the impression cylinder (65).

The function of the inking system is to meter out a fine and controlled film of liquid ink, and apply this to the surface of the printing plate (66). The inking system consists basically of an ink fountain pan (72), a rubber covered fountain roller (71), and an engraved (Anilox) (68) inking roller into which cells of uniform size and depth are engraved. The fountain roller lifts ink to the nip position, where it is squeezed into the cells in the screened inking roller and by a shearing action is removed from the roller surface. The ink in the cells is then transferred to the surface of the printing plates. To regulate ink film thickness in printing, engraved ink rollers are suitably utilized which have volumes of from 1.0 to 10.0 billion microns per square inch (bcm/in$^2$) or greater. These may be engraved or etched metal or ceramic. The engraved cells are generally square in shape with sloping side walls. The number of cells and their configuration regulate the volume of ink transferred. Further regulation of the ink is achieved by varying the surface speed of the fountain roller (71), altering the pressure between the fountain roller (71) and engraved roller, and also altering the hardness of the rubber covering on the fountain roller. A reverse angle manifold system can be utilized (FIG. 11A) which replaces the fountain pan and rubber roller in a conventional system.

The plate cylinder is usually made from steel. The printing plates, which can vary in thickness between 0.042–0.250 inches or greater, are most often secured to the cylinder with two-sided, self-adhesive material.

The impression cylinder is most often made from steel. The substrate passes between the plate and impression cylinders, which generate printing pressure. The ink is transferred from the cells in the screened ink roller to the plate surface, and then to the substrate, during which it reaches virtually a uniform film.

In our process, a central impression (FIG. 13A) configuration of flexographic press was utilized. Also the stack and in-line press can be used (see FIGS. 13B and 13C). The stack press (FIG. 13B) consists usually of two or more integral printing units arranged in vertical formation. This machine enables reverse side printing on the web.

The common impression machine (FIG. 13A) consists of a large cylinder around which are arranged either four or more printing units. The cylinder is very accurately made from steel. Usually the web enters the top or bottom unit on one side of the cylinder, travels to each unit with the cylinder, and emerges from the top or bottom unit on the opposite side of the cylinder. Most multi-color work that requires precise register is suitably printed on common impression machines.

The in-line machine (FIG. 13C) which is a less common configuration for wide web applications, consists of printing units arranged in horizontal formation, with the impression cylinder situated below the web, thus providing easy access to the plate cylinder. The web passes through each printing unit in a horizontal path.

Many products printed by flexography are required in reel form for subsequent processing, and so machines provide suitably versatile winding equipment.

The machine also provides facilities for supporting and controlling the supply reel during unwinding. A variety of equipment is available for both manual and automatic splicing and also tension control.

An ink drying system can be provided as part of the press design. There are several kinds of image carrier in flexography, each of which is suitable for use in our process:

(1) the traditional molded rubber plate;

(2) the photopolymer plates; and (3) the laser engraved rubber plates or rubber rollers.

There are various photopolymer plate material suitable for flexographic printing. These plates are made directly from photographic negatives.

Other embodiments of the invention will be apparent to those skilled in the art from consideration of the specification and practice of the invention disclosed herein. It is intended that the specification and example be considered as exemplary only with the true scope and spirit of the invention being indicated by the following claims.

We claim:

1. A soft, printed, embossed, single-ply absorbent paper product which has been printed either before or after embossing, said absorbent paper product having a serpentine configuration and a basis weight of at least about 12.5 lbs/3000 square feet ream and exhibiting low sidedness, said single-ply absorbent paper product formed by wet pressing of a cellulosic web, adhering said web to a Yankee dryer and creping the web from the Yankee dryer, said single-ply absorbent paper product having a Yankee side and an air side an wherein the absorbent paper is printed on thc Yankee side, the air side or both sides of said printed absorbent paper product including (a) a temporary wet strength agent comprising a wet strength resin selected from the group consisting of: uncharged aldehydes, uncharged aldhehyde resins, polyols and cyclic ureas, mixtures thereof and charged cationic starches having aldehyde moieties, and (b) a nitrogenous softening agent, the amount of the temporary wet strength agent added and the nitrogenous softener added being sufficient to produce a single-ply tissue having a specific total tensile strength of between 40 and 200 grams per 3 inches per pound per 3000 square feet ream, a cross direction specific wet tensile strength of between 2.75 and 20.0 grams per 3inches per pound per 3000 square feet ream, the ratio of MD tensile to CD tensile of between 1.25 and 2.75, a specific geometric mean tensile stiffness of between 0.5 and 3.2 grams per inch per percent strain per pound per 3000 square feet ream, a friction deviation of less than 0.250, and a sidedness parameter of less than 0.30.

2. The absorbent paper product according to claim 1, wherein said wet strength resin is applied to said product in an amount of at least about 3 lbs/ton.

3. The absorbent paper product of claim 1 in the form of a single-ply napkin.

4. The absorbent paper product of claim 1 in the form of a single-ply facial tissue.

5. The absorbent paper product of claim 1 in the form of a single-ply bathroom tissue.

6. The printed absorbent paper of claim 1 wherein the absorbent paper product exhibits a total tensile strength between 40 and 150 grams per 3 inches per 3000 square feet ream. a cross direction specific wet tensile strength of between 2.75 and 15 grams per 3 inches per pound per 3000 square feet ream, a specific geometric mean tensile stiffness or between 0.5 and 2.4 grams per inch per percent strain per pound per 3000 square feet ream, a friction deviation of less than 0.25; and a sidedness parameter of less than 0.30.

7. The absorbent paper product of claim 6 in the form of a single-ply bathroom tissue.

8. The absorbent paper product of claim 6 in the form of a single-ply facial tissue.

9. The absorbent paper product of claim 6 in the form of a single-ply napkin.

10. The absorbent paper of claim 6 wherein the absorbent paper product exhibits a specific total tensile strength of between 40 and 75 grams per 3 inches per pound per 3000 square feet ream a cross direction specific wet tensile strength between 2.75 and 7.5 grams per 3 inches per pound per 3000 square feet ream, a specific geometric mean tensile stiffness of between 0.5 and 1.2 grams per inch per percent strain per pound per 3000 square feet ream, a friction deviation of less than 0.225 and a sidedness parameter of less then 0.275.

11. The absorbent paper product of claim 10 wherein the temporary wet strength agent is selected from the group of uncharged organic compounds having aldehydic units and water soluble organic polymers comprising aldehydic units and cationic units.

12. The absorbent paper product of claim 11 in the form of a single-ply bathroom tissue.

13. The absorbent paper product of claim 10 wherein the nitrogenous softening agent is a cationic nitrogenous softening agent.

14. The absorbent paper product of claim 13 in the form of a single-ply bathroom tissue.

15. The printed bathroom tissue of claim 14 which has been printed before or after embossing exhibits puffiness and bulk having a plurality of bosses formed therein wherein the tissue has a Yankee side and an air side and wherein the bathroom tissue is printed on the Yankee side, air side or both and wherein the bosses comprise a plurality of stitch-shaped bosses arrayed to form polygonal cells making up a lattice structure; and a plurality of bosses forming a first signature emboss pattern being centrally arrayed within a plurality of cells, said first signature bosses being formed of linear continuous embossments at a height exceeding 3 thousandths of an inch and a height less than 120 thousandths of an inch;

a plurality of bosses forming a second signature emboss pattern being centrally arrayed within a plurality of cells, said second signature bosses being formed of linear crenulated embossments at a height less than 120 thousandths of an inch and defining a plurality of merlons and crenels, wherein said crenels extend to a depth of at least 2 thousandths of an inch.

16. The printed tissue according to claim 15 wherein the combination of lattice structure and signature bosses are offset from the machine direction.

17. The printed tissue according to claim 16 wherein the combination is offset from about 15 to 65 degrees from the machine direction.

18. The process of claim 16 wherein after creping the web is optionally calendered and wherein the web is embossed between mated emboss rolls, each of which contain both male and female elements.

19. The printed tissue according to claim 15 wherein the continuous signature bosses have a height of about 40 to 80 thousandths of an inch and the crenulated signature bosses have a height of about 40 to 80 thousandths of an inch.

20. The printed tissue according to claim 15 wherein the stitch-shaped bosses have a height of about 40 to 80 thousandths of an inch.

21. The printed tissue according to claim 15 wherein the diameter of the stitch-shaped boss is at least one and one-half times the width of a line of the continuous or crenulated signature boss.

22. The printed tissue according to claim 15 wherein the diameter of the stitch-shaped boss is at least twice the width of a line of the continuous or crenulated signature boss.

23. The printed tissue according to claim 15 wherein the diameter of the stitch-shaped boss is at least three times the width of a line of the continuous or crenulated signature boss.

24. The printed tissue according to claim 15 wherein said polygonal cells are diamond shaped cells.

25. The printed tissue according to claim 15 wherein said tissue is approximately 3 polygonal cells wide.

26. The printed tissue according to claim 15 wherein the polygonal cells have generator lines which connect the apices of the polygonal cells and wherein the center of the stitch-shaped boss farthest from the generator line is a distance equivalent to at least 1 diameter of said stitch-shaped boss but no more than 3 diameters of said stitch-shaped boss from said line.

27. The printed tissue according to claim 15 wherein the stitch-shaped bosses are substantially circular dots.

28. The printed tissue according to claim 15 wherein the stitch-shaped bosses resemble dashes.

29. The printed tissue according to claim 28 wherein the dashes have an aspect ratio of less than 5.

30. The printed tissue according to claim 15 wherein the polygonal cells are hexagonal cells.

31. The printed tissue according to claim 15 wherein the polygonal cells are octagonal cells.

* * * * *